US009861254B2

(12) United States Patent
Park et al.

(10) Patent No.: US 9,861,254 B2
(45) **Date of Patent: *Jan. 9, 2018**

(54) DISH WASHING MACHINE

(71) Applicant: SAMSUNG ELECTRONICS CO., LTD., Suwon-si, Gyeonggi-do (KR)

(72) Inventors: Chan Young Park, Suwon-si (KR); Min Ho Jung, Suwon-si (KR); Hyun Dong Jung, Suwon-si (KR); Soo Hyung Yoo, Incheon (KR); Chang Wook Lee, Seoul (KR); Seung Gee Hong, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 391 days.

This patent is subject to a terminal disclaimer.

(21) Appl. No.: 14/584,088

(22) Filed: Dec. 29, 2014

(65) Prior Publication Data

US 2015/0182100 A1 Jul. 2, 2015

(30) Foreign Application Priority Data

Dec. 31, 2013 (KR) ..... 10-2013-0169464
Jul. 25, 2014 (KR) ..... 10-2014-0094604

(51) Int. Cl.
*A47L 15/42* (2006.01)
*A47L 15/16* (2006.01)

(52) U.S. Cl.
CPC ..... *A47L 15/4282* (2013.01); *A47L 15/16* (2013.01); *Y10T 29/49245* (2015.01); *Y10T 29/49826* (2015.01)

(58) Field of Classification Search
CPC ..... A47L 15/4282
See application file for complete search history.

(56) References Cited

U.S. PATENT DOCUMENTS

| | | | |
|---|---|---|---|
| 2004/0003833 | A1 | 1/2004 | Elick et al. |
| 2005/0150529 | A1 | 7/2005 | Vanderroest et al. |
| 2009/0056754 | A1 | 3/2009 | Rolek |
| 2013/0319487 | A1 | 12/2013 | Hong et al. |

FOREIGN PATENT DOCUMENTS

| | | |
|---|---|---|
| EP | 2 807 970 | 12/2014 |
| JP | 2006-55480 | 3/2006 |

OTHER PUBLICATIONS

International Search Report dated May 21, 2015 in corresponding International Patent Application No. PCT/KR2014/013014.
Australian Office Action dated Mar. 31, 2017 from Australian Patent Application No. 2014374587, 3 pages.

(Continued)

*Primary Examiner* — Jason Ko
(74) *Attorney, Agent, or Firm* — Staas & Halsey LLP

(57) ABSTRACT

A dish washing machine including a drive unit to drive a vane. The drive unit includes a motor to generate driving force, a belt connected to a drive pulley and an idle pulley to transfer the driving force of the motor to the vane the motor, a rail to guide movement of the vane, a rear holder to rotatably support the drive pulley, the rear holder being coupled to one end of the rail by tension of the belt, and a front holder to rotatably support idle pulley, the front holder being coupled to the other end of the rail by the tension of the belt.

33 Claims, 53 Drawing Sheets

(56) References Cited

OTHER PUBLICATIONS

Canadian Office Action dated May 29, 2017 from Canadian Patent Application No. 2,935,057, 3 pages.
Partial Supplementary European Search Report dated Jul. 4, 2017 from European Patent Application No. 14876413.7, 10 pages.
Extended European Search Report dated Oct. 16, 2017 in European Patent Application No. 14876413.7.
Australian Notice of Acceptance for Patent Application dated Aug. 24, 2017 in Australian Patent Application No. 2014374587.

DISH WASHING MACHINE

CROSS-REFERENCE TO RELATED APPLICATIONS

This application claims the benefit of Korean Patent Application Nos. 10-2013-0169464 and 10-2014-0094604, filed on Dec. 31, 2013 and Jul. 25, 2014, respectively, in the Korean Intellectual Property Office, the disclosures of which are incorporated herein by reference.

BACKGROUND

1. Field

Embodiments of the present disclosure relate to a dish washing machine having a spray nozzle fixed to one side of a washing tub and a vane arranged to be movable in the washing tub and configured to reflect wash water sprayed from the spray nozzle toward dishes.

2. Description of the Related Art

A dish washing machine, which is a home appliance that washes dishes by spraying high-pressure water to the dishes, includes a body having a washing tub provided in the dish washing machine, a basket to accommodate dishes, a sump to store wash water, a spray nozzle to spray wash water, and a pump to supply wash water from the sump to the spray nozzle.

Generally, the dish washing machine employs a rotor-type spray structure having a rotary spray nozzle. The rotary nozzle sprays wash water while being rotated by water pressure. Such rotary nozzle sprays wash water within the radius of rotation, and thus there may be an area which the sprayed wash water does not reach. Accordingly, a linear-type spray structure is proposed such that every area is reached by the sprayed wash water.

The linear-type spray structure includes a fixed nozzle fixed to one side of the washing tub and a vane to move within the washing tub to reflect wash water sprayed from the fixed spray nozzle toward the dishes. Thereby, it may reflect the wash water to all areas of the washing tub according to movement of the reflecting plate.

The fixed nozzle may have a plurality of spray holes arranged in the lateral direction of the washing tub. The fixed nozzle may be fixed to the rear wall of the washing tub, extend in the lateral direction of the washing tub to reflect wash water sprayed from a plurality of spray holes of the vane, and be arranged to linearly reciprocate in the front-to-back direction of the washing tub.

The linear-type spray structure is further provided with a drive unit to drive the vane. The drive unit may be implemented in various forms. For example, the drive unit may include a motor, a belt connected to the motor to transfer driving power to the vane, and a rail to guide movement of the vane. When the motor is driven, the belt may rotate, causing the vane to move on the rail.

Regarding a distribution device to distribute the wash water stored in the sump to spray nozzles, the linear-type spray structure may employ a distribution device having a different structure than the distribution device of the rotor-type spray structure.

When a rotary nozzle is used as the spray nozzle disposed at a lower portion of the washing tub, arranging the outlet of the distribution device to face upward may shorten the length of a flow passage connecting the outlet of the distribution device to the rotary nozzle and minimize pressure loss of the wash water.

On the other hand, when a fixed nozzle is used as the spray nozzle disposed at the lower portion of the washing tub, the fixed nozzle is disposed close to the rear wall of the washing tub, and therefore the outlet of the distribution device does not need to be arranged to face upward. Arranging the outlet to face upward may increase pressure loss of the wash water since the flow passage connecting the outlet of the distribution device to the fixed nozzle should be bent rearward around the outlet of the distribution device.

Meanwhile, since the spray nozzles of the linear-type spray structure are fixed, targeted washing of spraying the wash water onto only one section of the washing tub may be implemented by distributing the wash water to only some of the spray nozzles.

SUMMARY

Therefore, it is an aspect of the present disclosure to provide a dish washing machine with a linear-type spray structure, which has a vane driving unit which may facilitate assembly and disassembly, reduce costs and be reliable.

Additional aspects of the disclosure will be set forth in part in the description which follows and, in part, will be apparent from the description, or may be learned by practice of the disclosure.

In accordance with one aspect of the present disclosure, a dish washing machine includes a body, a washing tub provided in the body, a fixed nozzle fixed to one side of the washing tub to spray wash water, a vane to move within the washing tub and reflect the wash water sprayed from the fixed nozzle toward dishes, and a drive unit to drive the vane, wherein the drive unit includes a motor to generate driving force, a belt connected to a drive pulley and an idle pulley to transfer the driving force of the motor to the vane the motor, a rail to guide movement of the vane, a rear holder to rotatably support the drive pulley, the rear holder being coupled to one end of the rail by tension of the belt, and a front holder to rotatably support idle pulley, the front holder being coupled to the other end of the rail by the tension of the belt.

Herein, the rail may include an inner space and a lower opening formed at a lower portion of the rail, the rail being formed in a shape of a pipe.

Herein, the belt may be disposed in the inner space of the rail.

In addition, the drive unit may further include a belt holder coupled to teeth of the belt to move along with the belt in the inner space of the rail.

Herein, the drive unit further may include a vane holder arranged to surround an outer surface of the rail and coupled to the belt holder through the lower opening of the belt to move along with the belt holder, the vane holder being coupled to the vane.

In addition, the front holder may include a front top holder, a front bottom holder, and a pulley bracket provided between the front top holder and the front bottom holder, the pulley bracket being configured to rotatably support the idle pulley.

Herein, the front holder may further include an elastic member to elastically support the pulley bracket to maintain the tension of the belt.

Herein, one end of the elastic member may be supported by the front top holder or the front bottom holder, and the other end of the elastic member may be supported by the pulley bracket.

In addition, the pulley bracket may be arranged to move with respect to the front top holder and the front bottom holder.

In addition, the elastic member may be a compression spring.

In addition, the belt may be formed of a resin material.

In addition, a drive shaft of the motor may be coupled to the drive pulley by passing through a bottom plate of the washing tub.

In accordance with another aspect of the present disclosure, a dish washing machine includes a body, a washing tub provided in the body, a sump to store wash water, a bottom plate cover coupled to one side of an bottom plate of the washing tub, a nozzle assembly including at least one fixed spray nozzle to spray the wash water received from the sump, the nozzle assembly being coupled to the bottom plate cover, a vane to move within the washing tub and reflect the wash water sprayed from the nozzle assembly toward dishes, and a rail assembly coupled to the bottom plate cover to guide movement of the vane.

Herein, the bottom plate cover may include a fastening hole to fasten the nozzle assembly and the rail assembly.

In addition, a motor to drive the vane may be coupled to a bottom surface of the bottom plate cover.

Herein, the bottom plate cover may include a shaft through hole allowing a drive shaft of the motor to pass therethrough.

The dish washing machine may further include a sealing member provided to the shaft through hole to seal the shaft through hole.

In addition, the bottom plate of the washing tub may include a motor through hole allowing the motor to pass therethrough and a flow passage through hole allowing a flow passage connecting the sump and the nozzle assembly to pass therethrough.

The dish washing machine may further include a sealing member provided between the bottom plate cover and the bottom plate of the washing tub to seal the motor through hole and the flow passage through hole.

In addition, the bottom plate cover may include a hose connector inserted into the flow passage through hole, the hose connector being connected with a hose to supply the wash water from the sump.

In accordance with another aspect of the present disclosure, a method of manufacturing a dish washing machine including a body, a washing tub, and a sump to store wash water includes assembling a nozzle assembly including at least one spray nozzle to spray the wash water received from the sump, assembling a rail assembly to guide movement of a vane, the vane being configured to move within the washing tub and reflect the wash water sprayed from the at least one spray nozzle toward dishes, preparing a bottom plate cover, assembling a bottom plate cover assembly by coupling the nozzle assembly, the rail assembly, and the bottom plate cover, and coupling the bottom plate cover assembly to one side of a bottom plate of the washing tub.

The method may further including coupling a motor to drive the vane to a bottom surface of the bottom plate cover.

The method may further include coupling a sealing member to a drive shaft of a motor such that a shaft through hole formed in the bottom plate cover is sealed.

The method may further include coupling a sealing member between the bottom plate cover and a bottom plate of the washing tub such that a motor through hole and flow passage through hole formed in a bottom plate of the washing tub are sealed.

The assembling of the rail assembly may include connecting a belt to a drive pulley, coupling a rear holder to one end of the rail, the rear holder being configured to rotatably support the drive pulley, connecting the belt to an idle pulley, and coupling a front holder to the other end of the rail through tension of the belt, the front holder being configured to rotatably support the idle pulley.

In accordance with another aspect of the present disclosure, a dish washing machine includes a body, a washing tub disposed inside the body, a fixed nozzle fixed on one side of the washing tub to spray wash water, a vane moving inside the washing tub to reflect the wash water sprayed from the fixed nozzle toward dishes, and a drive unit configured to drive the vane. The drive unit includes a motor configured to generate a driving force, a rail configured to guide movement of the vane, a drive pulley disposed on one side of the rail and connected to a driving shaft of the motor, an idle pulley disposed on the other side of the rail, and a belt including a belt body having a belt portion and a tooth, and a core wire buried in the belt body, to transfer the driving force of the motor to the vane.

The belt body may be formed of polyurethane, and the core wire may include aramid fibers.

The rail may have a tubular shape with an internal space and a lower opening formed at a lower portion thereof.

The belt may be disposed in the internal space of the rail.

The drive unit may further include a belt holder coupled with the tooth of the belt to move along the belt in the internal space of the rail.

The drive unit may further include a vane holder formed to surround an outer surface of the rail, coupled with the belt holder through the lower opening to move along the belt holder, and coupled with the vane.

In accordance with another aspect of the present disclosure, a dish washing machine includes a body, a washing tub disposed inside the body, a fixed nozzle fixed on one side of the washing tub to spray wash water, a vane moving inside the washing tub to reflect the wash water sprayed from the fixed nozzle toward dishes, and a drive unit configured to drive the vane. The drive unit includes a motor configured to generate a driving force, a rail configured to guide movement of the vane, a belt including a belt body having a belt portion and a tooth, and a core wire buried in the belt body, to transfer the driving force of the motor to the vane, and a tension control device configured to control a tension of the belt.

The tension control device may include an elastic member coupled to a rotary shaft of an idle pulley to apply pressure to the idle pulley in a direction in which a tension is applied to the belt.

The tension control device may include a position controller configured to move the idle pulley in a longitudinal direction of the rail.

The position controller may include a slide member coupled with the rotary shaft of the idle pulley and movable in the longitudinal direction of the rail.

The position controller may include a control member configured to apply pressure to the slide member so as to move the slide member.

The control member may include a screw.

The tension control device may include a pressing device configured to apply pressure to an opposite surface to the tooth of the belt so as to control a tension of the belt.

The pressing device may include a press member in contact with the opposite surface to the tooth of the belt.

The pressing device may include a slide member coupled to the press member and movable in a direction perpendicular to the belt.

The pressing device may include a control member configured to apply pressure to the slide member so as to move the slide member.

The control member may include a screw.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
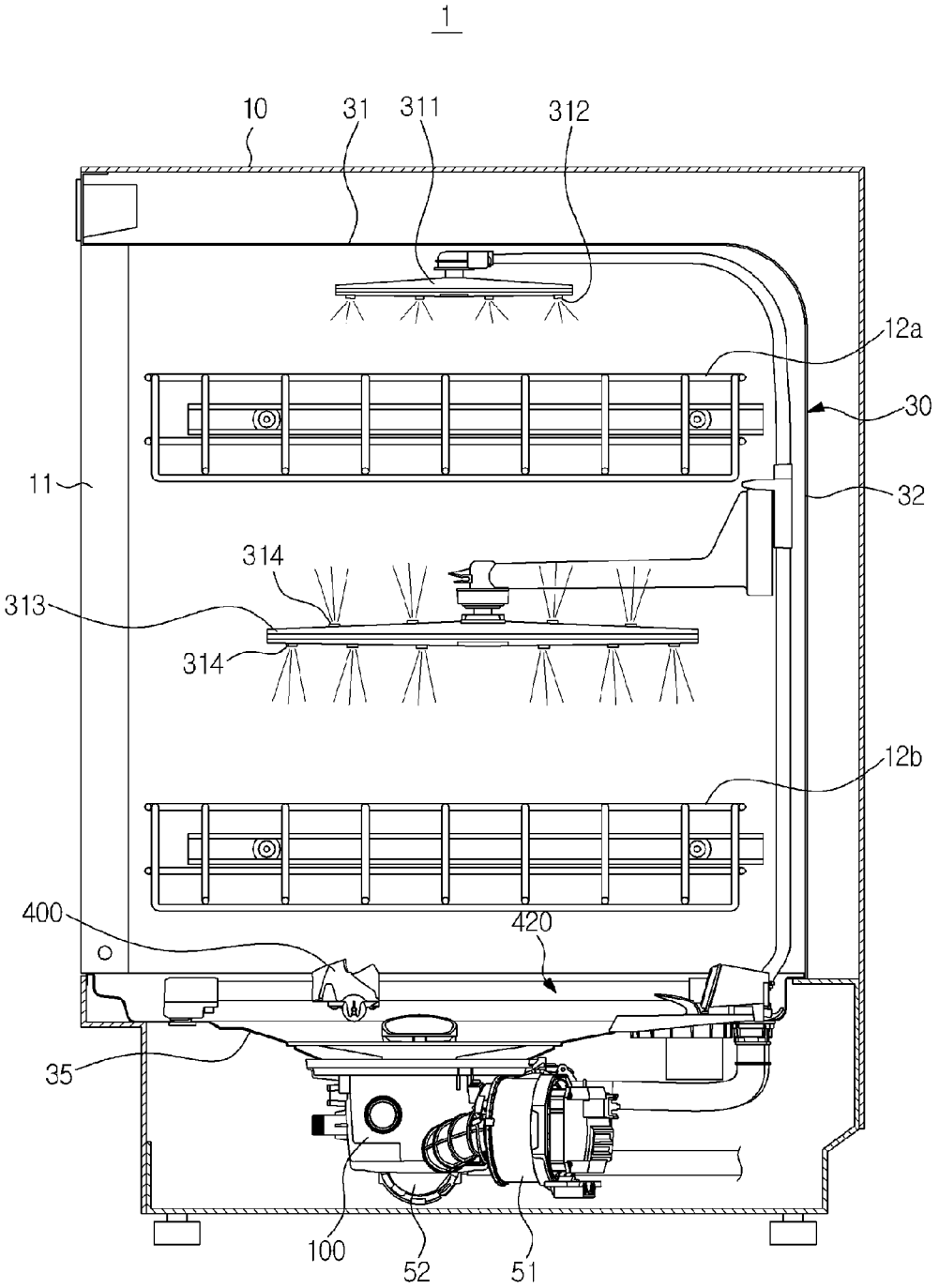
FIG. 1 is a cross-sectional view schematically illustrating a dish washing machine according to an exemplary embodiment of the present disclosure.

Reference will now be made in detail to the embodiments of the present disclosure, examples of which are illustrated in the accompanying drawings, wherein like reference numerals refer to like elements throughout.

Figure 2:
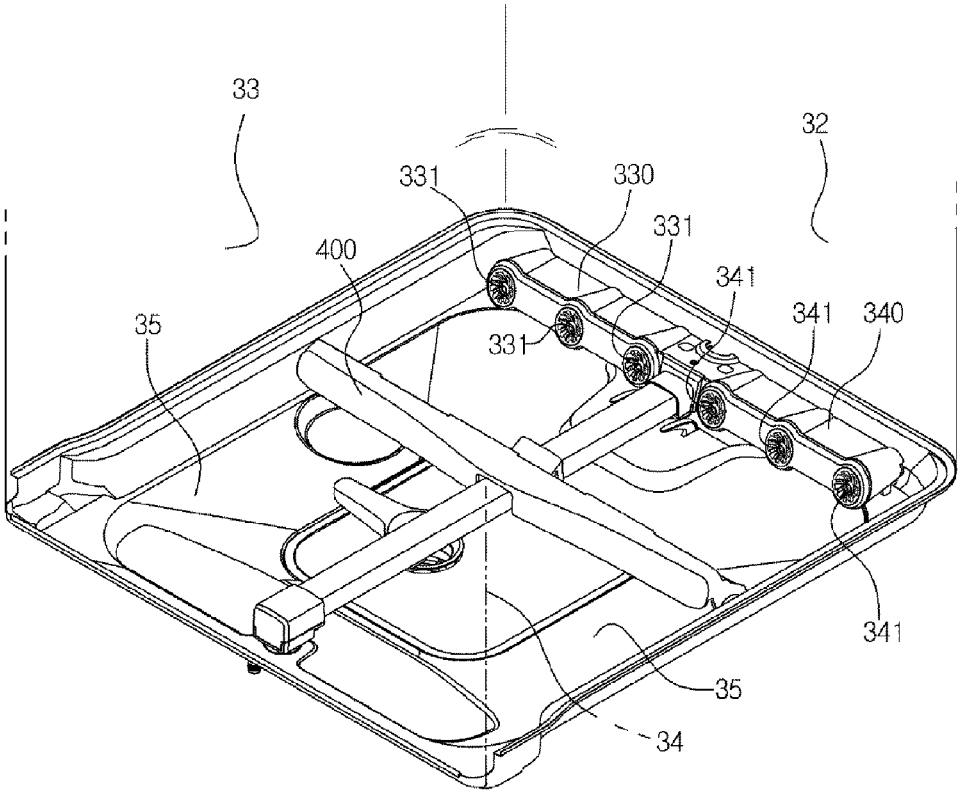
FIG. 2 is a view illustrating the lower portion of the dish washing machine of FIG. 1.

FIG. 1 is a cross-sectional view schematically illustrating a dish washing machine according to an exemplary embodiment of the present disclosure. FIG. 2 is a view illustrating the lower portion of the dish washing machine of FIG. 1.

The overall structure of a dish washing machine according to one embodiment of the present disclosure will be schematically described with reference to FIGS. 1 and 2.

A dish washing machine 1 includes a body 10 forming the exterior of the dish washing machine, a washing tub 30 provided in the body 10, baskets 12*a* and 12*b* provided in the washing tub 30 to accommodate dishes, spray nozzles 311, 313, 330 and 340 to spray wash water, a sump 100 to store the wash water, a circulation pump 51 to pump out the wash water from the sump 100 to supply the wash water to the spray nozzles 311, 313, 330 and 340, a drainage pump 52 to discharge the wash water in the sump 100 and dirt from the body 10, a vane 400 to move within the washing tub 30 to reflect the wash water toward the dishes, and a drive unit 420 to drive the vane 400.

The washing tub 30 may be formed approximately in the shape of a box provided with an opening at the front thereof to allow dishes to be put therein and withdrawn therefrom. The front opening of the washing tub 30 may be opened and closed by a door 11. The washing tub 30 may have an upper wall 31, a rear wall 32, a left sidewall 33, a right sidewall 34, and a bottom plate 35.

The baskets 12*a* and 12*b* may be wire racks formed by wires to allow the wash water to pass therethrough rather than being trapped therein. The baskets 12*a* and 12*b* may be detachably provided in the washing tub. The baskets 12*a* and 12*b* may include an upper basket 12*a* disposed at an upper portion of the washing tub and a lower basket 12*b* disposed at a lower portion of the washing tub 30.

The spray nozzles 311, 313, 330 and 340 may spray wash water at high pressure to wash the dishes. The spray nozzles 311, 313, 330 and 340 may include an upper rotary nozzle 311 provided at the upper portion of the washing tub 30, a middle rotary nozzle 313 provided at the center of the washing tub 30, and fixed nozzles 330 and 340 provided at the lower portion of the washing tub 30.

The upper rotary nozzle 311 may be arranged at the upper side of the upper basket 12*a*, and spray wash water downward while being rotated by water pressure. To this end, the lower end of the upper rotary nozzle 311 may be provided with spray holes 312. The upper rotary nozzle 311 may spray the wash water directly toward the dishes accommodated in the upper basket 12*a*.

The middle rotary nozzle 313 may be arranged between the upper basket 12*a* and the lower basket 12*b*, and be rotated by water pressure such that the wash water is vertically sprayed. To this end, the upper and lower ends of the middle rotary nozzle 313 may be provided with spray holes 314. The middle rotary nozzle 313 may spray wash water directly toward the dishes accommodated in the upper basket 12*a* and the lower basket 12*b*.

Unlike the rotary nozzles 311 and 313, the fixed nozzles 330 and 340 may be arranged not to be movable and fixed to one side of the washing tub 30. The fixed nozzles 330 and 340 may be disposed approximately adjacent to the rear wall 32 of the washing tub 30, so as to spray wash water toward the front of the washing tub 30. Accordingly, the wash water sprayed from the fixed nozzles 330 and 340 may not be directed toward the dishes.

The wash water sprayed from the fixed nozzles 330 and 340 may be reflected toward the dishes by the vane 400. The fixed nozzles 330 and 340 may be disposed below the lower basket 12*b*, and the vane 400 may reflect the wash water sprayed from the fixed nozzles 330 and 340 upward. That is, the wash water sprayed from the fixed nozzles 330 and 340 may be reflected toward the dishes accommodated in the lower basket 12*b* by the vane 400.

Each of the fixed nozzles 330 and 340 may be provided with a plurality of spray holes 331, 341 arranged in the lateral direction of the washing tub 30. The spray holes 331 and 341 may spray the wash water forward.

The vane 400 may extend in the lateral direction of the washing tub 30 so as to reflect all the wash water sprayed from the spray holes 331 and 341 of the fixed nozzles 330 and 340. That is, one longitudinal end of the vane 400 may be adjacent to the left sidewall 33 of the washing tub 30, and the other longitudinal end of the vane 400 may be adjacent to the right sidewall 34 of the washing tub 30.

The vane 400 may linearly reciprocate in the spray direction of the wash water sprayed from the fixed nozzles 330 and 340. That is, the vane 400 may linearly reciprocate in the front-to-back direction of the washing tub 30.

Therefore, the linear spray structure including the fixed nozzles 330 and 340 and the vane 400 may wash the entirety of the washing tub 30 without leaving an uncovered area. This structure is discriminated from the rotary nozzles, which spray the wash water only to the regions within the radius of rotation thereof.

The fixed nozzles 330 and 340 may include a left fixed nozzle 330 disposed at the left part of the washing tub 30 and a right fixed nozzle 340 disposed at the right part of the washing tub 30.

As described below, the rotary nozzles 311 and 313 and the fixed nozzles 330 and 340 may independently spray wash water. Further, the left fixed nozzle 330 and the right fixed nozzle 340 may independently spray wash water.

The wash water sprayed from the left fixed nozzle 330 may be reflected only to the left region of the washing tub 30 by the vane 400, and the washing water sprayed from the right fixed nozzle 340 may be sprayed only to the right region of the washing tub 30 by the vane 400.

Accordingly, the dish washing machine may wash the left region and right region of the washing tub 30 separately.

Unlike this embodiment, the region to be washed is not simply divided into the left and right regions. When necessary, the region may be divided into more regions.

The main elements of the dish washing machine of this embodiment as discussed above will be described below.

Figure 3:
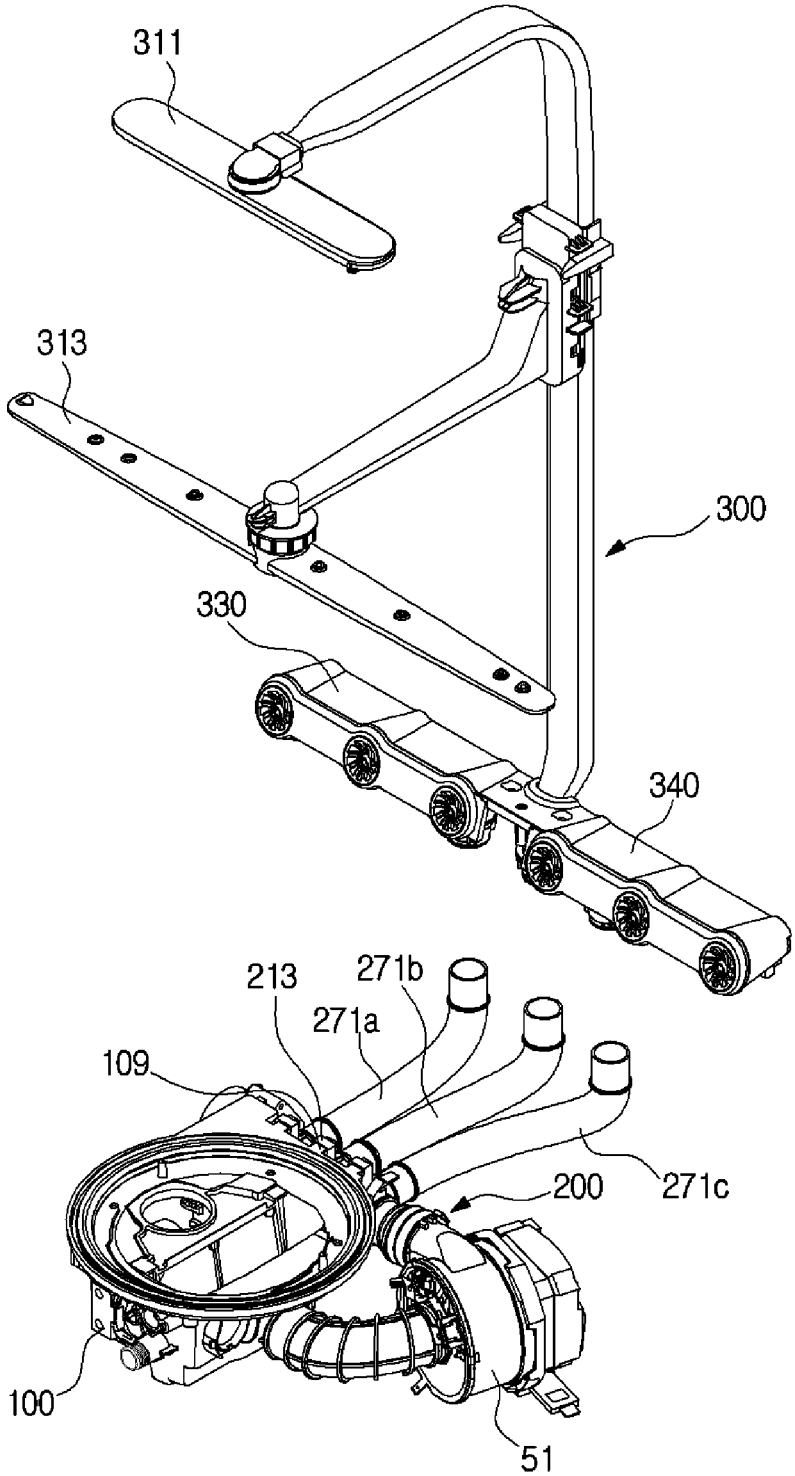
FIG. 3 is a view illustrating a flow passage structure of the dish washing machine of FIG. 1.
Figure 4:
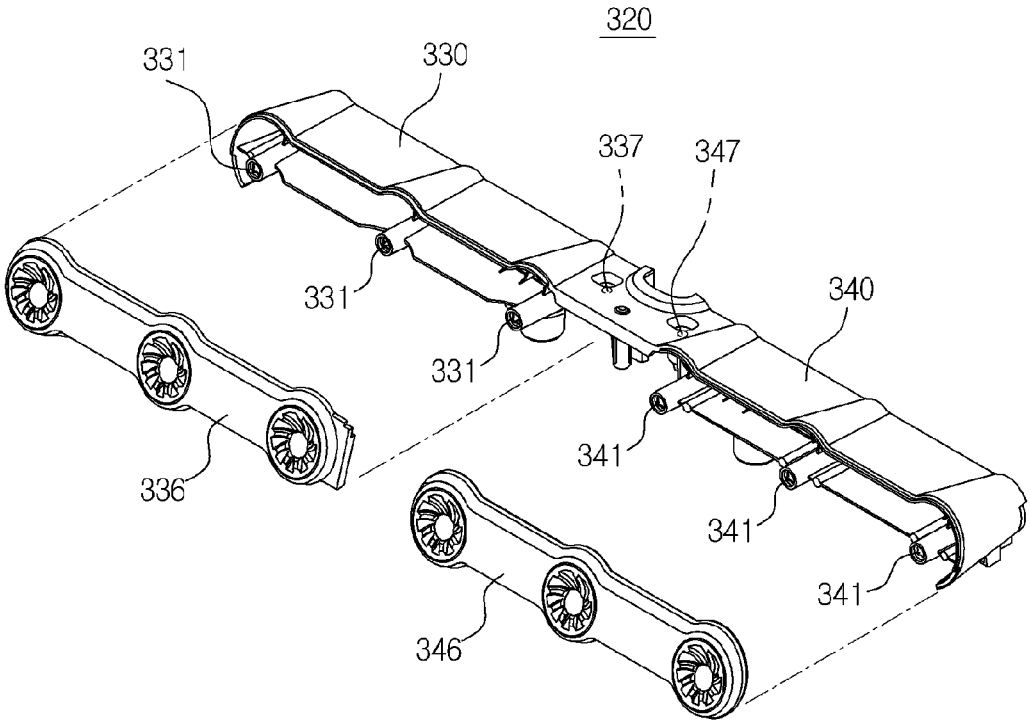
FIG. 4 is an exploded view illustrating a fixed nozzle assembly of the dish washing machine of FIG. 1.
Figure 5:
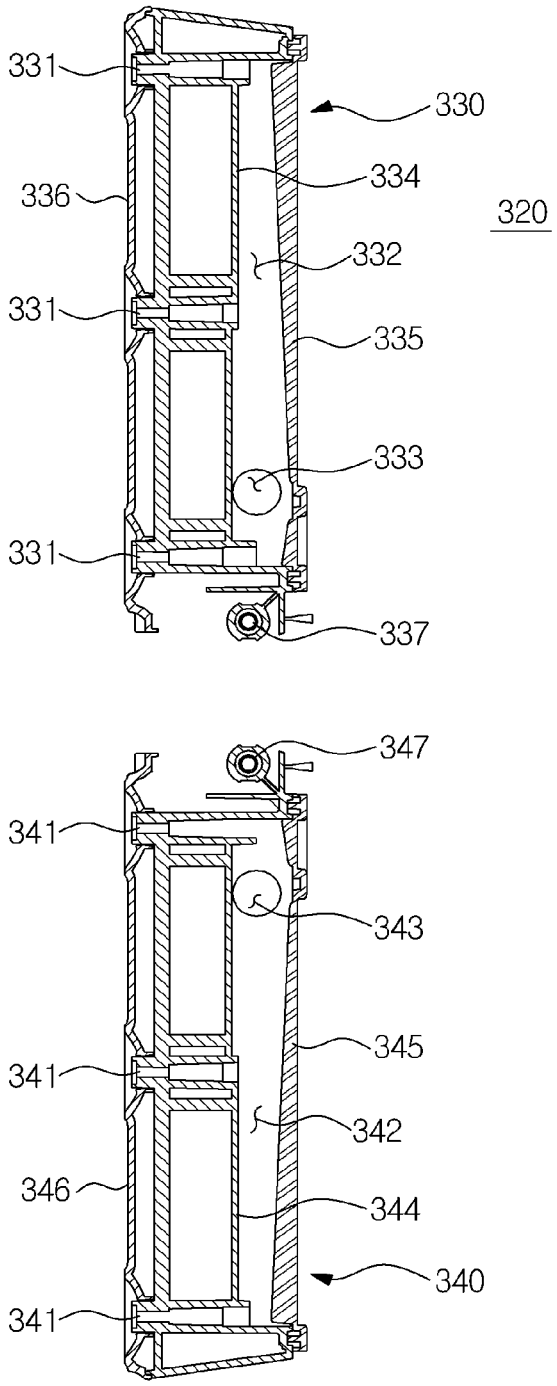
FIG. 5 is a cross-sectional view illustrating the fixed nozzle assembly of the dish washing machine of FIG. 1.

FIG. 3 is a view illustrating a flow passage structure of the dish washing machine of FIG. 1. FIG. 4 is an exploded view illustrating a fixed nozzle assembly of the dish washing machine of FIG. 1. FIG. 5 is a cross-sectional view illustrating the fixed nozzle assembly of the dish washing machine of FIG. 1.

Hereinafter, cycles of a dish washing machine, flow passage structure, structure of a fixed nozzle assembly and wash water distribution structure according to one embodiment of the present disclosure will be described with reference to FIGS. 3 to 5.

The dish washing machine may have a water supply cycle, a washing cycle, a drainage cycle, and a drying cycle.

In the water supply cycle, wash water may be supplied into the washing tub 30 through a water supply pipe (not shown). The wash water supplied to the washing tub 30 may be caused to flow to the sump 100 provided to the lower portion of the washing tub 30 and be stored in the sump 100 by the gradient of the bottom plate 35 of the washing tub 30.

In the washing cycle, the circulation pump 51 may be driven to pump out the wash water from the sump 100. The wash water pumped out by the circulation pump 51 may be distributed the rotary nozzles 311 and 313, the left fixed nozzle 330, and the right fixed nozzle 340 through a distribution device 200. The wash water may be sprayed from the spray nozzles 311, 313, 330 and 340 at high pressure to wash the dishes by the pumping force of the circulation pump 51.

Herein, the upper rotary nozzle 311 and the middle rotary nozzle 313 may receive the wash water from the distribution device 200 through a second hose 271*b*. The left fixed nozzle 330 may receive the wash water from the distribution device 200 through a first hose 271*a*. The right fixed nozzle 340 may receive the wash water from the distribution device 200 through a third hose 271*c*.

In this embodiment, the distribution device 200 has at least four distribution modes.

In the first mode, the distribution device 200 supplies wash water only to the rotary nozzles 311 and 313 through the second hose 271*b*.

In the second mode, the distribution device 200 supplies wash water only to the right fixed nozzle 340 through the third hose 271*c*.

In the third mode, the distribution device 200 supplies wash water only to the left fixed nozzle 330 and the right fixed nozzle 340 through the first hose 271*a* and the third hose 271*c*.

In the fourth mode, the distribution device 200 supplies wash water only to the left fixed nozzle 330 through the first hose 271*a*.

The distribution device 200 may have other various distribution modes, without being limited to this embodiment.

The wash water sprayed from the spray nozzles 311, 313, 330 and 340 may remove dirt from the dishes by striking the dishes, falling together with removed dirt or food particles, and then return to the sump 100. The circulation pump 51 pumps and circulates the wash water stored in the sump 100 again. During the washing cycle, driving and stopping of the circulation pump 51 may be repeated several times. During this process, the dirt having fallen to the sump 100 along with the wash water is caught by a filter mounted to the sump 100 such that the dirt remains in the sump 100 without being circulated to the spray nozzles 311, 313, 330 and 340.

In the drainage cycle, the drainage pump 52 may be driven to discharge, from the body 10, the dirt or food particles and wash water remaining in the sump 100.

In the drying cycle, a heater (not shown) mounted to the washing tub 30 may be driven to dry the dishes.

Hereinafter, structures of the left fixed nozzle 330 and the right fixed nozzle 340 will be described.

The left fixed nozzle 330 may include the spray holes 331 to spray wash water, a nozzle flow passage 332 to supply the wash water to the spray holes 331, a nozzle inlet 333 allowing the wash water to flow into the nozzle flow passage 332 therethrough, a nozzle body 334 forming the exterior of the left fixed nozzle, a nozzle cover 335 coupled to the back of the nozzle body 334 to define the nozzle flow passage 332, a decorative member 336 coupled to the front of the nozzle body 334, and a coupling hole 337 formed in the nozzle body 334 such that the left fixed nozzle 330 is coupled to a bottom plate cover 600 (FIG. 19), which will be described later.

The right fixed nozzle 340 may include the spray holes 341 to spray the wash water, a nozzle flow passage 342 to supply the wash water to the spray holes 341, a nozzle inlet 343 allowing the wash water to flow into the nozzle flow passage 342 therethrough, a nozzle body 344 forming the exterior of the right fixed nozzle, a nozzle cover 345 coupled to the back of the nozzle body 344 to form the nozzle flow passage 342, a decoration member 346 coupled to the front of the nozzle body 344, and the coupling hole 347 formed in the nozzle body 344 such that the right fixed nozzle 340 is coupled to the bottom plate cover 600, which will be described later.

Herein, the nozzle body 334 of the left fixed nozzle 330 may be integrated with the nozzle body 344 of the right fixed nozzle 340. Thereby, the left fixed nozzle 330 and the right fixed nozzle 340 may form one body.

As the left fixed nozzle 330 is integrated with the right fixed nozzle 340, horizontal alignment of the left fixed nozzle 330 and the right fixed nozzle 340 may be facilitated, and coupling the left fixed nozzle 330 and the right fixed nozzle 340 to the bottom plate cover 600 may be facilitated.

A fixed nozzle assembly 320 includes the left fixed nozzle 330 and the right fixed nozzle 340. A nozzle assembly 300 includes the fixed nozzle assembly 320, the upper rotary nozzle 311, and the middle rotary nozzle 313.

Figure 6:
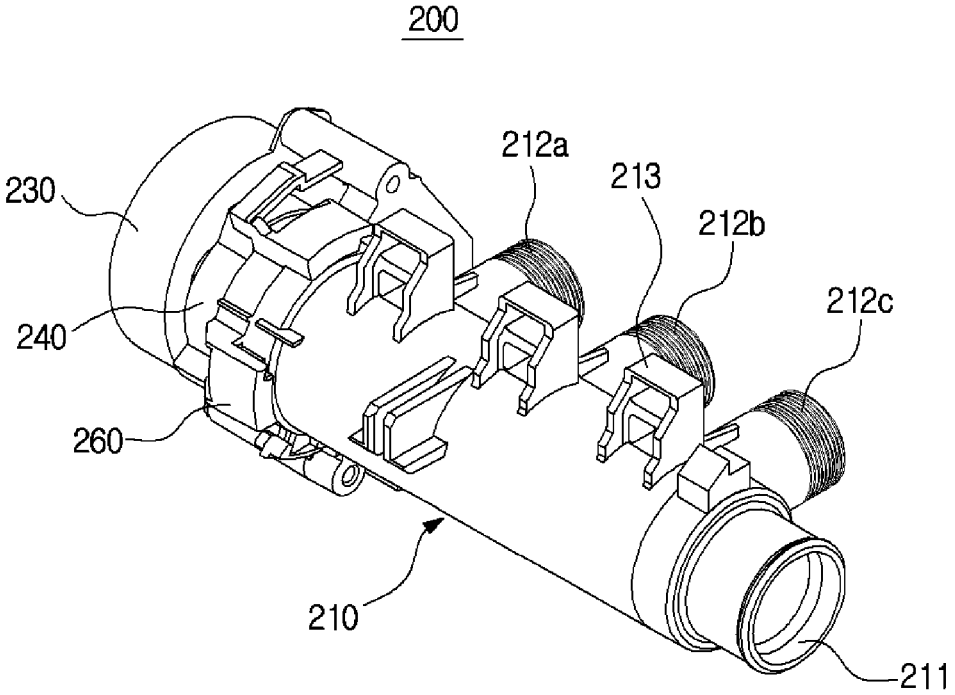
FIG. 6 is a view illustrating a distribution device of the dish washing machine of FIG. 1.
Figure 7:
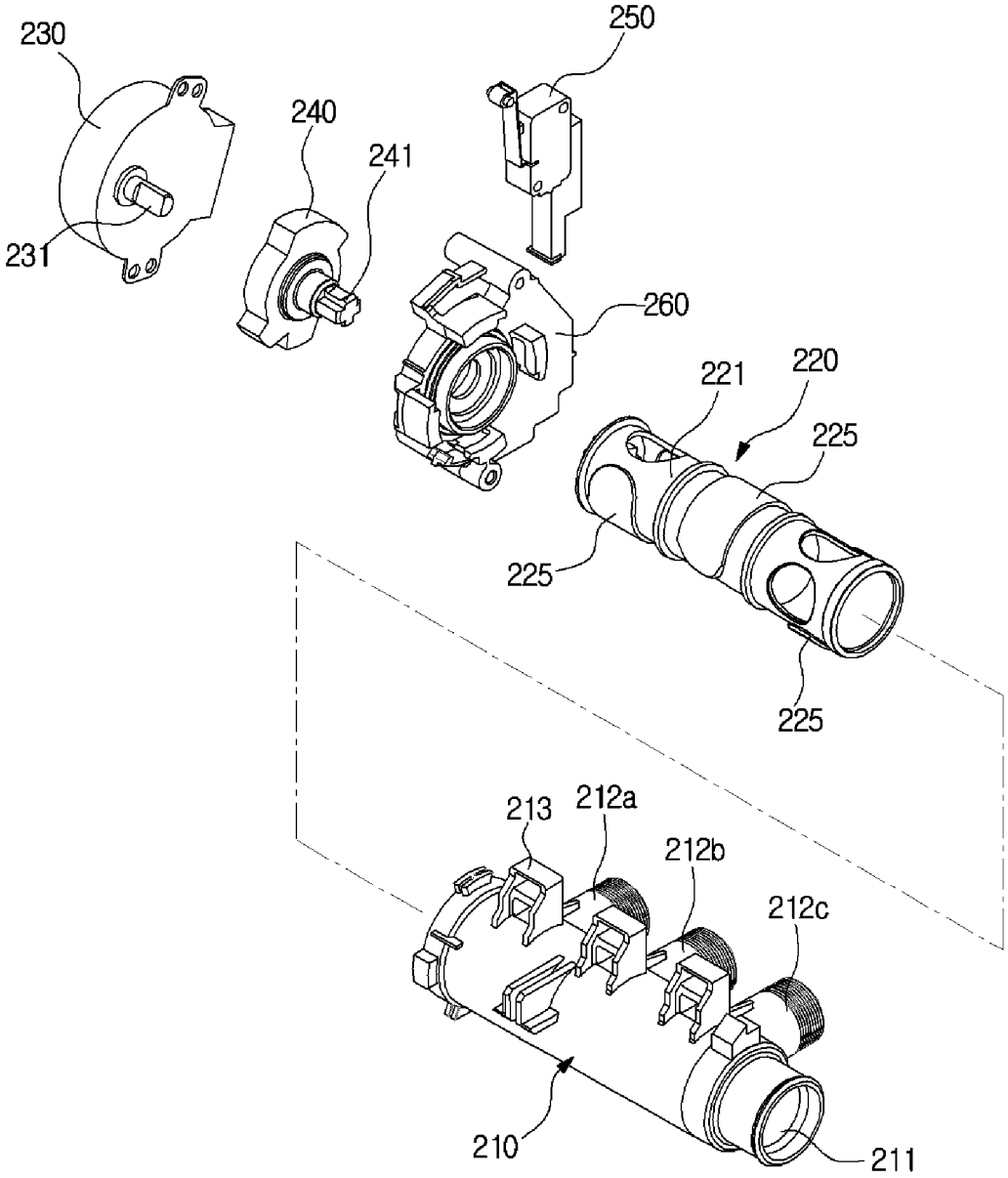
FIG. 7 is an exploded view illustrating elements of the distribution device of the dish washing machine of FIG. 1.
Figure 8:
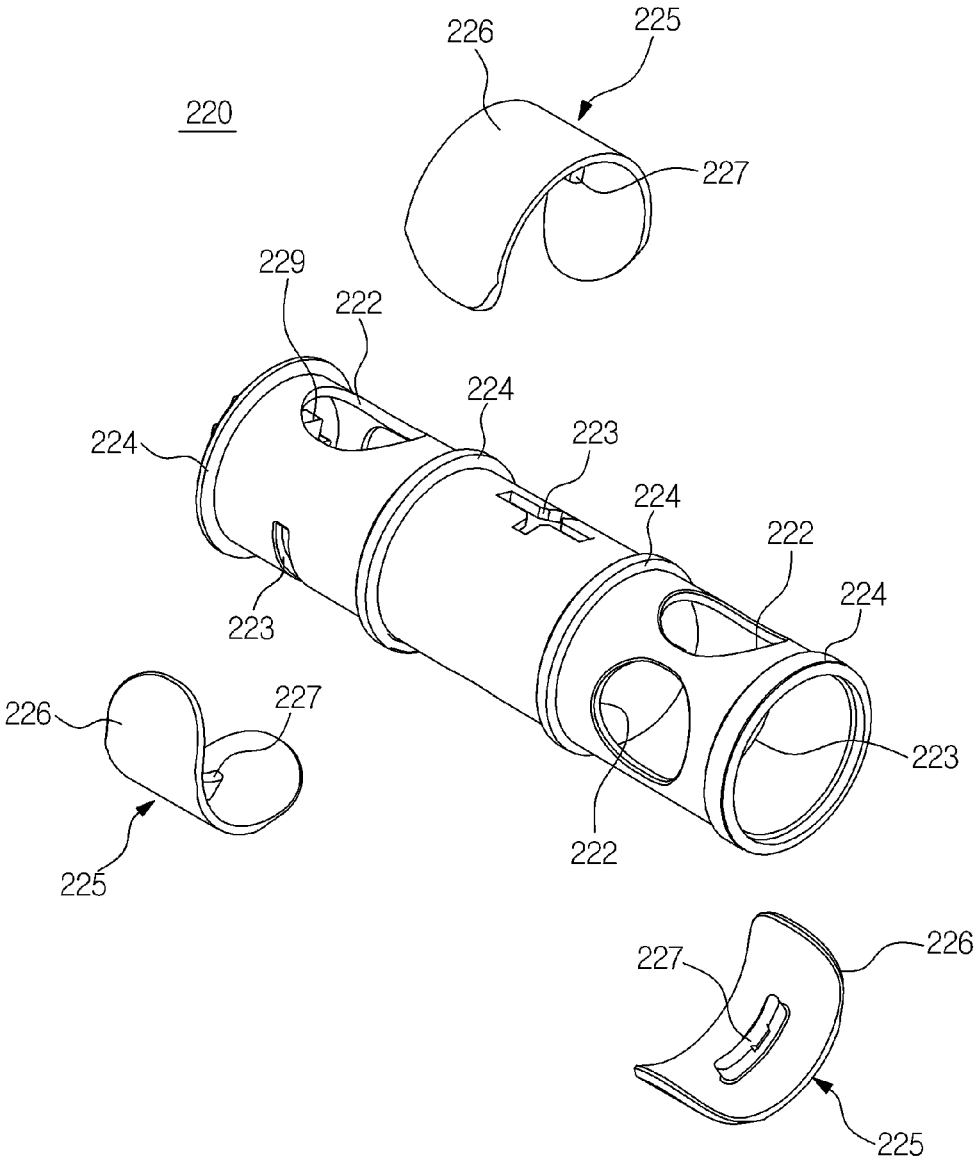
FIG. 8 is an exploded view illustrating an opening and closing member of the distribution device of the dish washing machine shown in FIG. 1.
Figure 9:
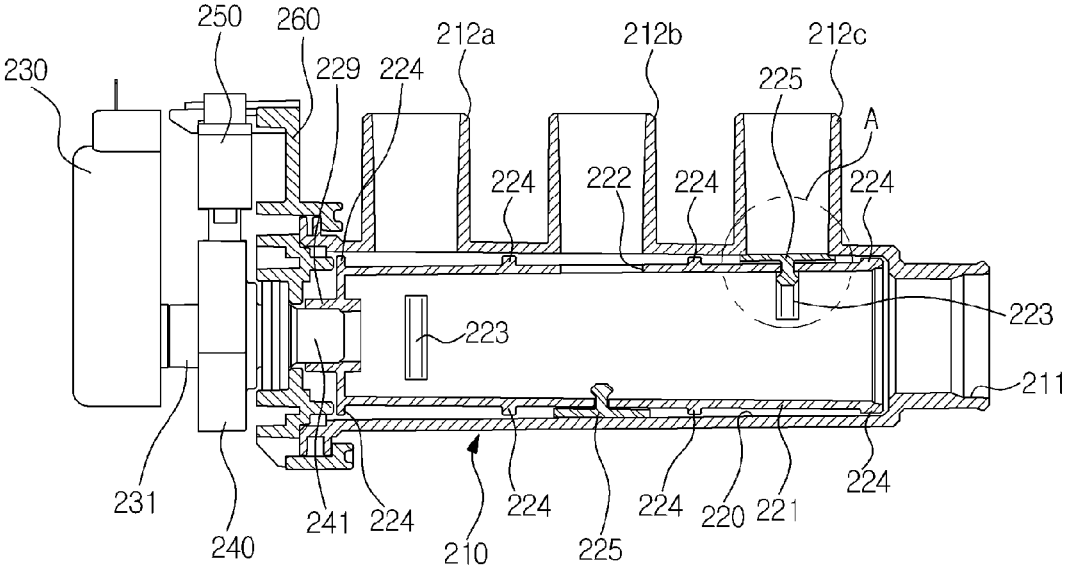
FIG. 9 is a cross-sectional view illustrating the distribution device of the washing machine of FIG. 1.
Figure 10:
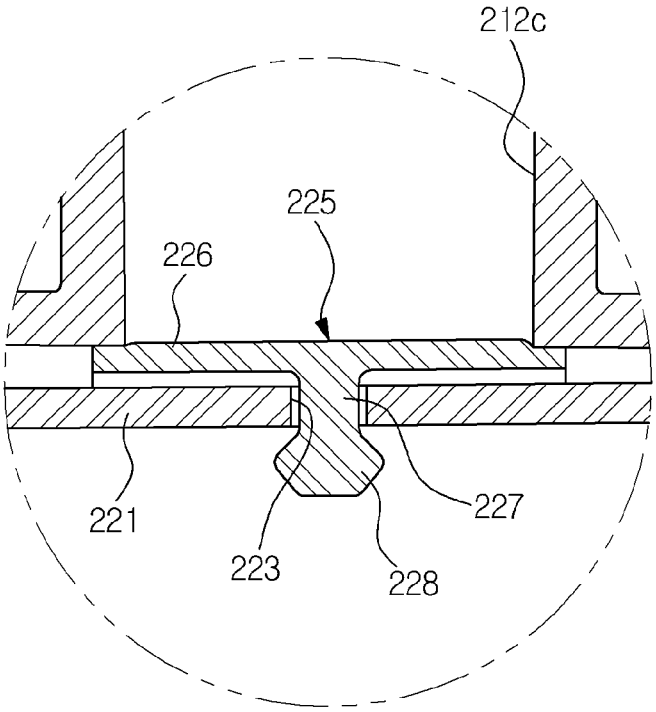
FIG. 10 is an enlarged view illustrating portion A of FIG. 9.

FIG. 6 is a view illustrating a distribution device of the dish washing machine of FIG. 1. FIG. 7 is an exploded view illustrating elements of the distribution device of the dish washing machine of FIG. 1. FIG. 8 is an exploded view illustrating an opening and closing member of the distribution device of the dish washing machine shown in FIG. 1. FIG. 9 is a cross-sectional view illustrating the distribution device of the washing machine of FIG. 1. FIG. 10 is an enlarged view illustrating portion A of FIG. 9.

Hereinafter, a distribution device of a dish washing machine according to one embodiment of the present disclosure will be described with reference to FIGS. 6 to 10.

The distribution device 200 is formed in an approximately cylindrical shape.

The distribution device 200 includes a housing 210 having a shape of an approximately hollow cylinder and forming the exterior of the distribution device 200, an opening and closing member 220 rotatably provided in the housing 210, a motor 230 to rotate the opening and closing member 220, a support member 260 to support the motor 230 and the housing 210, a cam member 240 coupled to the motor 230 and the opening and closing member 200 to rotate together with the opening and closing member 200, and a microswitch 250 contacting the cam member 240 to sense the rotation position of the opening and closing member 200.

The housing 210 may be disposed to extend toward both of the sidewalls 33 and 34 (FIG. 2) of the washing tub 30. Hereinafter, the longitudinal direction of the housing 210 will be referred to as the axial direction. One end of the housing 210 in the axial direction is provided with an inlet 211 allowing the wash water to flow into the housing 210 therethrough. The other end of the housing 210 in the axial direction is provided with the motor 230.

Specifically, the inlet 211 may be arranged to face the right sidewall 34 of the washing tub 30. The inlet 211 is connected with the circulation pump 51, and thus the wash water stored in the sump 100 may flow into the housing 210 through the inlet 211 when the circulation pump 51 is driven.

The circumferential surface of the housing 210 is provided with outlets 212*a*, 212*b* and 212*c*. The outlets 212*a*, 212*b* and 212*c* are spaced a certain distance from each other in the axial direction. The outlets 212*a*, 212*b* and 212*c* include a first outlet 212*a*, a second outlet 212*b*, and a third outlet 212*c*.

Herein, the outlets 212*a*, 212*b* and 212*c* are arranged to face the rear wall 32 (FIG. 2) of the washing tub 30. This is because the housing 210 of the distribution device 200 has a cylindrical shape, the housing 210 is disposed to extend toward both of the sidewalls 33 and 34, and the opening and closing member 220 opens and closes the outlets 212*a*, 212*b* and 212*c* by rotating about the axial direction of the housing 210.

For reference, a distribution device generally used in a conventional dish washing machine has a semispherical housing and a flat-disc type opening and closing device rotatably provided to the upper portion of the housing, and accordingly the outlets are inevitably provided to the upper portion of the distribution device.

Since the outlets 212*a*, 212*b* and 212*c* of the distribution device 200 are arranged to face the rear wall 32 of the washing tub 30 as described above, pressure loss in the wash water supplied to the fixed nozzles 330 and 340 disposed adjacent to the rear wall 32 of the washing tub 30 in the distribution device 200 may be reduced.

This is possible since the flow passage connecting the outlets 212*a*, 212*b* and 212*c* to the fixed nozzles 330 and 340 may be smoothly formed without a bent portion that is sharply bent.

On the contrary, if the conventional distribution device having the outlets facing the upper side of the distribution device is applied to the fixed nozzles 330 and 340 of this embodiment, the flow passage connected to the outlets may have to be sharply bent rearward right at the outlets, and thus pressure loss may increase.

The first outlet 212*a*, the second outlet 212*b*, and the third outlet 212*c* may be arranged in order from the left side to right side of the washing tub 30.

That is, the first outlet 212*a* is relatively close to the left fixed nozzle 330, the third outlet 212*c* is disposed relatively close to the right fixed nozzle 340, and the second outlet 212*b* is disposed at the center between the above outlets.

The first outlet 212*a* may be connected to the left fixed nozzle 330 through the first hose 271*a* (FIG. 3). The second outlet 212*b* may be connected to the rotary nozzles 311 and 313 through the second hose 271*b* (FIG. 3). The third outlet 212*c* may be connected to the right fixed nozzle 340 through the third hose 271*c* (FIG. 3).

As described above, each of the outlets 212*a*, 212*b* and 212*c* is connected to a corresponding one of the spray nozzles 311, 313, 330 and 340 that is relatively close thereto, and therefore each of hoses 271*a*, 271*b* and 271*c* may be shortened and prevented from being entangled, and pressure loss in the wash water may be reduced.

The housing 210 may be provided with a sump coupling part 213 to be coupled to the sump 100, and the sump 100 may be provided with a distribution device coupling part 109 (FIG. 3) to be coupled to the sump coupling part 213. In this embodiment, the sump coupling part 223 is formed in a recessed shape, and the distribution device coupling part 109 is formed in a protruding shape. As the sump coupling part 213 is coupled to the distribution device coupling part 109, the distribution device 200 and the sump 100 may be aligned.

The opening and closing member 220 selectively opens and closes the outlets 212*a*, 212*b* and 212*c* by rotating about the axial direction of the housing 210 within the housing 210. Accordingly, the opening and closing member 220 substantially functions to distribute the wash water to the spray nozzles 311, 313, 330 and 340.

The opening and closing member 220 is formed approximately in the shape of a hollow cylinder. The opening and closing member 220 includes a rotary body 221 to rotate in the housing 210, and sealing members 225 coupled to the rotary body 221 to close the outlets 212*a*, 212*b* and 212*c*.

The circumferential surface of the rotary body 221 may be provided with communication holes 222. When the communication holes 222 are positioned to correspond to the outlets 212*a*, 212*b* and 212*c*, they may allow the wash water to smoothly flow to the outlets 212*a*, 212*b* and 212*c*.

In addition, the circumferential surface of the rotary body 221 may be provided with spacing protrusions 224 to space the inner circumferential surface of the housing 210 and the outer circumferential surface of the rotary body 222 from each other by a predetermined distance to minimize friction between the opening and closing member 220 and the housing 210 to allow smooth rotation of the opening and closing member 220 in the housing 210. The inner circumferential surface of the housing 210 and the outer circumferential surface of the rotary body 222 may be kept spaced a constant distance from each other by the spacing protrusions 224.

In addition, the circumferential surface of the rotary body 221 may be provided with engagement holes 223 to which the sealing members 225 are coupled. Engagement projections 227 of the sealing members 225 are coupled to the engagement holes 223. The engagement holes 223 may be formed in different shapes to correspond to the shapes of the engagement projections 227 of the sealing members 225.

For example, the engagement hole 223 positioned in the middle of the holes may be formed approximately in a cross shape, while the engagement holes 223 on both sides of the center hole may have a slot shape. Similarly, the engagement projection 227 of the central sealing member 225 may have a cross shape, while the engagement projections 227 on both sides of the central engagement projection 227 may have a slot shape.

Providing different shapes as above is intended to allow easy identification of the sealing member 225 in the assembly operation when the shape of the sealing member 225 coupled to a center portion is different from that of the sealing members 225 coupled to both sides of the center portion.

One of both axial direction ends of the rotary body 221 which corresponds to the inlet 211 of the housing 220 is open. The other one of both axial direction ends of the rotary body 221 is provided with a cam shaft coupling part 229, to which a cam shaft 241 of the cam member 240 is coupled.

The sealing members 225 are coupled to the circumferential surface of the rotary body 221 to close the outlets 212*a*, 212*b* and 212*c*. The sealing members 225 are coupled to the engagement holes 223 of the rotary body 221. The sealing members 225 are coupled such that they are movable more or less in the radial direction of the engagement holes 223 of the rotary body 221. This is intended to enhance sealing of the outlets 212*a*, 212*b* and 212*c* through close contact between the sealing members 225 and the outlets 212*a*, 212*b* and 212*c*.

That is, the sealing members 225 move between the open position, at which the sealing members 225 closely contact the rotary body 221, and the closed position, at which the sealing members 225 closely contact the outlets 212*a*, 212*b* and 212*c*. When the wash water flows into the housing 210, the sealing members 225 may be smoothly moved from the open position to the closed position by the pressure of the wash water. Thereby, sealing of the outlets 212*a*, 212*b* and 212*c* may be improved, enhancing reliability of the distribution device 200.

Each of the sealing members 225 includes a sealing part 226 (FIG. 8) formed in a curved shape to closely contact the outlet 212*a*, 212*b*, 212*c*, and an engagement projection 227 protruding from the sealing part 226 to be inserted into the engagement hole 223 of the rotary body 221.

The engagement projection 227 and the engagement hole 223 are spaced from each other to allow the sealing member 225 to move in the radial direction. Instead, one end of the engagement projection 227 may be provided with a stopper part 228 having a lager diameter than the engagement hole 223 in order to prevent complete separation of the sealing member 225 from the engagement hole 223.

The sealing member 225 may be integrally formed of a resin material. The sealing member 225 may be readily connected to the rotary body 221 by strongly pressing the engagement projection 227 such that the engagement projection 227 is inserted into the engagement hole 223. Once connection is completed, the stopper part 228 is engaged with the engagement hole 223 and is thus not separated from the rotary body 221 as long as force is not manually applied thereto.

Figure 11:
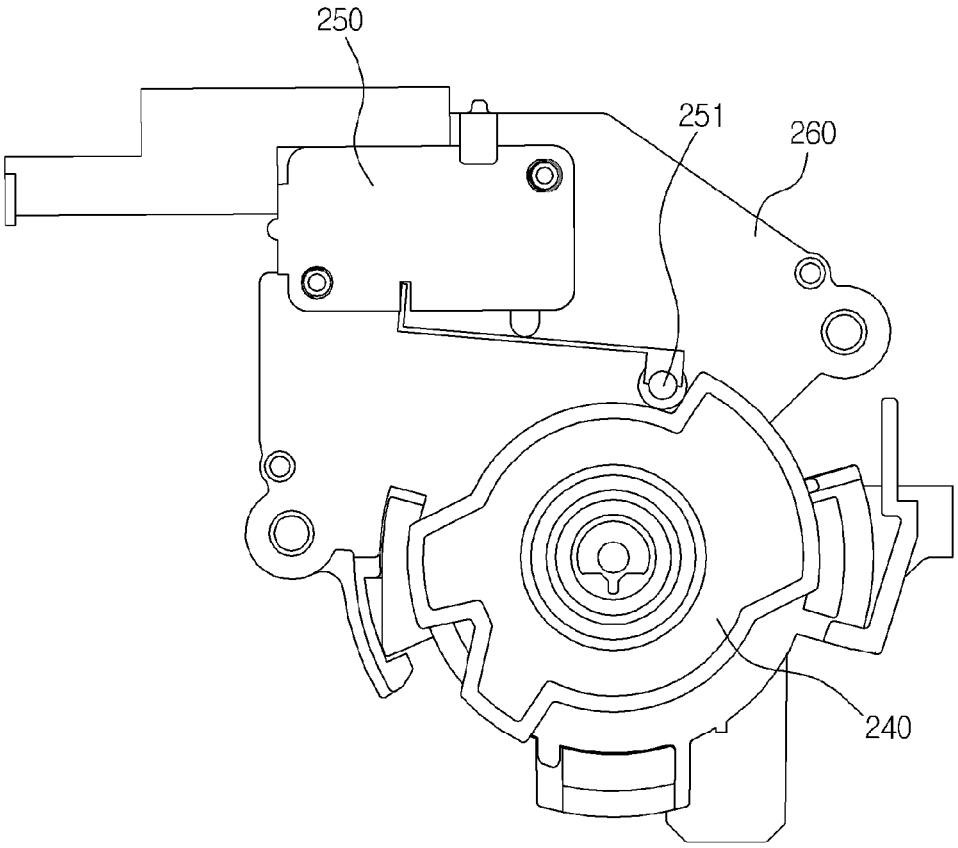
FIG. 11 is a side view illustrating the distribution device of the dish washing machine of FIG. 1 (with the motor not shown)
Figure 12:
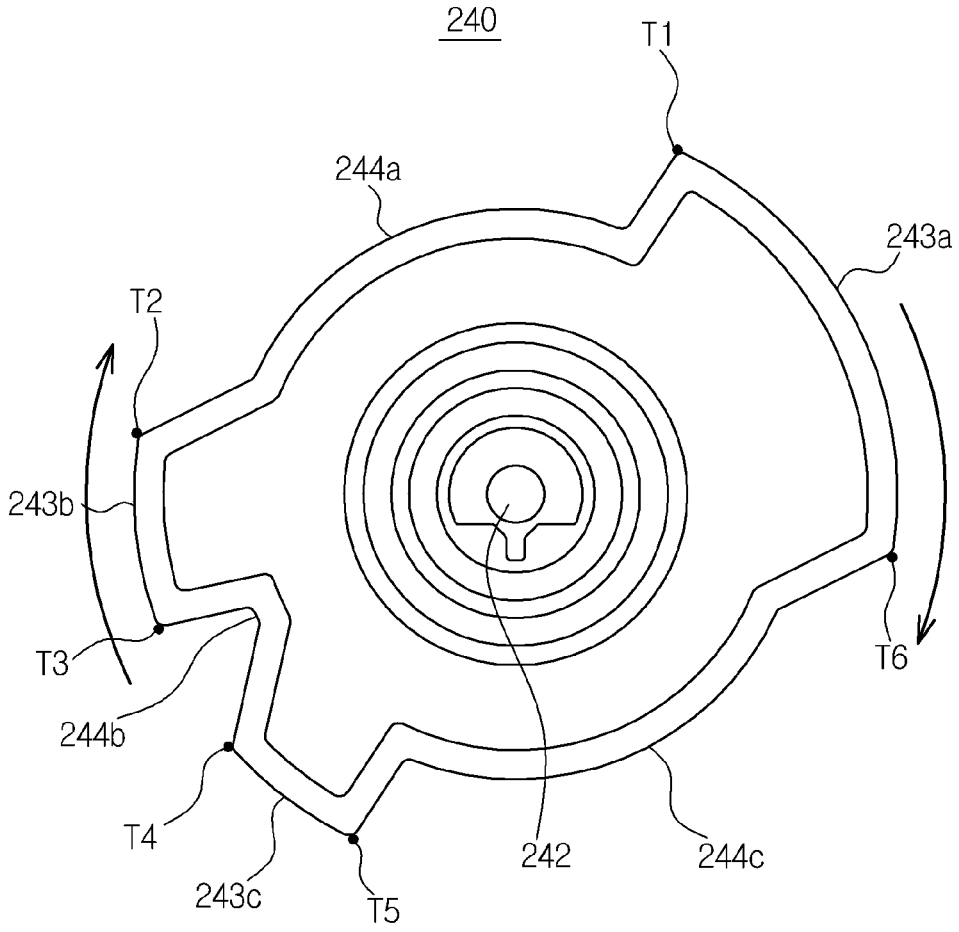
FIG. 12 is an enlarged view illustrating a cam member of the distribution device of the dish washing machine of FIG. 1.
Figure 13:
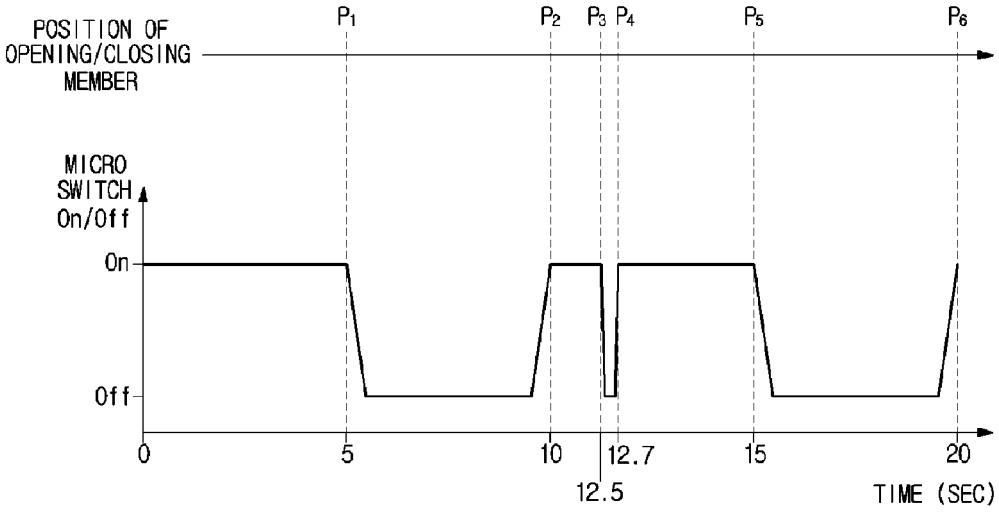
FIG. 13 is a view depicting a relationship between the On/Off time of a microswitch of the distribution device of the dish washing machine shown in FIG. 1 and rotation positions of the opening and closing member.
Figure 14:
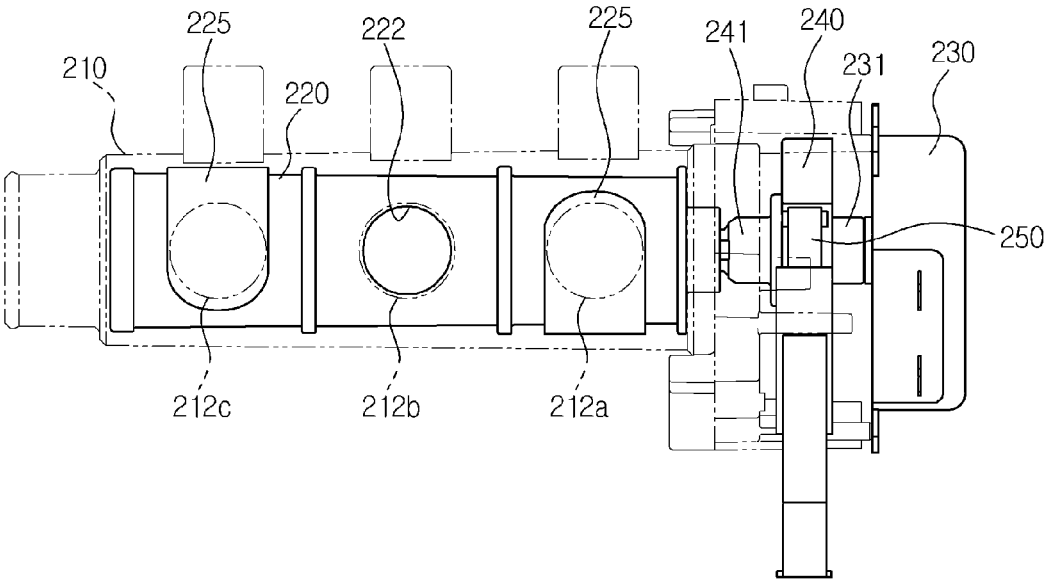
FIG. 14 is a view illustrating operation of the distribution device of the dish washing machine of FIG. 1, in which only the second outlet is open and the wash water is distributed only to rotary nozzles.
Figure 15:
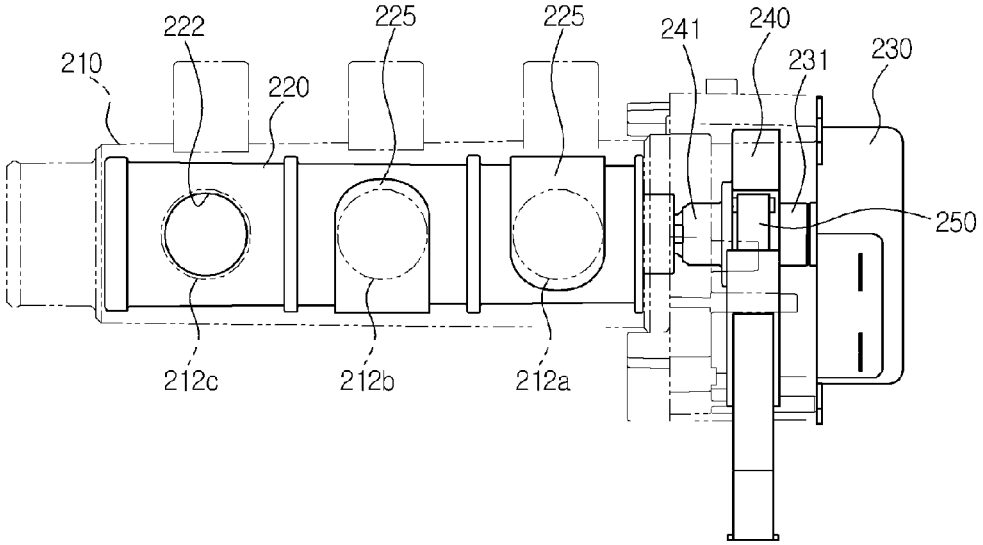
FIG. 15 is a view illustrating operation of the distribution device of the dish washing machine of FIG. 1, in which only the third outlet is open and the wash water is distributed only to right fixed nozzles.
Figure 16:
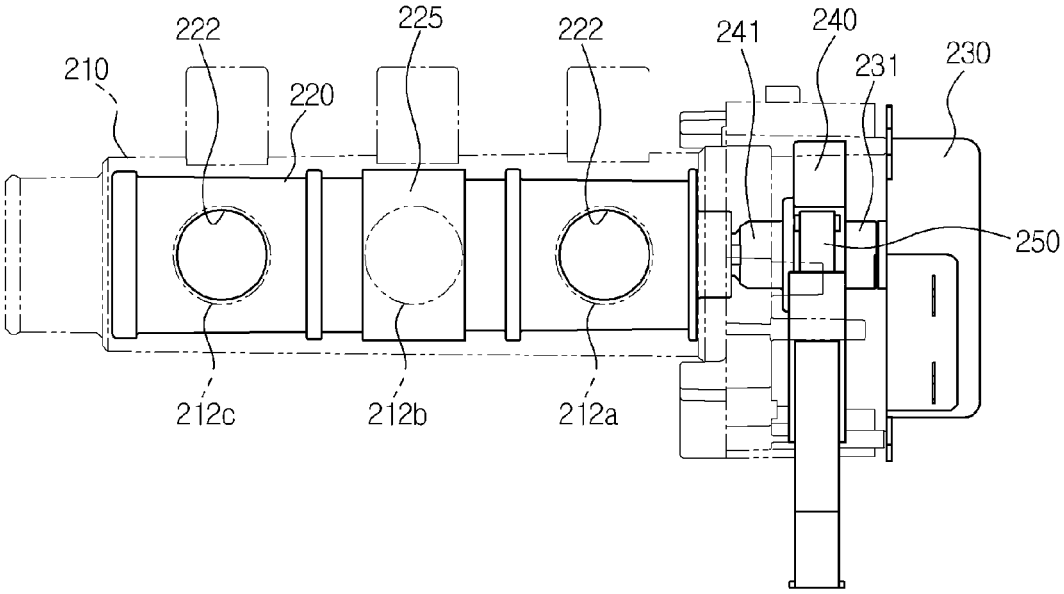
FIG. 16 is a view illustrating operation of the distribution device of the dish washing machine of FIG. 1, in which only the first and third outlets are open and the wash water is distributed only to the left fixed nozzles and the right fixed nozzles.
Figure 17:
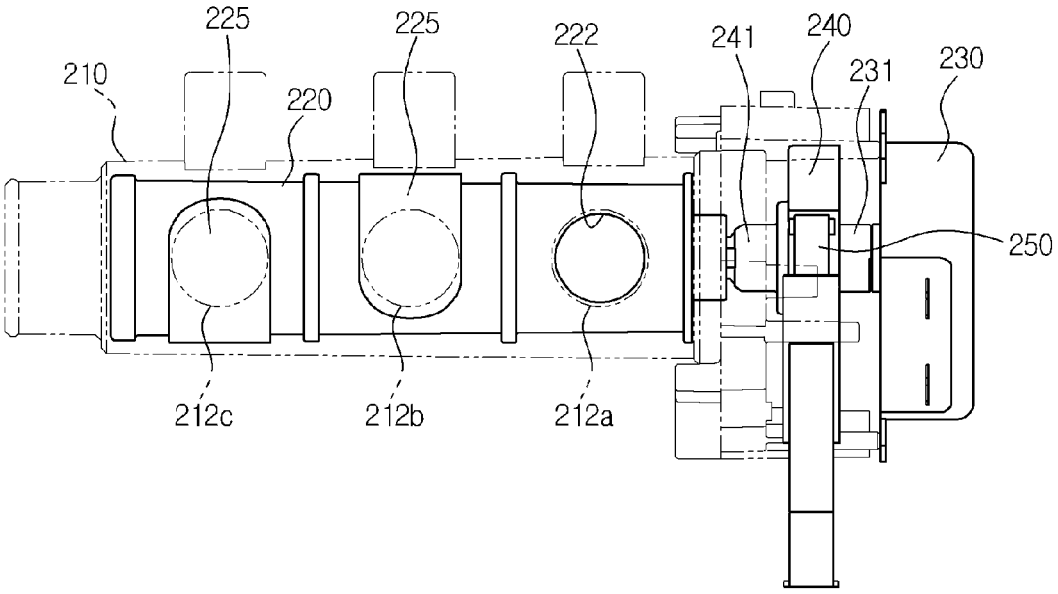
FIG. 17 is a view illustrating operation of the distribution device of the dish washing machine of FIG. 1, in which only the first outlet is open and the wash water is distributed only to the left fixed nozzles.

FIG. 11 is a side view illustrating the distribution device of the dish washing machine of FIG. 1 (with the motor not shown). FIG. 12 is an enlarged view illustrating a cam member of the distribution device of the dish washing machine of FIG. 1. FIG. 13 is a view depicting a relationship between the On/Off time of a microswitch of the distribution device of the dish washing machine of FIG. 1 and rotation positions of the opening and closing member. FIG. 14 is a view illustrating operation of the distribution device of the dish washing machine of FIG. 1, in which only the second outlet is open and the wash water is distributed only to rotary nozzles. FIG. 15 is a view illustrating operation of the distribution device of the dish washing machine of FIG. 1, in which only the third outlet is open and the wash water is distributed only to right fixed nozzles. FIG. 16 is a view illustrating operation of the distribution device of the dish washing machine of FIG. 1, in which only the first and third outlets are open and the wash water is distributed only to the left fixed nozzles and the right fixed nozzles. FIG. 17 is a view illustrating operation of the distribution device of the dish washing machine of FIG. 1, in which only the first outlet is open and the wash water is distributed only to the left fixed nozzles.

Hereinafter, operation of a distribution device according to one embodiment of the present disclosure will be described with reference to FIGS. 11 to 17.

Once the motor 230 is operated, rotary power thereof is transferred to the cam member 240 through a motor shaft 231, and thus the cam member 240 is rotated. The motor 230 may be a unidirectional motor that rotates only in one direction.

For simplicity of description, it will be assumed that the cam member 240 rotates clockwise about a rotation center 242 as shown in FIG. 12. When the cam member 240 rotates, rotary power is transferred to the opening and closing member 220 through the cam shaft 241, thereby rotating the opening and closing member 220.

The cam member 240 is arranged to contact a contact terminal 251 of the microswitch 250. The cam member 240 includes convex parts 243*a*, 243*b* and 243*c* radially protruding to turn on and off the microswitch 250 and concave parts 244*a*, 244*b* and 244*c* which are radially recessed.

The convex parts 243*a*, 243*b* and 243*c* may include a first convex part 243*a*, a second convex part 243*b*, and a third convex part 243*c*, which are sequentially arranged counterclockwise. The concave parts 244*a*, 244*b* and 244*c* may include a first concave part 244*a*, a second concave part 244*b*, and a third concave part 244*c*, which are sequentially arranged counterclockwise.

It will be assumed that the microswitch 250 is turned on when the contact terminal 251 contacts the convex parts 243*a*, 243*b* and 243*c* of the cam member 240, and that the microswitch 250 is turned off when the contact terminal 251 contacts the concave parts 244*a*, 244*b* and 244*c* of the cam member 240. Therefore, when the motor 230 is driven, the microswitch 250 may be alternately turned on and off.

Meanwhile, the distribution device 200 may designate the rotation positions of the opening and closing member 220 according to On and Off time of the microswitch 250, may be provided with a control unit to rotate or step the motor 230 to rotate the opening and closing member 220 to a specific necessary position of the designated rotation positions. The control unit may include an electronic circuit.

For example, the control unit may designate six rotation positions P1, P2, P3, P4, P5, and P6 of the opening and closing member 220, as shown in FIG. 13.

The control unit may designate the rotation position of the opening and closing member 220 at a time point at which the microswitch 250 is turned off after being turned on for 5 seconds, as a first rotation position P1 of the opening and closing member 220 among the six rotation positions P1, P2, P3, P4, P5, and P6.

In this embodiment, the microswitch 250 is turned off at only one time point after being turned on for 5 seconds, and thus the section in which the microswitch 250 is turned on for 5 seconds may be defined as a reference reset section.

In addition, the rotation position of the opening and closing member 220 at a time point at which the microswitch 250 having been turned on for 5 seconds and then turned off for 5 seconds is turned on again may be designated as a second rotation position P2.

In this way, the first rotation position P1 to sixth rotation position P6 may be designated.

When the opening and closing member 220 is at the six rotation positions P1, P2, P3, P4, P5, and P6, the contact terminal 251 of the microswitch 250 is correspondingly located at contact terminal positions T1, T2, T3, T4, T5, and T6 as shown in FIG. 12.

The rotation position information about the opening and closing member 220 according to the On and Off time of the microswitch 250 as described above may be pre-stored in a ROM of the control unit.

In addition, the information about opening and closing of the outlets 212*a*, 212*b* and 212*c* of the distribution device 200 according to each rotation position of the opening and closing member 220 and the spray information about the spray nozzles 311, 313, 330 and 340 according to opening and closing of the outlets 212*a*, 212*b* and 212 may also be pre-stored in the ROM of the control unit.

Accordingly, when a user inputs a desired specific spray nozzle 311, 313, 330, 340, the control unit may determine an outlet 212*a*, 212*b* and 212*c* to open, and then determine a corresponding specific rotation position of the opening and closing member 220.

The control unit may drive the motor 230 to rotate the opening and closing member 220 to the determined specific rotation position. When rotation of the opening and closing member 220 to the determined specific rotation position is completed, driving of the motor 230 may be stopped.

In this embodiment, when the opening and closing member 220 is at the first rotation position P1, only the second outlet 212*b* is open as shown in FIG. 14, and accordingly the wash water may be distributed only to the rotary nozzles 311 and 313.

When the opening and closing member 220 is at the second rotation position P2, only the third outlet 212*c* is open as shown in FIG. 15, and accordingly the wash water may be distributed only to the right fixed nozzle 340.

The third rotation position P3 and fourth rotation position P4 of the opening and closing member 220 are not used.

When the opening and closing member 220 is at the fifth rotation position P5, only the first outlet 212*a* and the third outlet 212*c* are open as shown in FIG. 16, and accordingly the wash water may be distributed only to the left fixed nozzle 330 and the right fixed nozzle 340.

When the opening and closing member 220 is at the sixth rotation position P6, only the first outlet 212*a* is open as shown in FIG. 17, and accordingly the wash water may be distributed only to the left fixed nozzle 330.

Figure 18:
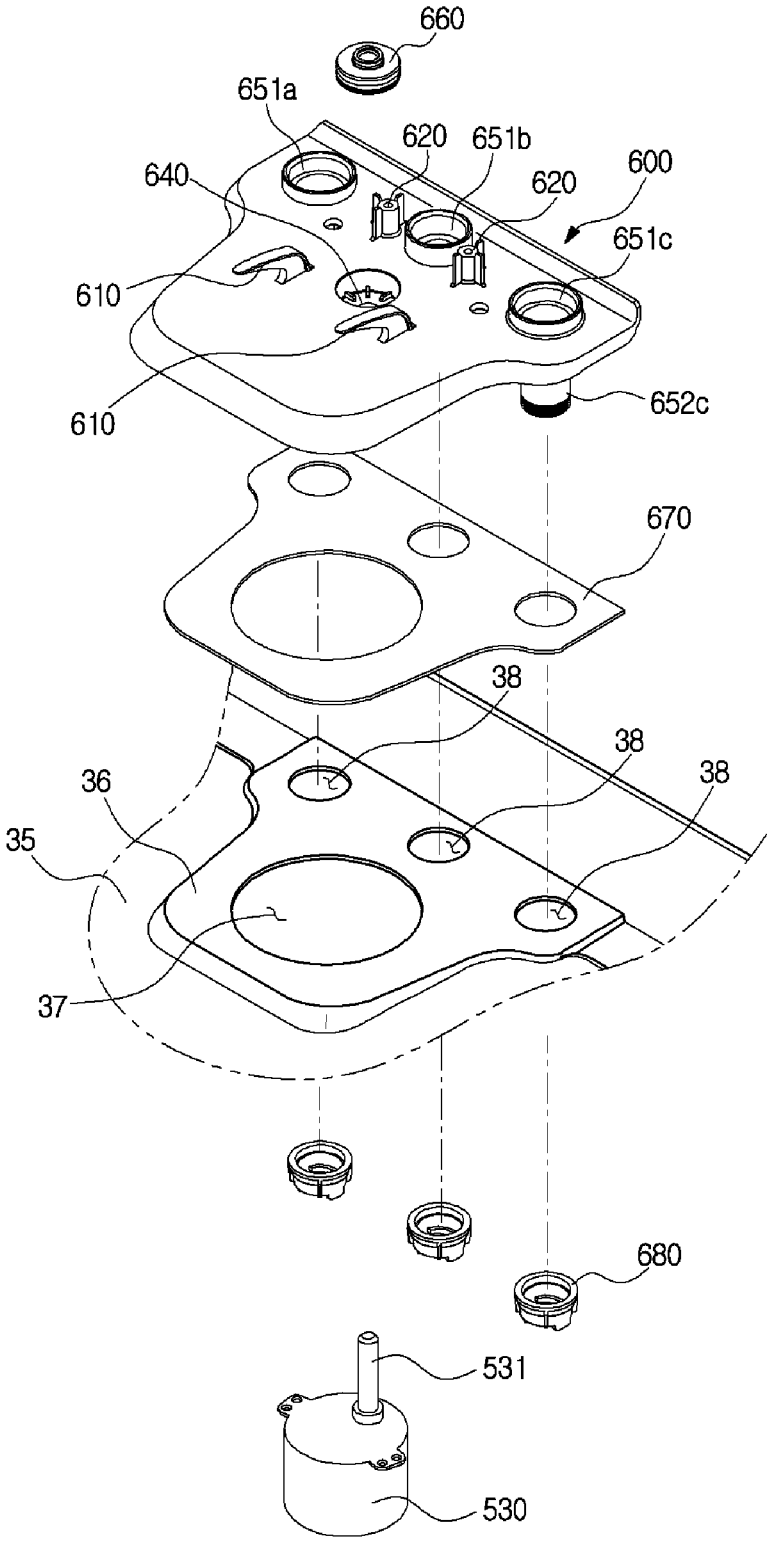
FIG. 18 is an exploded view illustrating a bottom plate, bottom plate cover and motor of the washing tub of the dish washing machine of FIG. 1.
Figure 19:
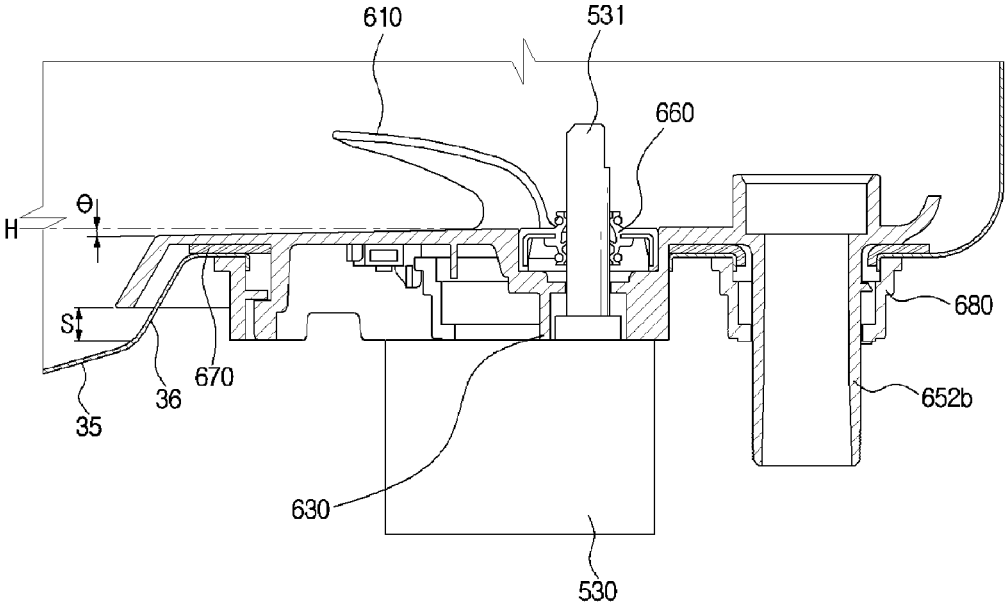
FIG. 19 is a cross-sectional view illustrating the bottom plate, bottom plate cover and motor of the dish washing machine of FIG. 1.
Figure 20:
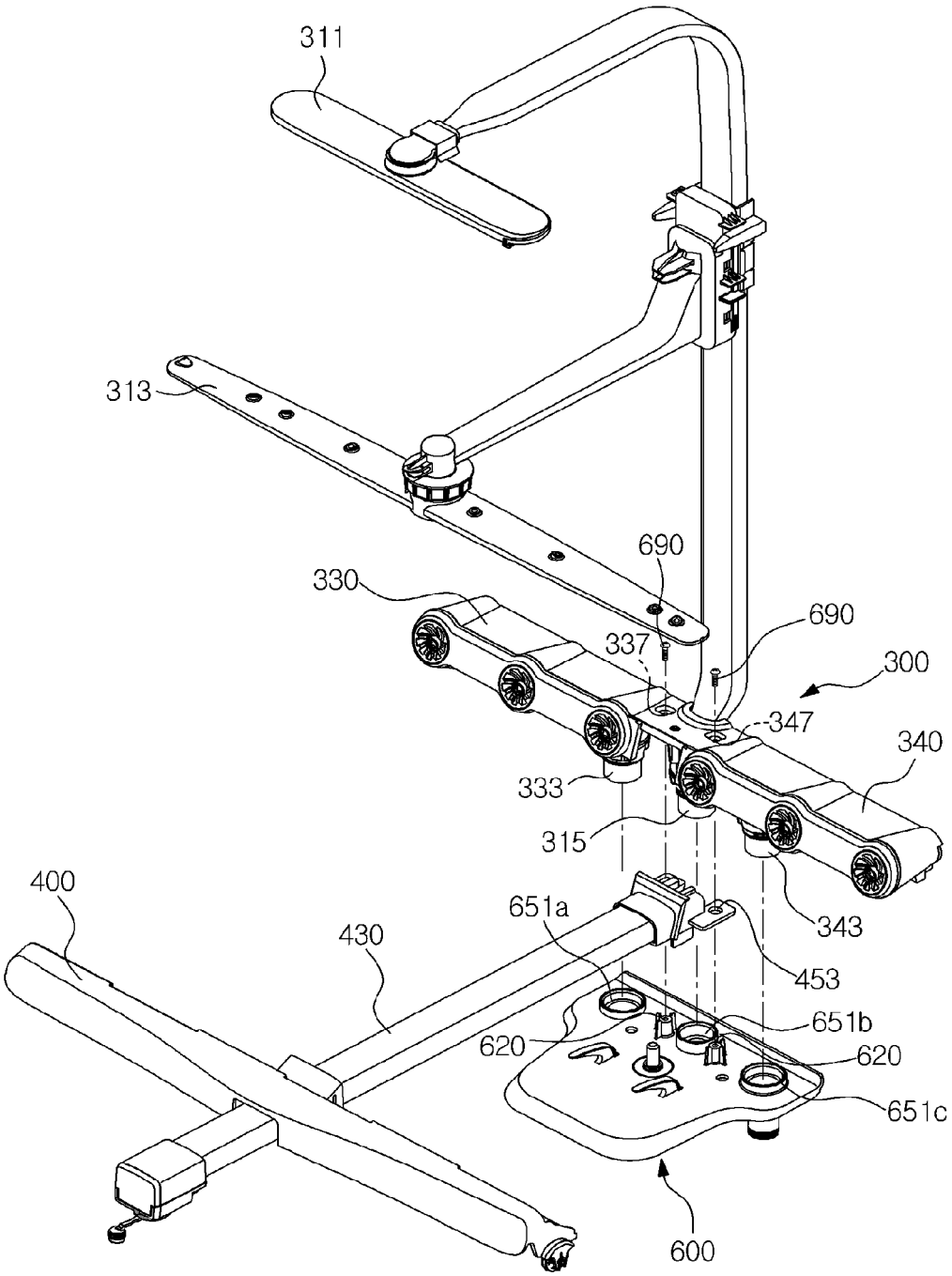
FIG. 20 is an exploded view illustrating a vane, rail assembly, spray nozzle assembly and bottom plate cover of the dish washing machine of FIG. 1.

FIG. 18 is an exploded view illustrating a bottom plate, bottom plate cover and motor of the washing tub of the dish washing machine of FIG. 1, FIG. 19 is a cross-sectional view illustrating the bottom plate, bottom plate cover and motor of the dish washing machine of FIG. 1, and FIG. 20 is an exploded view illustrating a vane, rail assembly, spray nozzle assembly and bottom plate cover of the dish washing machine of FIG. 1.

Hereinafter, a bottom plate cover of a dish washing machine according to one embodiment of the present disclosure will be described with reference to FIGS. 18 to 20.

The dish washing machine 1 includes a bottom plate cover 600 coupled to one side of the rear portion of the bottom plate 35 of the washing tub 30.

The bottom plate cover 600 functions to seal the motor through hole 37 and flow passage through holes 38 formed in the bottom plate 35, to support the motor 530 that drives the vane 400, and to fix a rail assembly 430 and nozzle assembly 300 of the dish washing machine 1.

As described above, the nozzle assembly 300 includes an upper rotary nozzle 311, a middle rotary nozzle 313, a left fixed nozzle 330, and a right fixed nozzle 340.

The rail assembly 430 serves to guide movement of the vane 400, and details thereof will be described later.

The rear portion of the bottom plate 35 may be provided with a bottom plate protrusion 36 protruding to allow the bottom plate cover 600 to be coupled thereto. The bottom plate protrusion 36 may include a motor through hole 37 through which the motor 530 to drive the vane 400 passes, and flow passage through holes 38 through which a flow passage connecting the nozzle assembly 300 to the distribution device 200 (FIG. 3) passes.

The motor 530 may be mounted on the bottom surface of the bottom plate cover 600. When the bottom plate cover 600 is removed from the bottom plate 35, the motor 530 may be withdrawn along with the bottom plate cover 600 through the motor through hole 37.

Specifically, hose connectors 652*a*, 652*b* and 652*c* of the bottom plate cover 600 may pass through the flow passage through holes 38.

The bottom plate cover 600 includes a shaft through hole 640 allowing a drive shaft 531 of the motor 530 to pass therethrough, hose connectors 652*a*, 652*b* and 652*c* which protrude downward to allow hoses 271*a*, 271*b* and 271*c* extending from the distribution device 200 to be coupled thereto and are inserted into the flow passage through holes 38 of the bottom plate protrusion 36, nozzle inlet connectors 651*a*, 651*b* and 651*c* protruding upward to allow the inlets 315, 333 and 343 of the nozzle assembly 300 to be coupled thereto, fastening holes 620 to fix the nozzle assembly 300 and the rail assembly 430, and a rotary guide 610 protruding to guide rotation of the vane 400.

The bottom plate cover 600 is closely coupled to the upper surface of the bottom plate protrusion 36. Fixing caps 680 may be coupled to the hose connectors 652*a*, 652*b* and 652*c* of the bottom plate cover 600 to allow the bottom plate cover 600 to be fixed to the bottom plate protrusion 36.

A sealing member 670 may be provided between the bottom plate cover 600 and the bottom plate protrusion 36 to prevent the wash water from leaking from the washing tub 30 through the motor through hole 37 and flow passage through holes 38 of the bottom plate protrusion 36. The sealing member 670 may be formed of rubber.

A motor mounting portion 630 allowing the motor 530, which drives the vane 400, to be mounted thereto may be arranged on the bottom surface of the bottom plate cover 600. The drive shaft 531 of the motor 530 may protrude into the washing tub 30 through the shaft through hole 640 of the bottom plate cover 600. A drive pulley 500 (FIG. 21), which will be described later, may be coupled to the drive shaft 531 of the motor 530 so as to rotate together with the drive shaft 531.

A sealing member 660 may be provided in the shaft through hole 640 to prevent the wash water from leaking from the washing tub 30 through the shaft through hole 640. The sealing member 660 may be a mechanical sealing device that ensures smooth rotation of the drive shaft 531 and sealing.

The upper surface of the bottom plate cover 600 may be inclined at a predetermined angle θ (FIG. 19) with respect to a reference horizontal plane H (FIG. 19).

This is intended to prevent dirt or food particles from accumulating on the bottom plate cover 600 or from moving to the fixed spray nozzles 330 and 340. According to one embodiment of the present disclosure, the fixed spray nozzles 330 and 340 of the dish washing machine 1 are immovable unlike the rotary nozzles 311 and 313, and thus may have residual dirt or be congested by the residual dirt. However, the aforementioned structure may prevent this problem.

The inclination angle θ between the upper surface of the bottom plate cover 600 and the reference horizontal plane H may be about 3°.

In addition, one end of the bottom plate cover 600 may be spaced a predetermined distance S (FIG. 19) from the bottom plate 35. This is because an error in manufacturing and assembly make it difficult for the bottom plate cover 600 to fully contact the bottom plate 35. In addition, this structure prevents dirt from being stuck in a fine gap between the end of the bottom plate cover 600 and the bottom plate 35. The distance S between the end of the bottom plate cover 600 and the bottom plate 35 may be greater than or equal to about 5 mm.

The rail assembly 430 and the nozzle assembly 300 may be coupled to the bottom plate cover 600. The bottom plate cover 600, the rail assembly 430 and the nozzle assembly 300 may be securely fixed by a fastening member 690. To this end, fastening holes 620, 453 and 347 may be formed at the positions of the bottom plate cover 600, nozzle assembly 300 and rail assembly 430 corresponding to each other.

With this structure, the rail assembly 430 and the nozzle assembly 300 may be mutually fixed and aligned with each other.

According to one embodiment, in the dish washing machine 1, the wash water sprayed from the fixed spray nozzles 330 and 340 of the nozzle assembly 300 is not directed toward the dishes, but is reflected toward the dishes by the vane 400 coupled to the rail assembly 430. Accordingly, accurate position alignment of the fixed spray nozzles 330 and 340 and the rail assembly 430 is required. This requirement is met through the coupling structure as described above.

Figure 21:
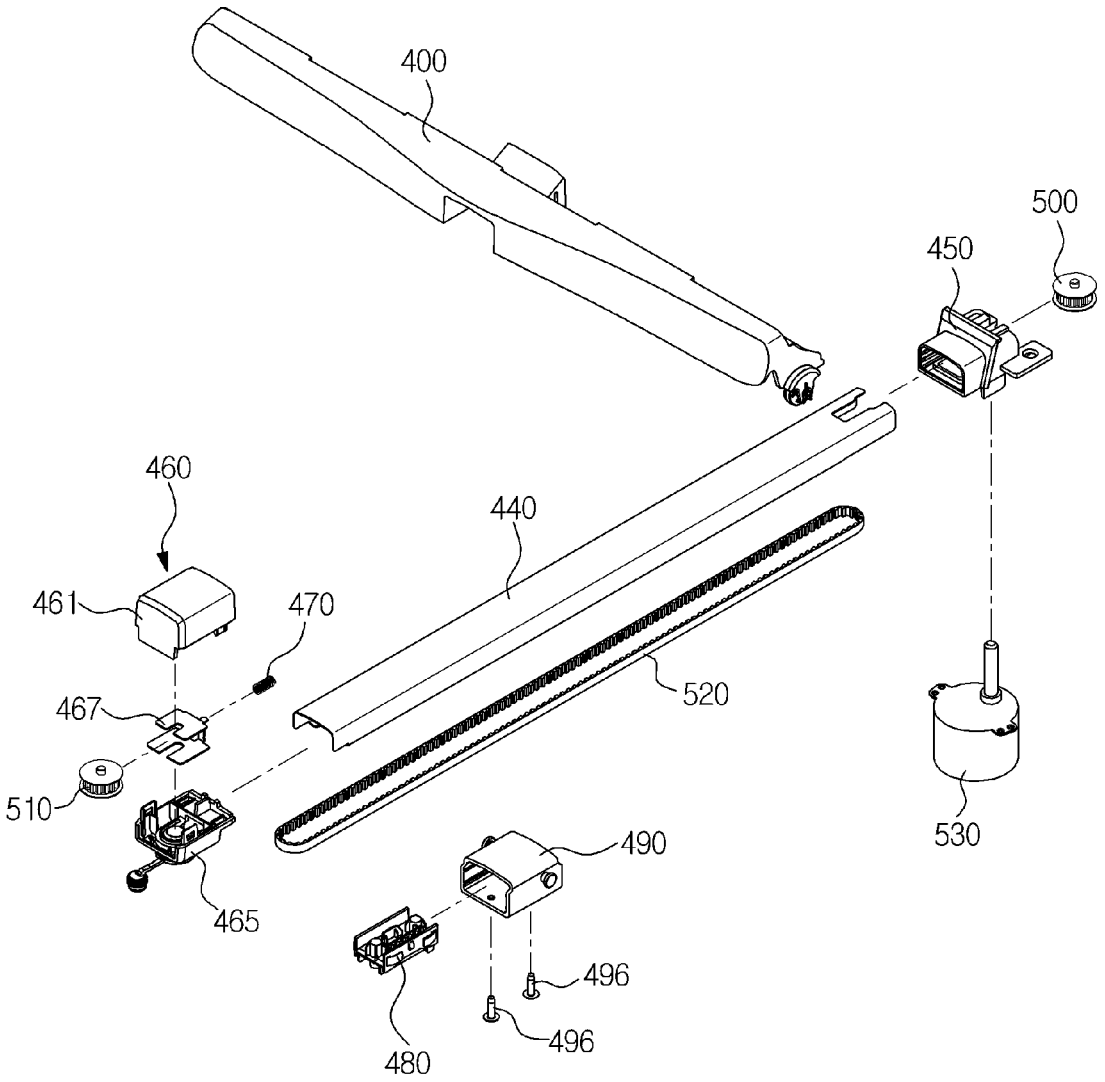
FIG. 21 is a view illustrating a vane and drive unit of the dish washing machine of FIG. 1, in which the drive unit is disassembled.
Figure 22:
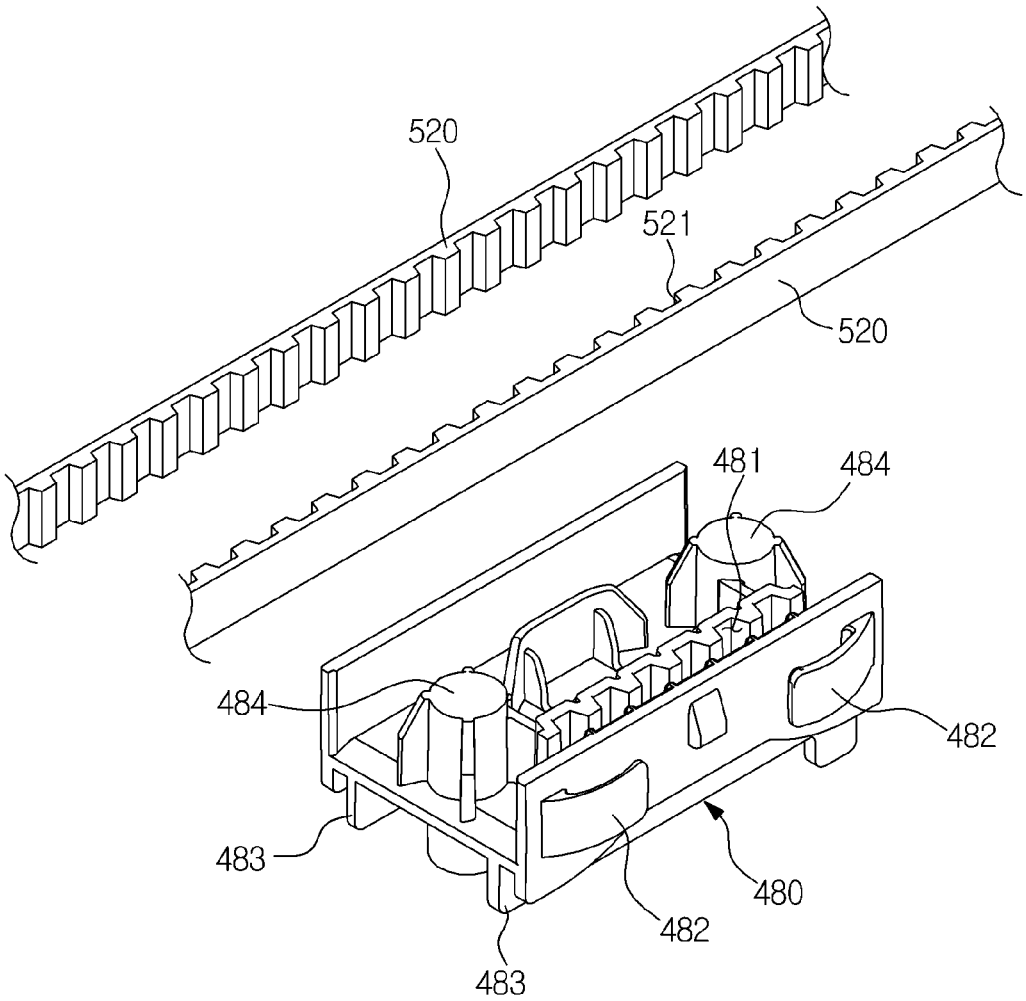
FIG. 22 is a view illustrating a belt and belt holder of the dish washing machine of FIG. 1.
Figure 23:
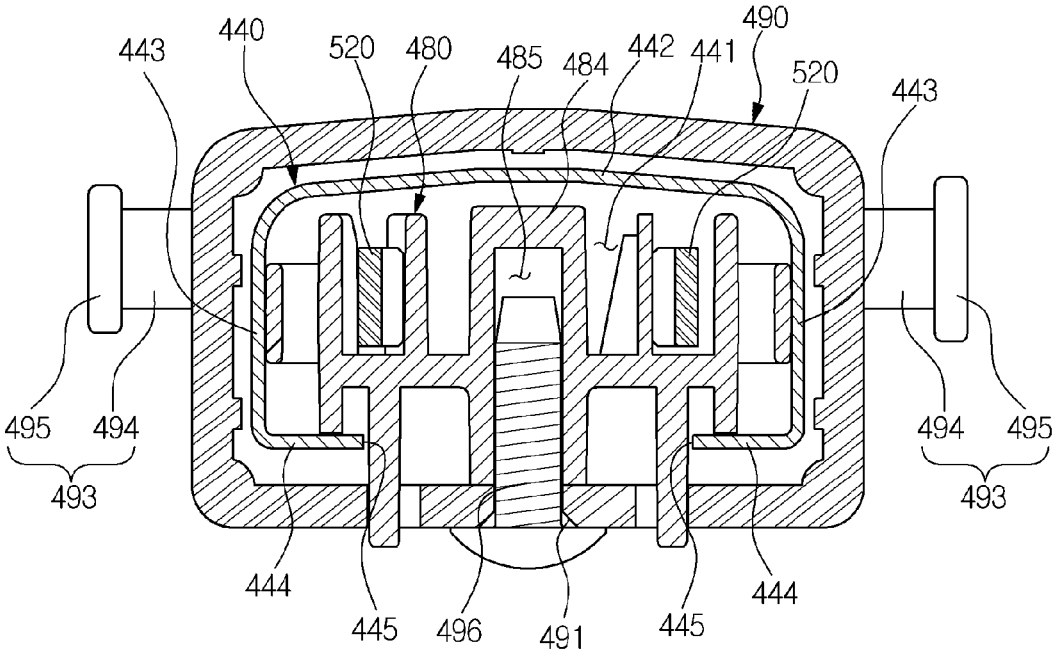
FIG. 23 is a cross-sectional view illustrating the rail, belt, belt holder and vane holder of the dish washing machine of FIG. 1.
Figure 24:
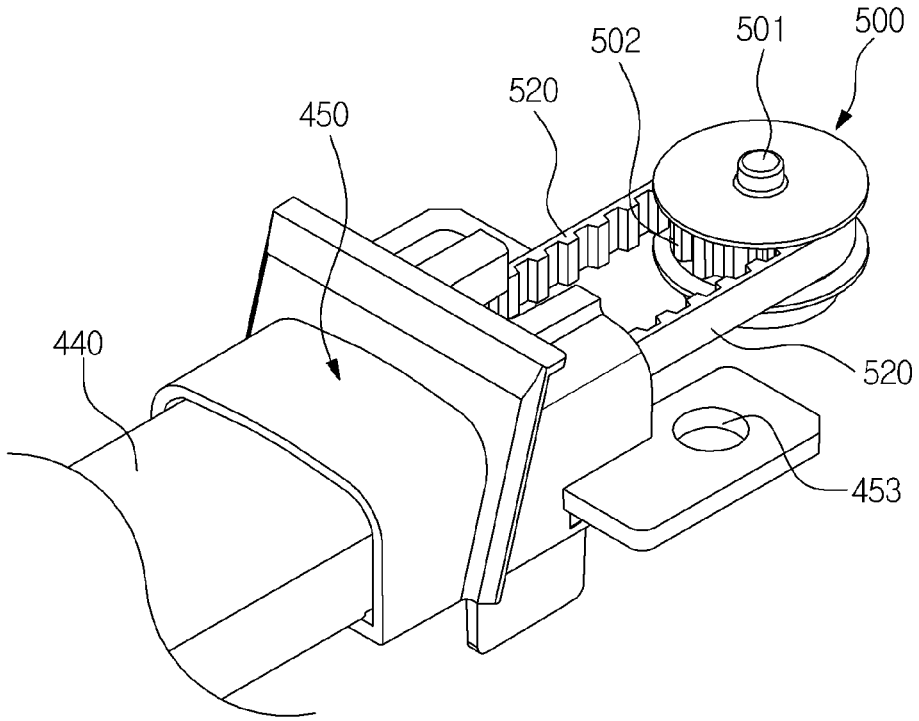
FIG. 24 is a view illustrating a rail, belt, drive pulley and rear holder of the dish washing machine of FIG. 1.
Figure 25:
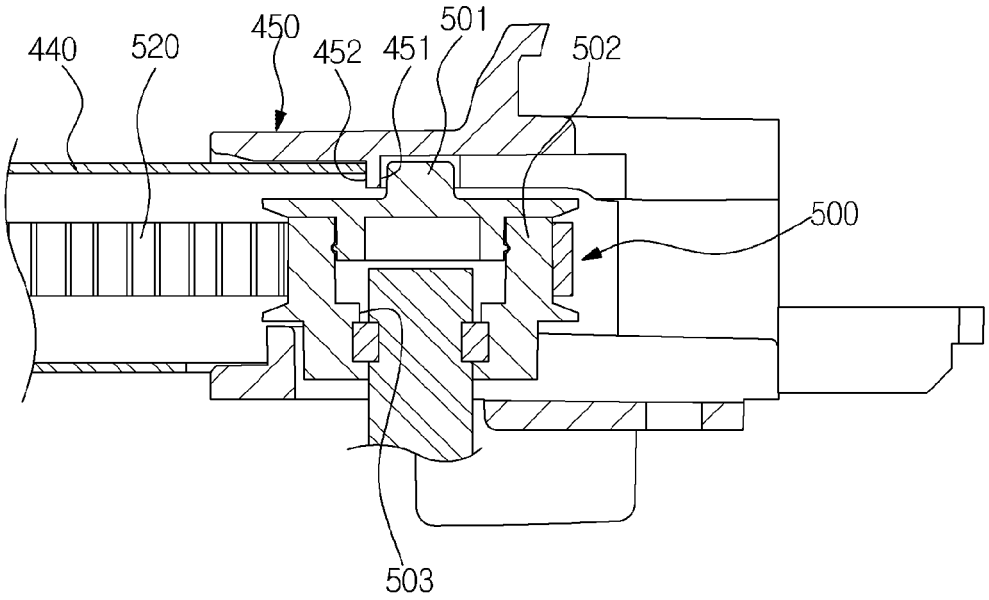
FIG. 25 is a cross-sectional view illustrating the rail, belt, drive pulley and rear holder of the dish washing machine of FIG. 1.
Figure 26:
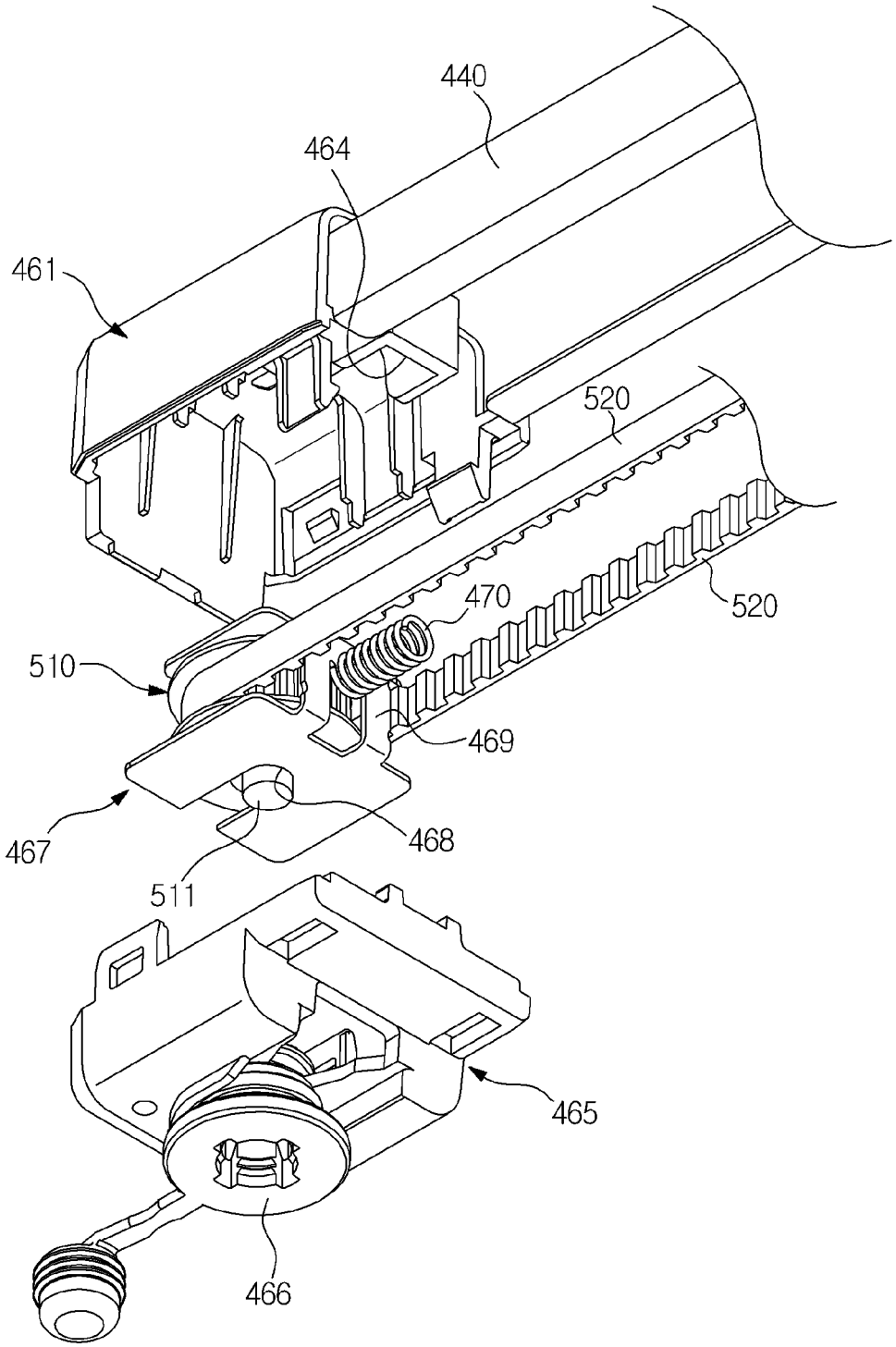
FIG. 26 is a view illustrating a rail, belt, idle pulley and front holder of the dish washing machine of FIG. 1.
Figure 27:
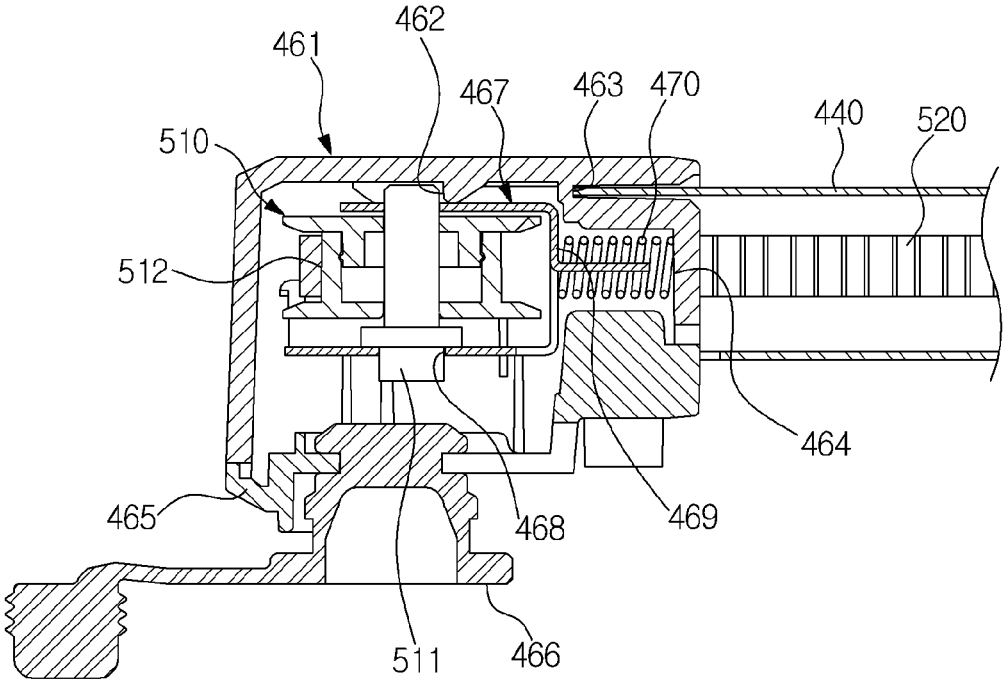
FIG. 27 is a cross-sectional view illustrating the rail, belt, idle pulley and front holder of the dish washing machine of FIG. 1.

FIG. 21 is a view illustrating a vane and drive unit of the dish washing machine of FIG. 1, in which the drive unit is disassembled. FIG. 22 is a view illustrating a belt and belt holder of the dish washing machine of FIG. 1. FIG. 23 is a cross-sectional view illustrating the rail, belt, belt holder and vane holder of the dish washing machine of FIG. 1. FIG. 24 is a view illustrating a rail, belt, drive pulley and rear holder of the dish washing machine of FIG. 1. FIG. 25 is a cross-sectional view illustrating the rail, belt, drive pulley and rear holder of the dish washing machine of FIG. 1. FIG. 26 is a view illustrating a rail, belt, idle pulley and front holder of the dish washing machine of FIG. 1. FIG. 27 is a cross-sectional view illustrating the rail, belt, idle pulley and front holder of the dish washing machine of FIG. 1.

Hereinafter, a vane and drive unit of a dish washing machine according to one embodiment of the present disclosure will be described with reference to FIGS. 21 to 27.

The dish washing machine 1 of this embodiment includes a vane 400 to reflect wash water sprayed from the fixed nozzles 330 and 340. The vane 400 may linearly reciprocate in the spray direction in which the wash water is sprayed from the fixed spray nozzles 330 and 340.

The dish washing machine 1 may include a drive unit 420 to linearly reciprocate the vane 400.

The drive unit 420 includes a motor 530 to generate driving power and a rail assembly 430 to guide movement of the vane 400.

The rail assembly 430 includes a rail 440 to guide movement of the vane 400, the rail having an inner space 441, a drive pulley 500 connected to the motor 530 to rotate, a belt 520 connected to the drive pulley 500 to rotate and disposed in the inner space 441 of the rail 440, an idle pulley 510 connected to the belt 520 to rotatably support the belt 520, a belt holder 480 disposed in the inner space 441 of the rail 400 to be coupled to the belt 520 to linearly reciprocate, a vane holder 490 disposed outside the rail 400 to be coupled to the belt holder 480 to linearly reciprocate, the belt holder 480 being coupled with the vane 400, a rear holder 450 to rotatably support the drive pulley 500, the rear holder 450 being coupled to the rear end of the rail 440, and a front holder 460 to rotatably support the idle pulley 510, the front holder 460 being coupled to the front end of the rail 440.

The rail 440 may be formed of a metallic material. The rail 440 may extend in the front-to-back direction in the middle between the left sidewall 33 and right sidewall 34 of the washing tub 30.

The rail 440 may be formed in the shape of a pipe with an opening 445 formed approximately at the lower portion thereof. That is, the rail 440 may include an inner space 441, an upper wall 442, a lower wall 444, two sidewalls 443, and a lower opening 445 formed in the lower wall 444. The lower opening 445 may extend from one longitudinal end of the rail 440 to the other longitudinal end of the rail 440.

As the rail 440 is formed in the shape of a pipe, the belt 520 may be disposed in the inner space 441 of the rail 400. Thereby, movement of the belt 520 may not obstructed by contact with the dishes in the washing tub 30 or the belt 520 may be prevented from rusting due to contact with the wash water in the washing tub 30.

In addition, the opening 445 is formed in the lower wall 444 of the rail 440 in order to allow the belt 520 disposed in the inner space 441 of the rail 440 to be connected to the vane 400 arranged outside the rail 400 such that driving power is transferred from the belt 520 to the vane 400.

The belt 520 may be wound around the drive pulley 500 and the idle pulley 510, forming a closed loop. When the motor 530 is driven, the belt 520 may rotate in the direction of rotation of the motor 530. In consideration of the tensile strength and cost, the belt 520 may be formed of a resin material including aramid fiber.

The inner surface of the belt 520 may be provided with teeth 521 to transfer the driving power of the belt 520 to the belt holder 480.

Similar to the belt 520, the belt holder 480 may be disposed in the inner space 441 of the rail 400 and engaged with the teeth 521 of the belt 520 to move together with the belt 520. To this end, the belt holder 480 may have a tooth engagement part 481 engaged with the teeth 521 of the belt 520.

In addition, the belt holder 480 include legs 482 and 483 to support the rail 400. The legs 482 and 483 may include at least one lateral leg 482 protruding laterally to be supported on the sidewalls 443 of the rail 400, and at least one lower leg 483 protruding downward to be supported on the lower wall 444 of the rail 400.

The lateral legs 482 may reduce noise and vibration caused by collision and friction with the rail 400 during movement of the belt holder 480 and may be elastically deformable to allow smooth movement of the belt holder 480.

The lateral legs 482 may be elastic members of a leaf spring type. That is, lateral legs 482 may include curves plates which are deformed between the released shape and the compressed shape.

In addition, the belt holder 480 may have a fastening part 484 to be coupled with the vane holder 490. The fastening part 484 may include a fastening hole 485 into which a fastening member 496 is inserted.

The vane holder 490 is coupled to the belt holder 480 to move together with the belt holder 480 and to transfer the driving power of the belt holder 480 to the vane 400. The vane holder 490 is arranged to surround the outer surface of the rail 440.

The vane holder 490 is coupled to the belt holder 480 through the lower opening 445 of the rail 440. To this end, the vane holder 490 may have a fastening hole 491 to be coupled with the belt holder 480. Accordingly, by fastening the fastening member 496 to the fastening hole 491 of the vane holder 490 and the fastening hole 485 of the belt holder 480, the vane holder 490 may be coupled to the belt holder 480.

The fastening member 496 may be sequentially fastened to the fastening hole 491 of the vane holder 490 and the fastening hole 485 of the belt holder 480 by moving vertically upward.

The vane holder 490 may be provided with a coupling lug 493 to which the vane 400 is detachably coupled. The coupling lug 493 may include a coupling shaft 494 that protrudes laterally and a separation preventing part 495 formed at the end of the coupling shaft 494 to prevent separation of the vane 400.

The drive pulley 500 includes a rotational shaft 501, a shaft connector 503 connected to the drive shaft 531 of the motor 530 to receive driving power, and a belt coupling part 502 to which the belt 520 is coupled.

The rear holder 450 rotatably supports the drive pulley 500, and is coupled to the rear end of the rail 440. The rear holder 450 includes a pulley support surface 451 to support the rotational shaft 501 of the drive pulley 500, a rail support surface 452 to support the rear end of the rail 440, and a fastening hole 453 to be coupled to the bottom plate cover 600.

The idle pulley 510 includes a rotational shaft 511 and a belt coupling part 512 to which the belt 520 is coupled.

The front holder 460 includes a front top holder 461, a front bottom holder 465 coupled to the lower portion of the front top holder 461, and a pulley bracket 467 provided between the front top holder 461 and the front bottom holder 465 to move in the longitudinal direction of the rail 440 and to rotatably support the idle pulley 510.

The front top holder 461 includes a pulley support surface 462 to support the rotational shaft 511 of the idle pulley 510 and a rail support surface 463 to support the front end of the rail 440.

The front bottom holder 465 may be coupled to the lower portion of the front top holder 461 by a holding structure. The front bottom holder 465 may have a coupling lug 466 coupled to the bottom plate 35 of the washing tub 30.

The pulley bracket 467 includes a pulley support surface 468 to support the rotational shaft 511 of the idle pulley 510.

Meanwhile, the rail 440, belt 520, drive pulley 500, rear holder 450, idle pulley 510, and front holder 460 may be connected to each other by tension of the belt 520.

That is, the drive pulley 500 is pressed toward the rail 440 by the tension of the belt 520, and this force is transferred to the rear holder 450 through the pulley support surface 451 of the rear holder 450. As a result, the rear holder 450 is closely coupled to the rear end of the rail 440.

In addition, the idle pulley 510 is pressed towards the rail 440 by the tension of the belt 520, and this force is transferred to the front holder 460 through the pulley support surface 462 of the front holder 460. As a result, the front holder 460 is closely coupled to the front end of the rail 440.

Meanwhile, the front holder 460 may further include a finite elastic member 470 to maintain the tension of the belt 520. When the belt 520 is thermally expanded by heat in the washing tub 30, the belt 520 extends and thus the tension of the belt 520 decreases. Decrease in tension of the belt 520 may obstruct the vane 400 from being smoothly driven.

One end of the elastic member 470 may be supported by the front holder 460, and the other end of the elastic member 470 may be supported by the pulley bracket 467. To this end, each of the front holder 460 and the pulley bracket 467 may be provided with an elastic member support surface 464, 469.

The elastic member 470 may be a compression spring. Since the front holder 460 is supported on the rail 440 by the rail support surface 463, the elastic force of the elastic member 470 may be applied to the pulley bracket 467. That is, the pulley bracket 467 may be pressed away from the rail 440 by the elastic force of the elastic member 470.

At this time, since the pulley bracket 467 is pressed toward the rail 440 by the tension of the belt 520, the pulley bracket 467 moves to a position where the tension of the belt 520 and the elastic force of the elastic member 470 are balanced.

That is, in a case in which the tension is reduced by elongation of the belt 520 and the elastic force of the elastic member 470 becomes stronger than the tension of the belt 520, the pulley bracket 467 is moved away from the rail 440 by the elastic force of the elastic member 470. As the pulley bracket 467 is moved away from the rail 440, the belt 520 is tensioned again, thereby recovering the tension thereof.

With this configuration, when the belt 520 is elongated by thermal expansion, the pulley bracket 467 is moved to pull the belt 520. Thereby, the tension of the belt 520 may be kept constant, and reliability of the drive unit 420 may be enhanced.

Hereinafter, an assembly procedure of the rail assembly 430 of a dish washing machine will be described.

As shown in FIG. 22, the belt holder 480 is coupled to the belt 520.

As shown in FIG. 23, the assembly of the belt 520 and the belt holder 480 is disposed in the inner space 441 of the rail 440. Next, the vane holder 490 is coupled to the assembly of the belt 520 and the belt holder 480 through a fastening member 496.

As shown in FIG. 24, the rear holder 450 is connected to the longitudinal rear end of the rail 440. Next, the drive pulley 500 is coupled to the belt 520.

As shown in FIG. 26, the front top holder 461 is coupled to the longitudinal front end of the rail 440. Next, the belt 520, the idle pulley 510, the pulley bracket 467, and the elastic member 470 are coupled together. Next, the assembly of the belt 520, idle pulley 510, pulley bracket 467 and elastic member 470 is inserted into the front top holder 461. Next, the front bottom holder 465 is coupled to the front top holder 461.

Figure 28:
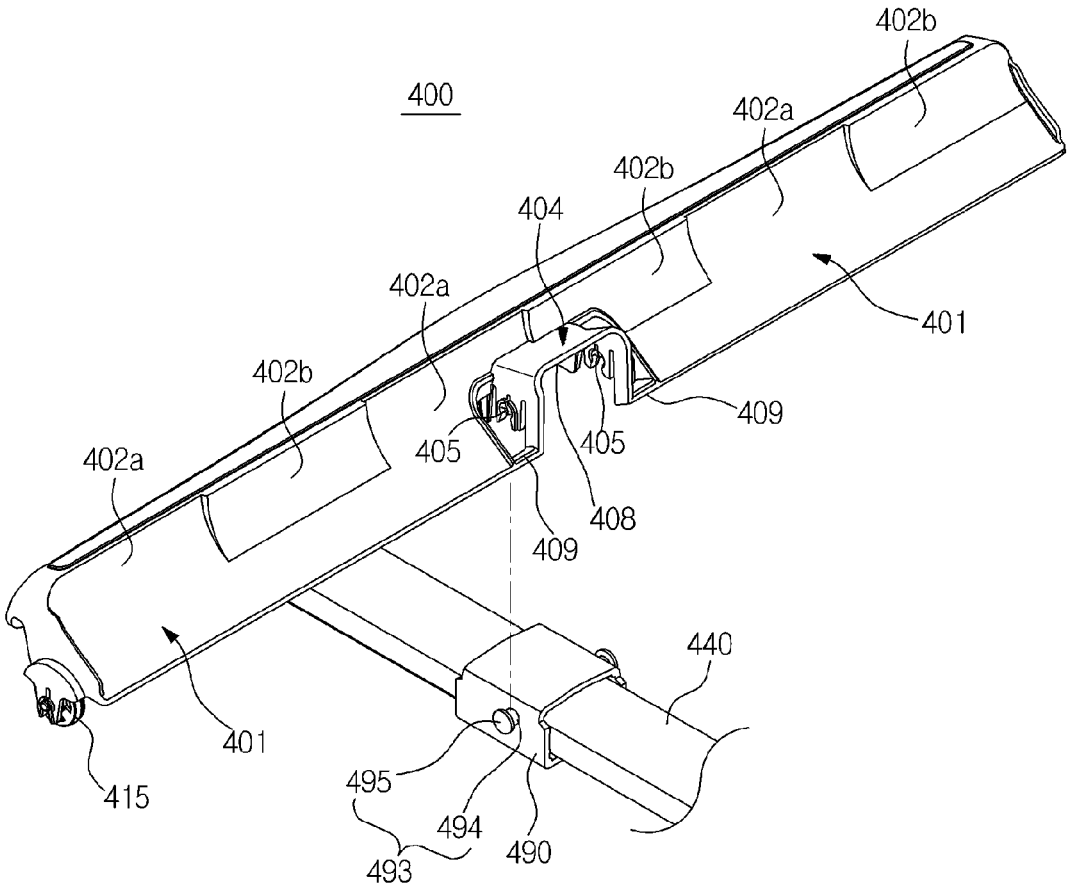
FIG. 28 is a view illustrating a vane and vane holder of the dish washing machine of FIG. 1.
Figure 29:
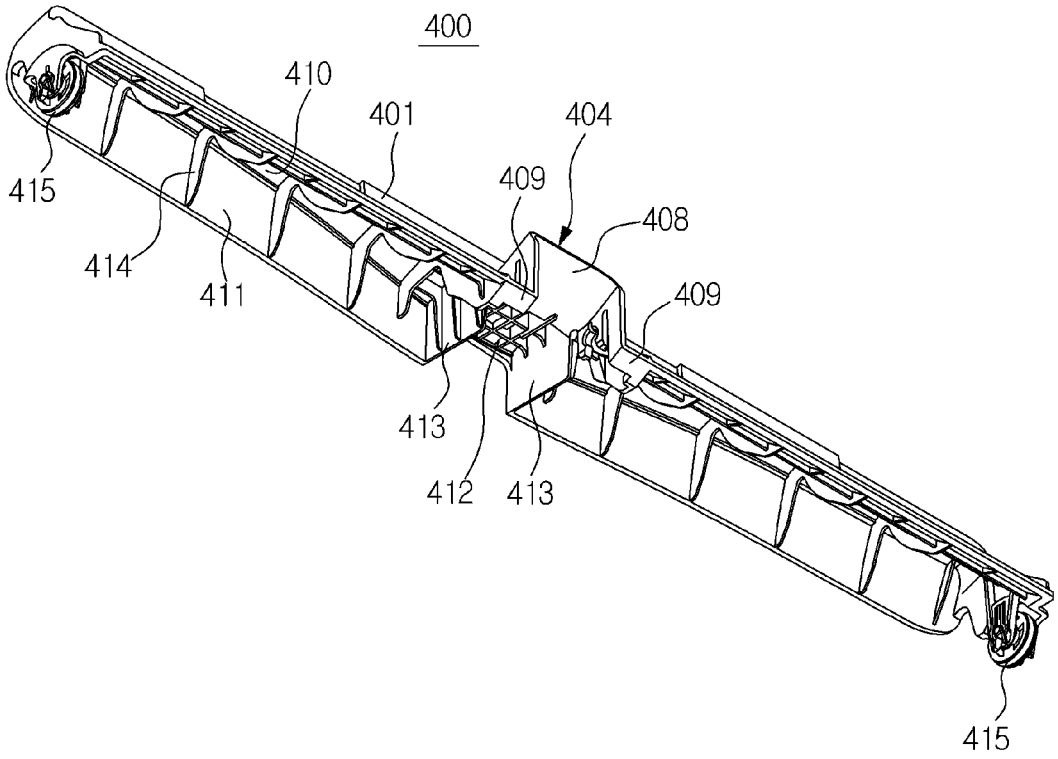
FIG. 29 is a perspective view illustrating the vane of the dish washing machine of FIG. 1.
Figure 30:
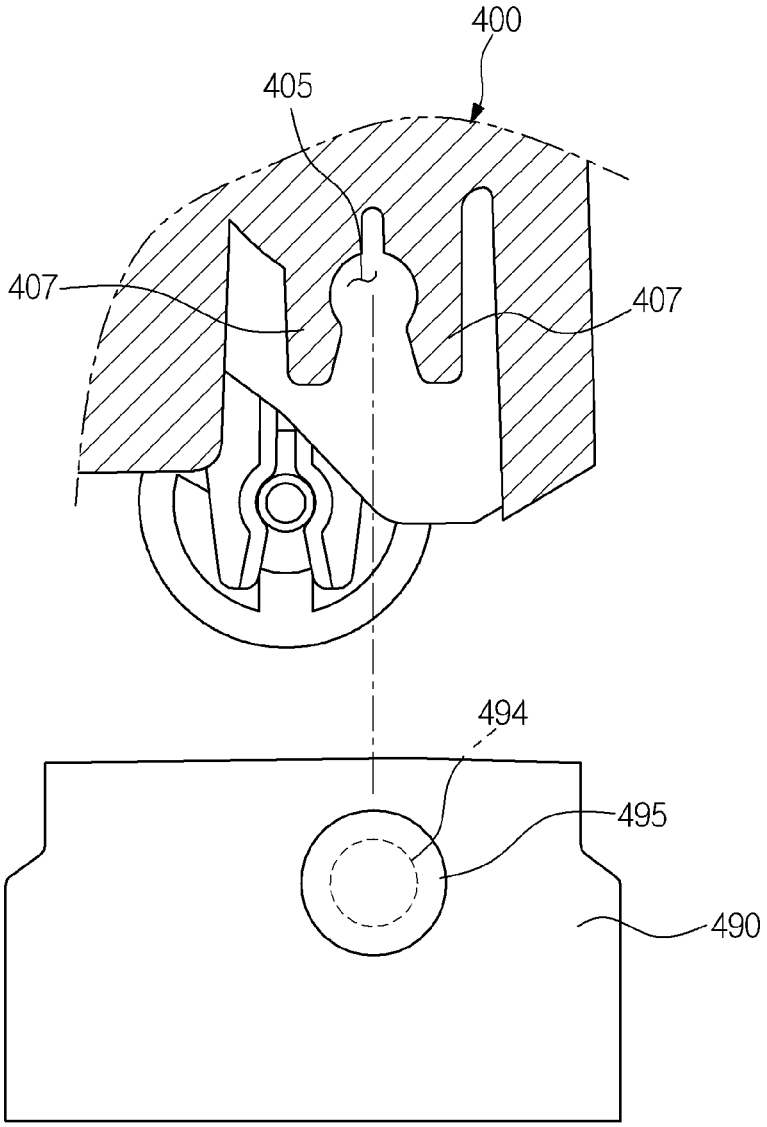
FIG. 30 is an enlarged view illustrating parts of the vane and vane holder of the dish washing machine of FIG. 1.

FIG. 28 is a view illustrating a vane and vane holder of the dish washing machine of FIG. 1. FIG. 29 is a perspective view illustrating the vane of the dish washing machine of FIG. 1. FIG. 30 is an enlarged view illustrating parts of the vane and vane holder of the dish washing machine of FIG. 1.

Hereinafter, a vane according to one embodiment of the present disclosure will be described with reference to FIGS. 28 to 30.

The vane 400 may extend in a direction perpendicular to the rail 440.

The vane 400 may include a reflector 401 to reflect wash water sprayed from the fixed nozzles 330 and 340, a upper support 410 curved from the reflector 401, a rear support 411 curved from the upper support 410, a cap portion 404 arranged at the longitudinal center of the reflector 401, a rotation restricting part 409 arrange to interfere with the rotary guide 610 (FIG. 31) of the bottom plate cover 600, a reinforcement rib 414 provided to enhance strength of the reflector 401, upper support 410 and rear support 411, a horizontal support 412 supported on the upper surface of the vane holder 490, and a vertical support 413 supported on the lateral surface of the vane holder 490.

The reflector 401 includes reflective surfaces 402*a* and 402*b* inclined to reflect the wash water. The reflective surfaces 402*a* and 402*b* may include reflective surfaces 402*a* and reflective surfaces 402*b*, which are alternately arranged in the longitudinal direction and inclined at different inclination angles such that the wash water is reflected at different reflection angles.

The cap portion 404 may include a coupling groove 405 to be coupled to the vane holder 490, and a rotation stopper 408 to limit the range of rotation of the vane 400 when the vane 400 is rotated by the rotary guide 610 of the bottom plate cover 600.

The coupling lug 493 of the vane holder 490 may be coupled to the coupling groove 405 of the vane 400. Specifically, the coupling shaft 494 of the coupling lug 493 may be inserted into the coupling groove 405 of the vane 400. The coupling shaft 494 may rotatably support the vane 400.

As shown in FIG. 30, the coupling groove 405 of the vane 400 may be defined by elastic hooks 407. When the coupling shaft 494 of the vane holder 490 is pushed into or withdrawn from the coupling groove 405 of the vane 400, the elastic hooks 407 may be elastically deformed in such a manner that the elastic hooks 407 move away from each other and then return to original positions when the insertion or withdrawal is completed. With this configuration, the vane 400 may be mountable to and detachable from the vane holder 490.

Both longitudinal ends of the vane 400 may be provided with rollers 415 to allow smooth movement of the vane 400. The bottom plate 35 of the washing tub 30 may be provided with a roller support 39 (FIG. 47) to support the rollers 415.

Figure 31:
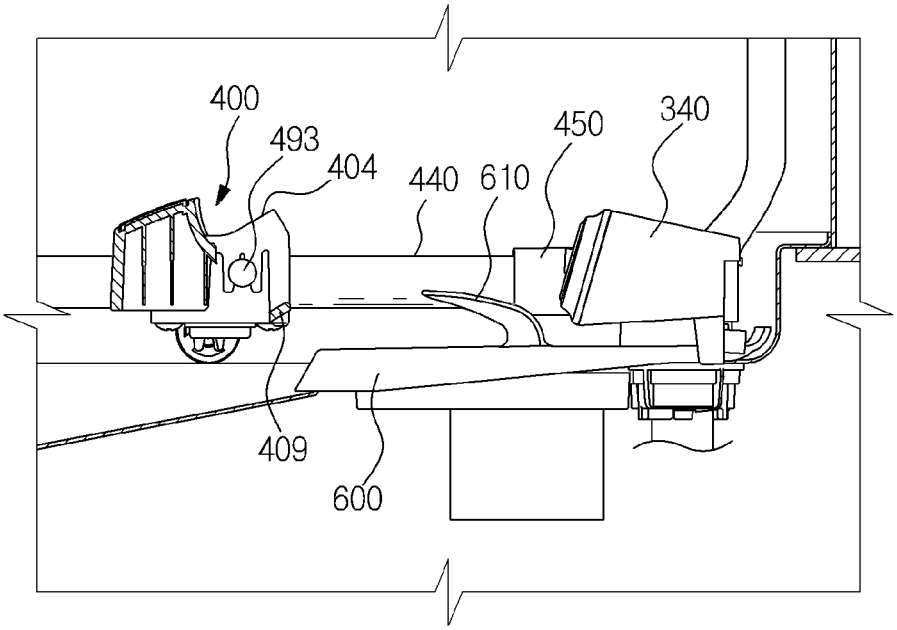
FIGS. 31 to 33 are views illustrating rotation of the vane of the dish washing machine of FIG. 1.
Figure 32:
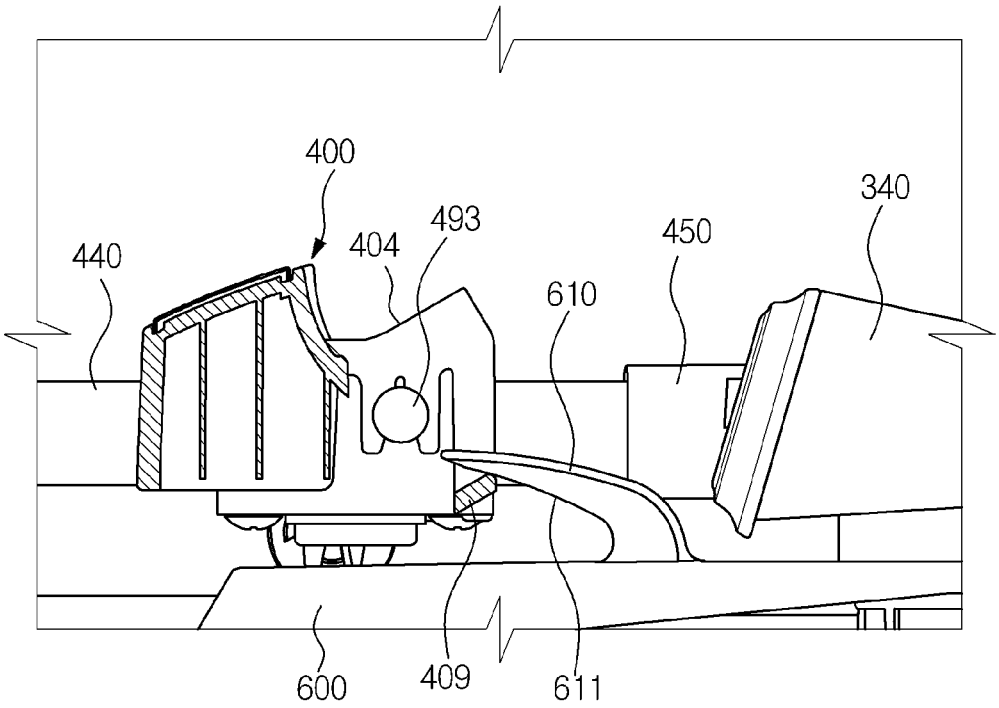
Figure 33:
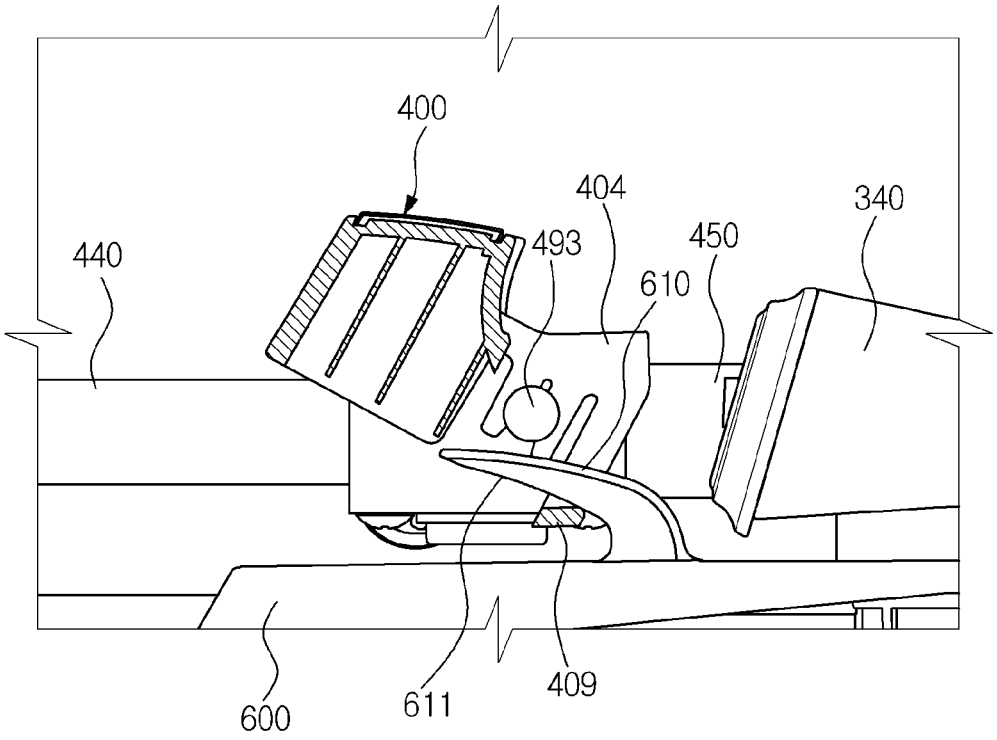
Figure 34:
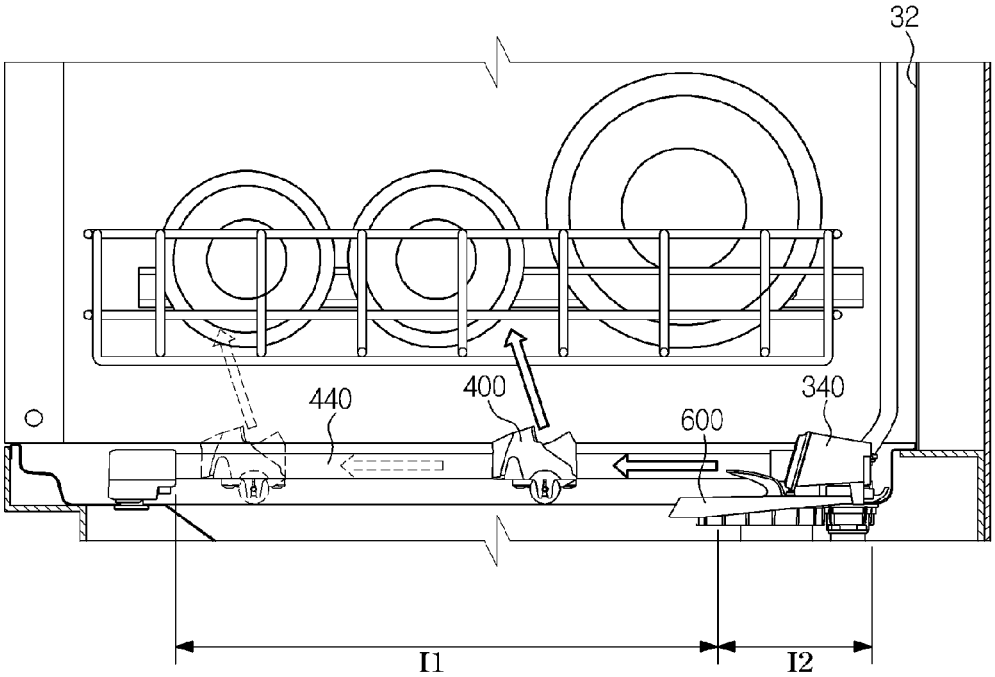
FIG. 34 is a view illustrating reflection of wash water performed by the vane of the dish washing machine of FIG. 1 in the movement section of the vane.
Figure 35:
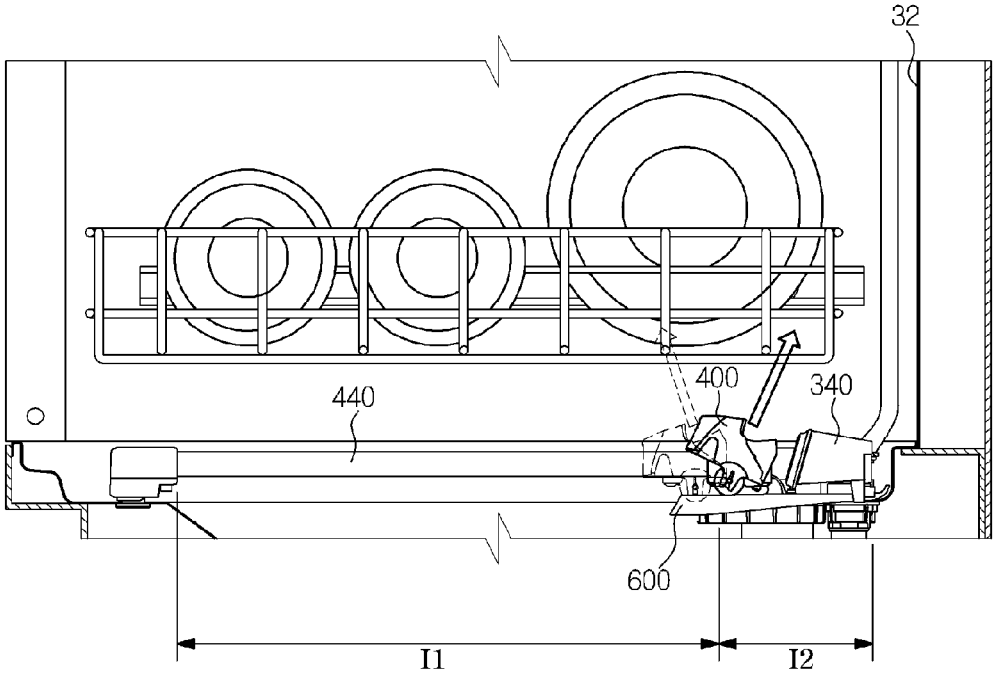
FIG. 35 is a view illustrating reflection of wash water performed by the vane of the dish washing machine of FIG. 1 in the non-movement section of the vane.

FIGS. 31 to 33 are views illustrating rotation of the vane of the dish washing machine of FIG. 1. FIG. 34 is a view illustrating reflection of wash water performed by the vane of the dish washing machine of FIG. 1 in the movement section of the vane. FIG. 35 is a view illustrating reflection of wash water performed by the vane of the dish washing machine of FIG. 1 in the non-movement section of the vane.

Hereinafter, a movement section and non-movement section of a vane and rotation of the vane according to one embodiment of the present disclosure will be described with reference to FIGS. 31 to 35.

In a dish washing machine 1 according to one embodiment, the vane 400 reflects the wash water sprayed from the fixed spray nozzles 330 and 340 toward the dishes. Since the fixed spray nozzles 330 and 340 spray the wash water approximately in a horizontal direction, the fixed spray nozzles 330 and 340 are the vane 400 are positioned approximately at the same level. Accordingly, the vane 400 is not movable to a region where the fixed spray nozzles 330 and 340 are disposed.

That is, the dish washing machine 1 has a vane movement section I1 in which the vane 400 is movable, and a vane non-movement section I2 to which the vane 400 is immovable.

According to one embodiment, the vane 400 of the dish washing machine 1 may be rotatably arranged to wash the dishes accommodated in the vane non-movement section I2.

As described above, the bottom plate cover 600 is provided with a rotary guide 610 protruding to guide movement of the vane 400, and the vane 400 is provided with a rotation restricting part 409 to interfere with the rotary guide 610. The rotation restricting part 409 is formed above the coupling lug 493 of the vane holder 490 which forms the axis of rotation of the vane 400 and transfers the driving force to the vane 400.

The rotary guide 610 includes a guide surface 611 formed to be curved to contact the rotation restricting part 409 and allow smooth movement of the vane 400.

When the vane 400 in the vane movement section I1 reaches the vane non-movement section I2, and thus the rotation restricting part 409 of the vane 400 is interfered with by the guide surface 611 of the rotary guide 610 of the bottom plate cover 600, the vane 400 rotates about the coupling lug 493 of the vane holder 490. Thereby, the wash water may be reflected toward the dishes in the non-movement section I2.

Figure 36:
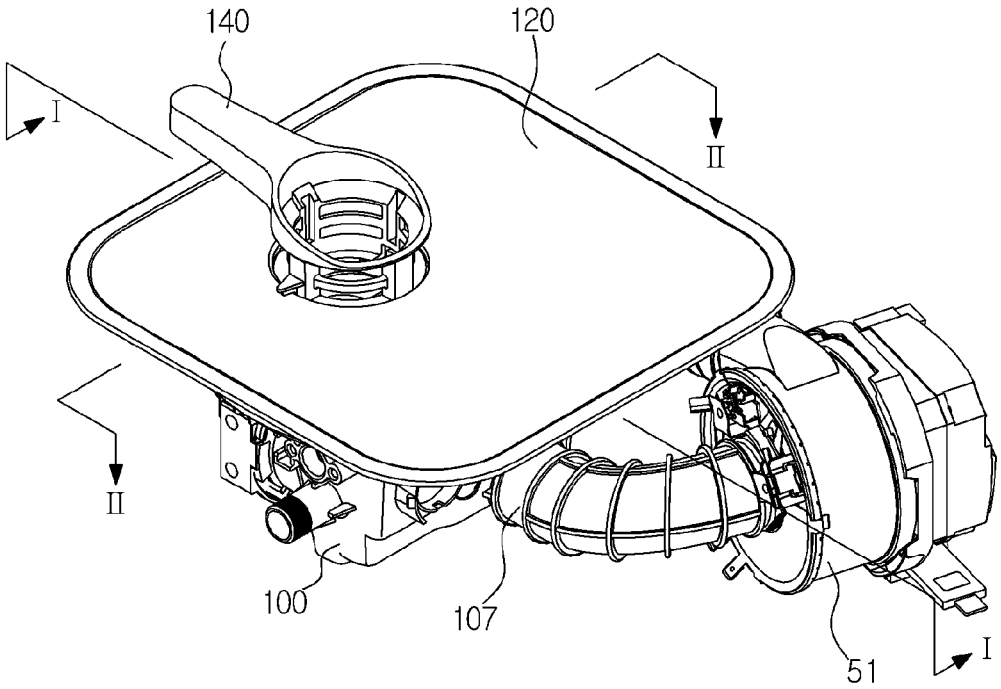
FIG. 36 is a view illustrating a sump, coarse filter and fine filter of the dish washing machine of FIG. 1.
Figure 37:
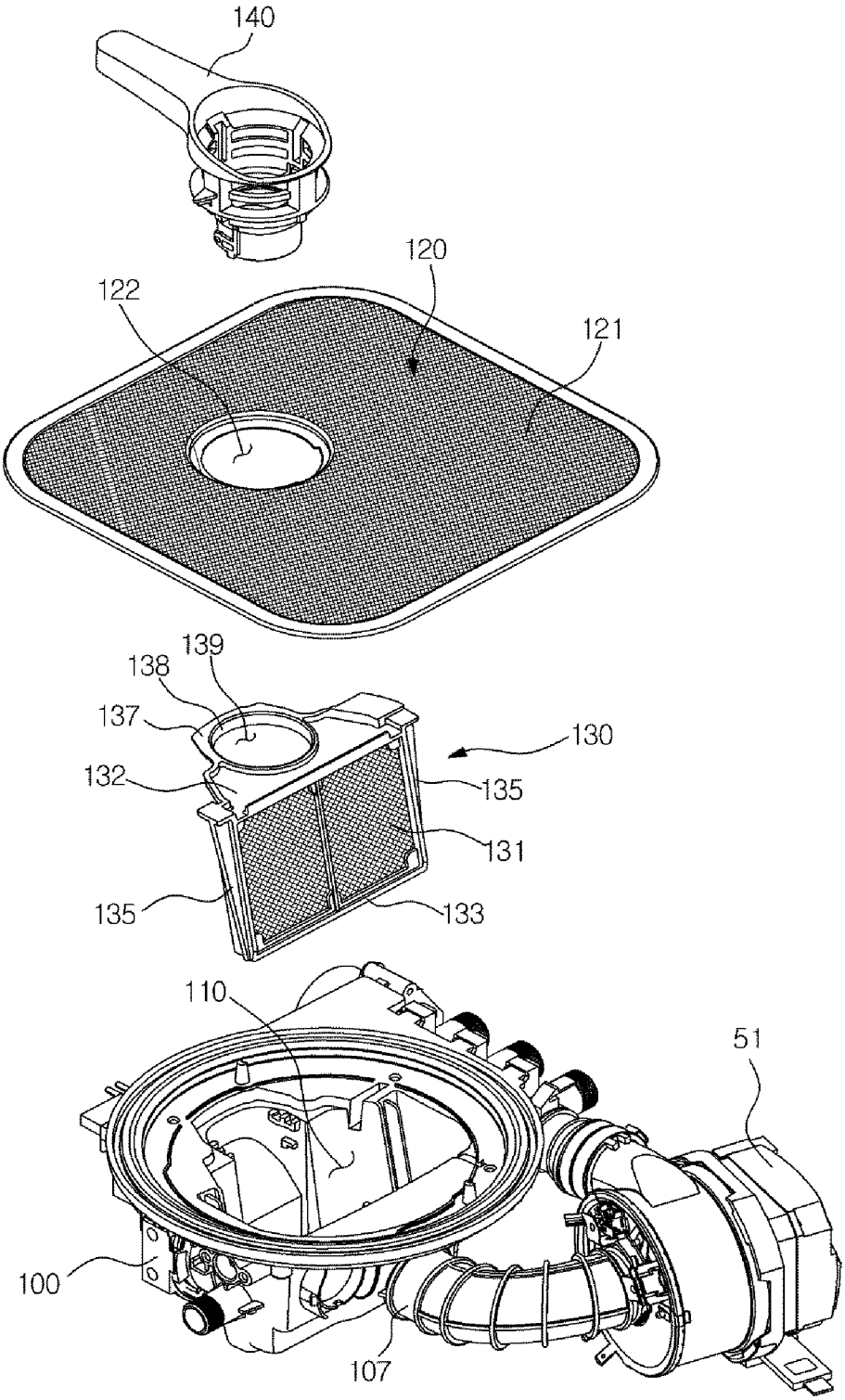
FIG. 37 is an exploded view illustrating the sump, coarse filter, fine filter and microfilter of the dish washing machine of FIG. 1.
Figure 38:
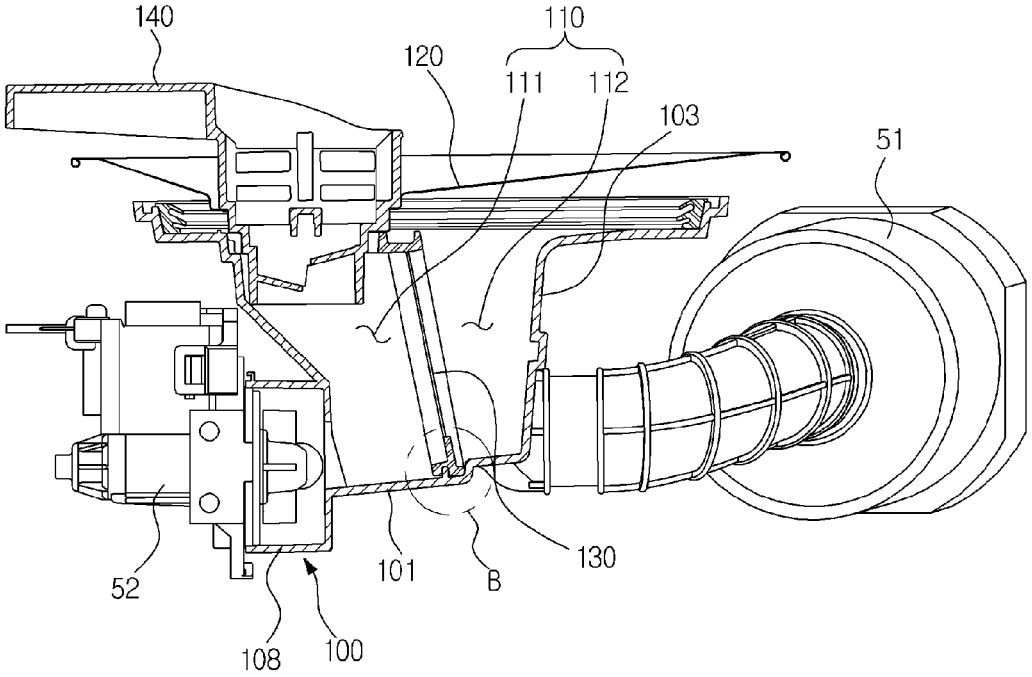
FIG. 38 is a cross-sectional view taken along line I-I of FIG. 36.
Figure 39:
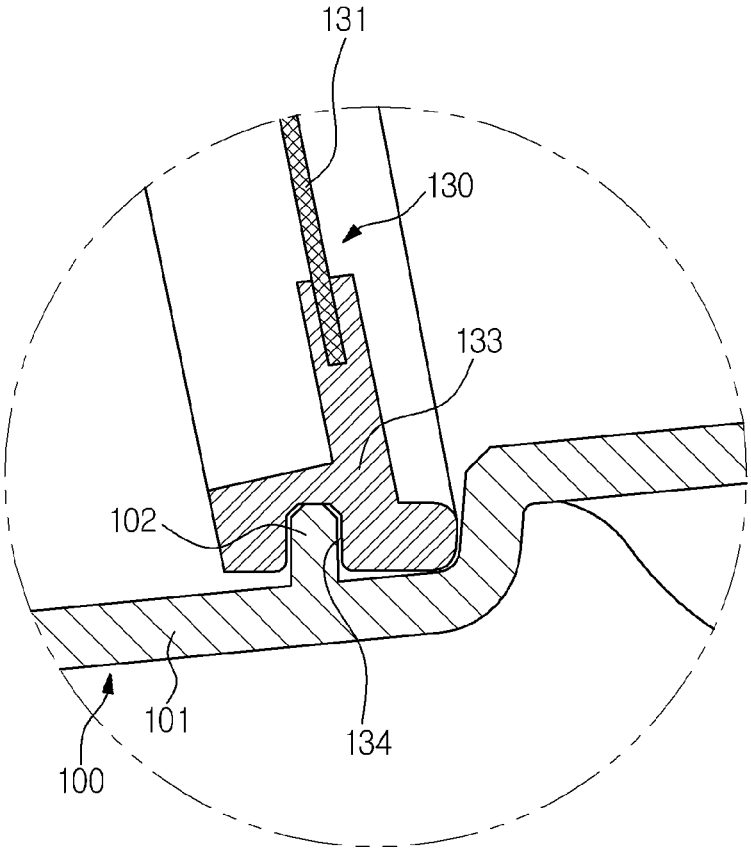
FIG. 39 is an enlarged view illustrating portion B of FIG. 38.
Figure 40:
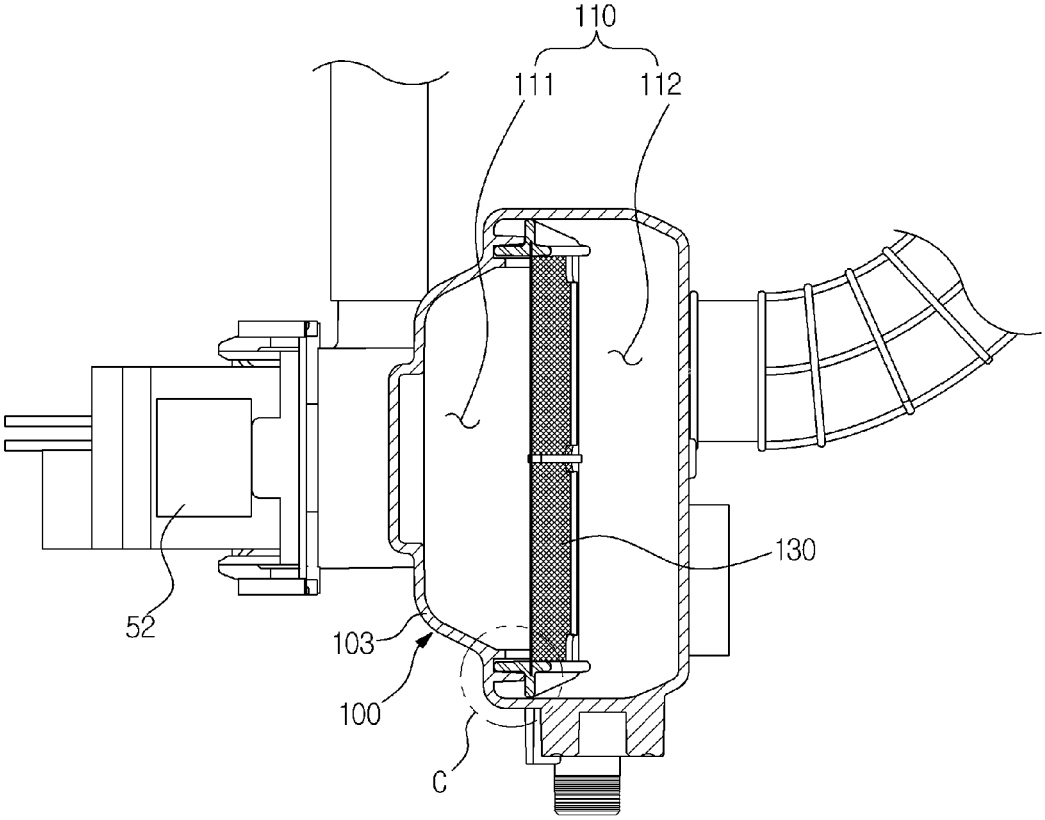
FIG. 40 is a cross-sectional view taken along line II-II of FIG. 38.
Figure 41:
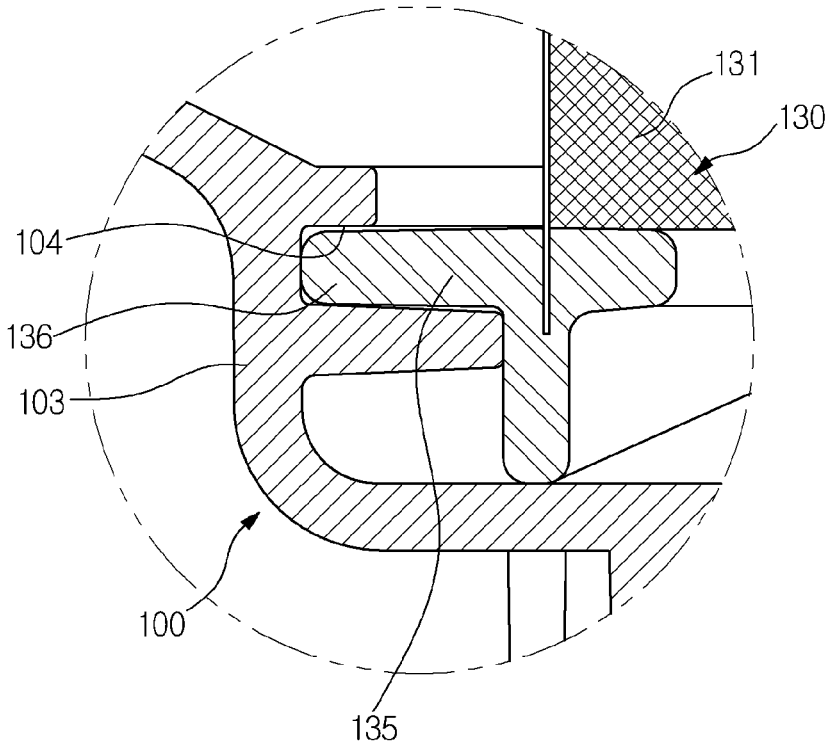
FIG. 41 is an enlarged view illustrating portion C of FIG. 40.
Figure 42:
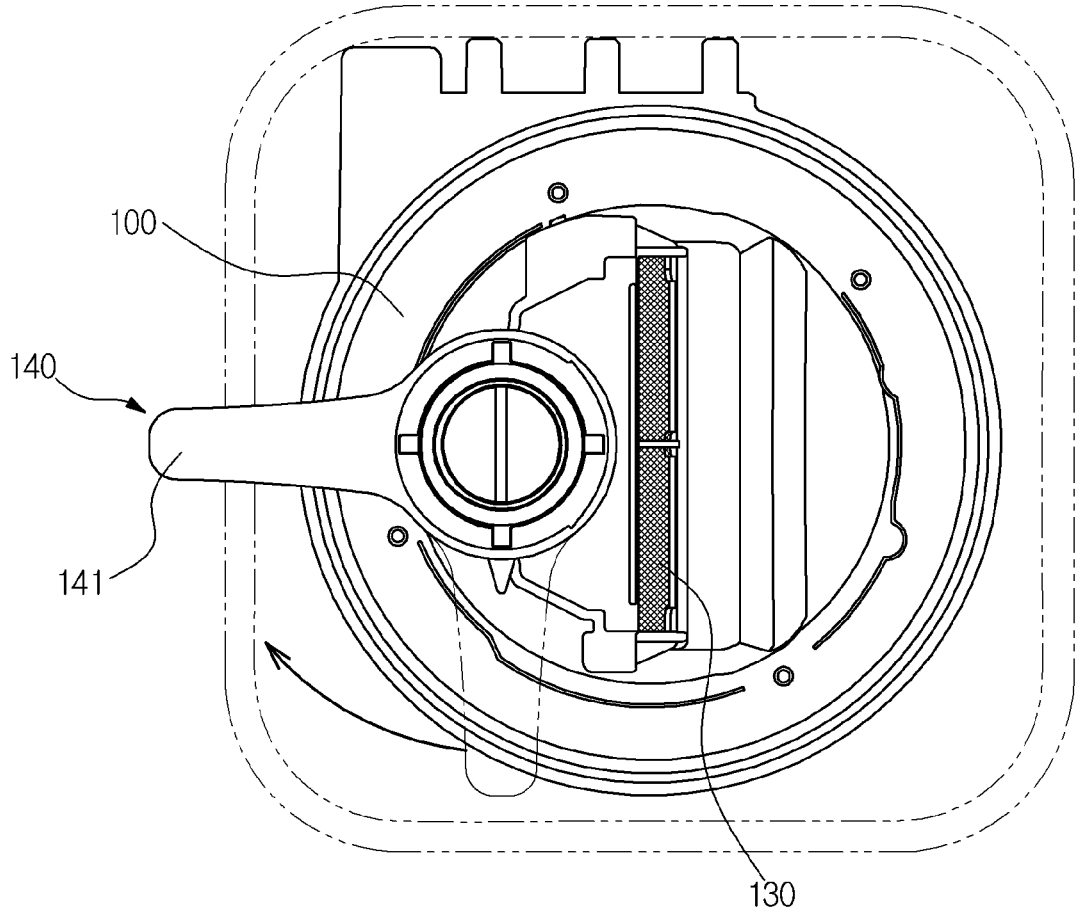
FIG. 42 is a plan view illustrating the sump and coarse filter of the dish washing machine of FIG. 1, in which the coarse filter performs a locking operation.
Figure 43:
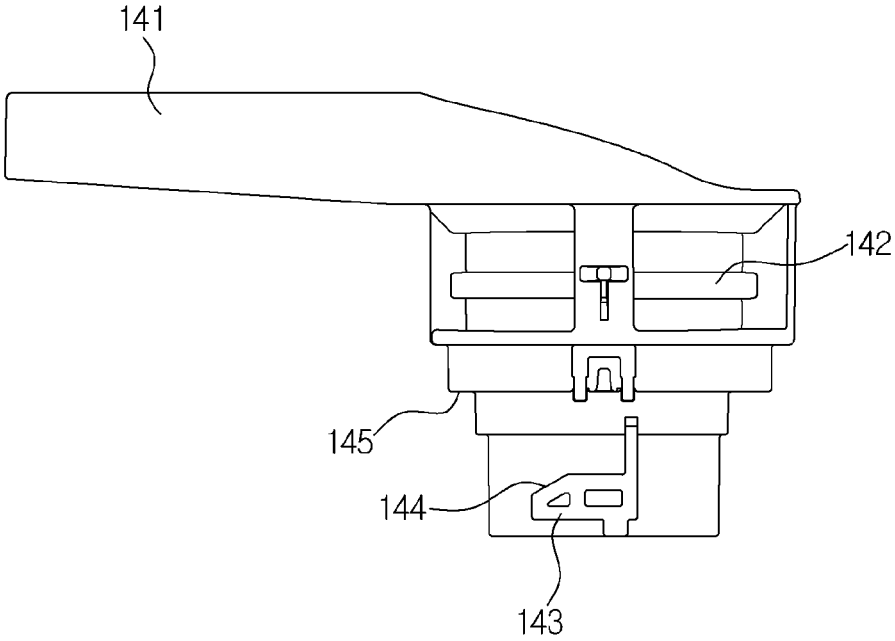
FIG. 43 is a side view illustrating the coarse filter of the dish washing machine of FIG. 1.
Figure 44:
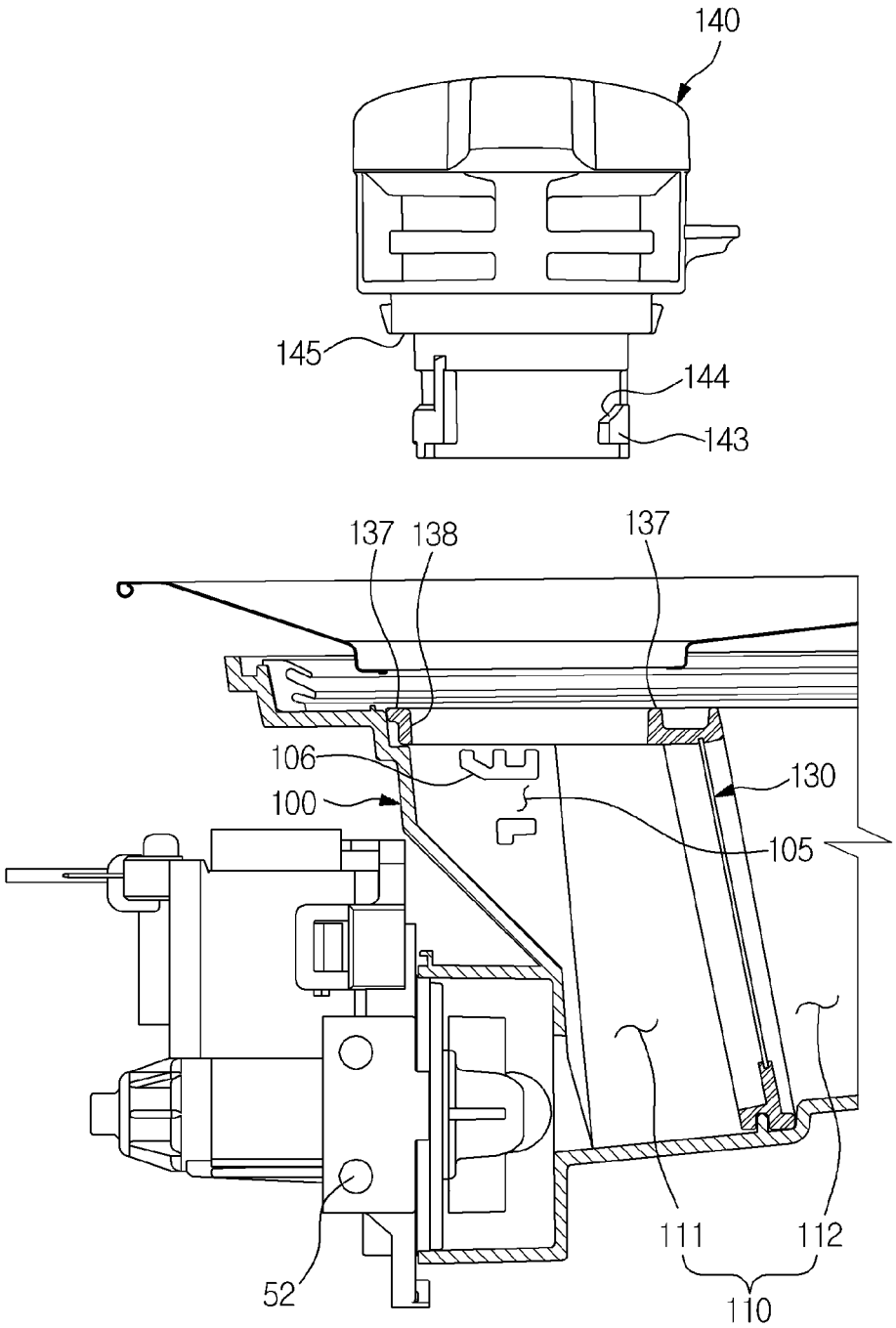
FIG. 44 is a view illustrating the sump and coarse filter of the dish washing machine of FIG. 1, in which the coarse filter performs a locking operation.
Figure 45:
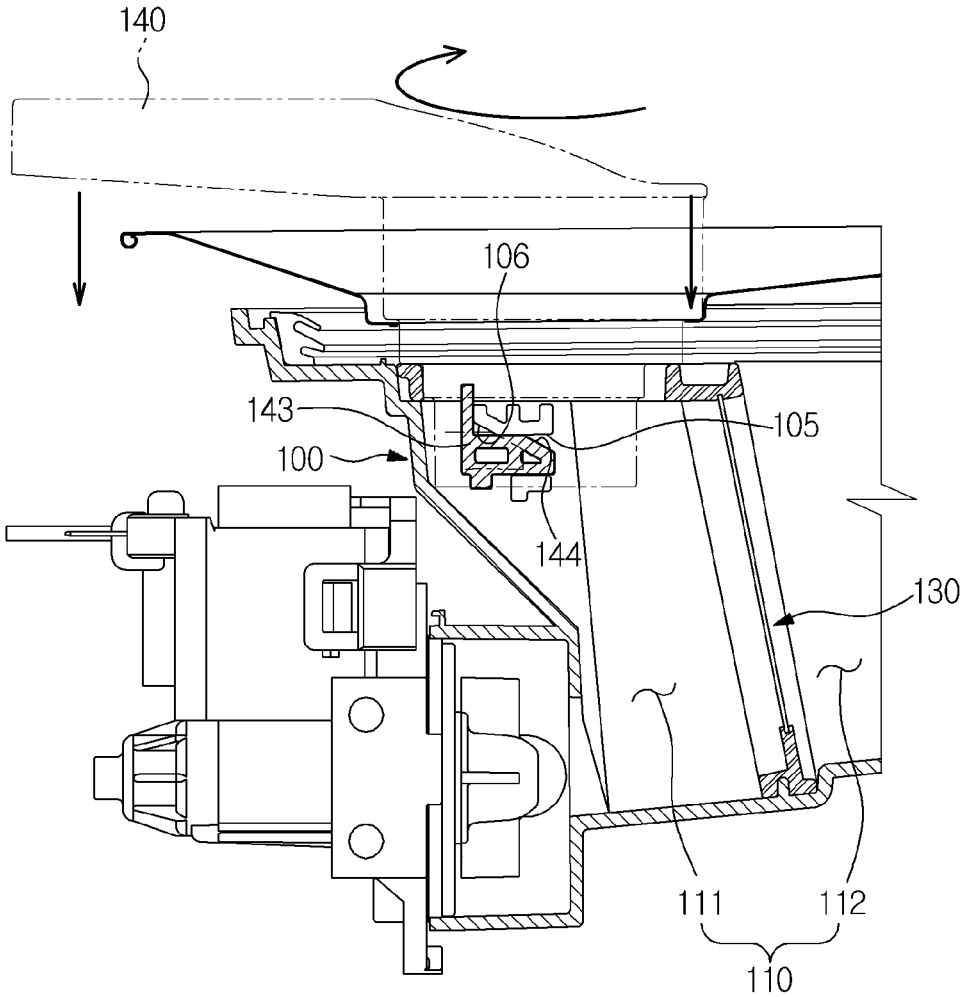
FIG. 45 is a cross-sectional view illustrating the sump, coarse filter and microfilter of the dish washing machine of FIG. 1.
Figure 46:
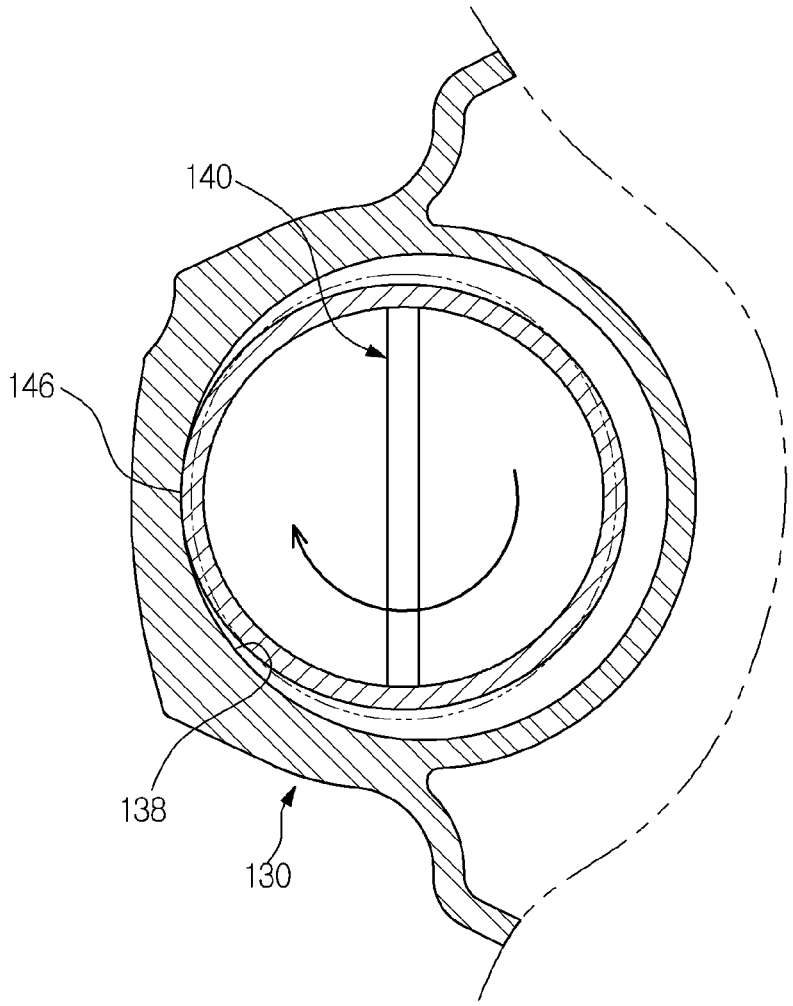
FIG. 46 is an enlarged plan view illustrating parts of the coarse filter and microfilter of the dish washing machine of FIG. 1.
Figure 47:
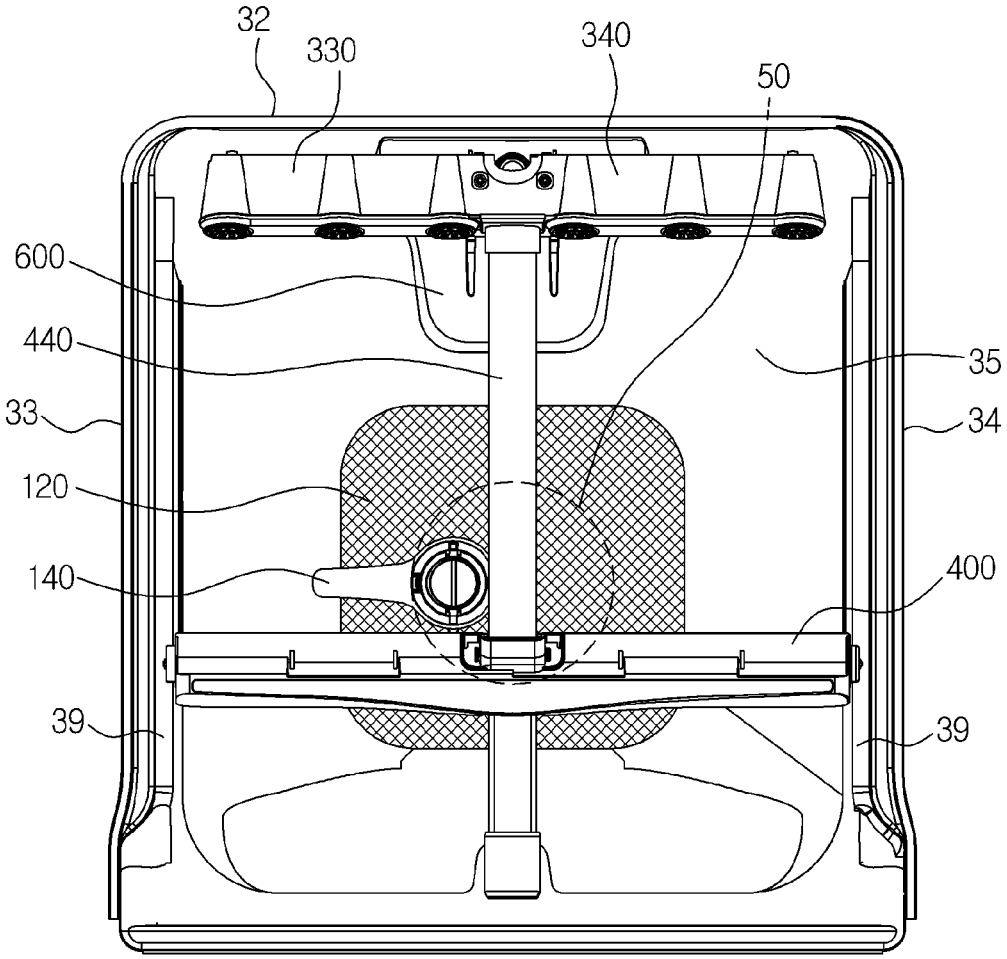
FIG. 47 is a plan view illustrating the lower portion of a washing tub of the dish washing machine of FIG. 1.

FIG. 36 is a view illustrating a sump, coarse filter and fine filter of the dish washing machine of FIG. 1. FIG. 37 is an exploded view illustrating the sump, coarse filter, fine filter and microfilter of the dish washing machine of FIG. 1. FIG. 38 is a cross-sectional view taken along line I-I FIG. 36. FIG. 39 is an enlarged view illustrating portion B of FIG. 38. FIG. 40 is a cross-sectional view taken along line II-II of FIG. 38. FIG. 41 is an enlarged view illustrating portion C of FIG. 40. FIG. 42 is a plan view illustrating the sump and coarse filter of the dish washing machine of FIG. 1, in which the coarse filter performs a locking operation. FIG. 43 is a side view illustrating the coarse filter of the dish washing machine of FIG. 1. FIG. 44 is a view illustrating the sump and coarse filter of the dish washing machine of FIG. 1, in which the coarse filter performs a locking operation. FIG. 45 is a cross-sectional view illustrating the sump, coarse filter and microfilter of the dish washing machine of FIG. 1. FIG. 46 is an enlarged plan view illustrating parts of the coarse filter and microfilter of the dish washing machine of FIG. 1. FIG. 47 is a plan view illustrating the lower portion of a washing tub of the dish washing machine of FIG. 1.

According to this embodiment, the dish washing machine 1 includes a sump 100 to store wash water, a circulation pump 51 to circulate the wash water from the sump 100 to spray nozzles 311, 313, 330 and 340, a drainage pump 52 to discharge the wash water in the sump 100 and dirt from the body 10, and filters 120, 130 and 140 to filter out the dirt contained in the wash water.

A bottom plate 35 of the washing tub 30 is provided with a drainage hole 50 (FIG. 47) to discharge wash water to the sump 100. The bottom plate 35 of the washing tub 30 may be inclined toward the drainage hole 50 such that the wash water is guided toward the drainage hole 50 by gravity.

The sump 100 may be formed approximately in the shape of a semi-sphere having an open top. The sump 100 includes a bottom portion 101, a sidewall portion 103, a water storage chamber 110 formed between the bottom portion 101 and the sidewall portion 103 to store wash water, a circulation port 107 connected with the circulation pump 51, and a drainage port 108 connected with the drainage pump 52.

The filters 120, 130 and 140 include a fine filter 120 mounted in the drainage hole 50 of the bottom plate 35, a coarse filter 140 mounted to the sump 100, and a microfilter 130.

The coarse filter 140 may be formed in an approximately cylindrical shape. The coarse filter 140 may be mounted on the inner surface of the sidewall portion 103 of the sump 100.

The coarse filter 140 may have a filter portion 142 to filter out dirt having a relatively large size and a handle 141 for installation of the coarse filter 140. The filter portion 142 of the coarse filter 140 may be formed on the circumferential surface of the coarse filter 140.

The coarse filter 140 is mounted to the sump 100 by passing through a through hole 139 of the microfilter 130 and a through hole 121 of the fine filter. The upper portion of the coarse filter 140 protrudes into the washing tub 30, and the lower portion thereof protrudes toward a dirt catching chamber 111 of the sump 100. The dirt catching chamber 111 will be described later.

The fine filter 120 may have a filter portion 121 to filter out dirt having a relatively intermediate size or large size and a through hole 122 through which the coarse filter 140 passes. The fine filter 120 is approximately horizontally mounted on the drainage hole 50 in the bottom plate 35 of the washing tub. The fine filter 120 may be inclined to allow the wash water to be guided toward the through hole 122 by gravity.

The wash water in the washing tub 30 may flow toward the coarse filter 140 along the slope of the fine filter 120. A part of the wash water and dirt may pass through the filter portion 121 of the fine filter 120 and flow directly to the water storage chamber 110 of the sump 100.

The microfilter 130 may have a filter portion 131 adapted to filter out dirt of a relatively small size or a size greater than the small size and having a flat shape, frames 132, 133 and 135 to support the filter portion 131, and a through hole 139 through which the coarse filter 140 passes.

The frames 132, 133 and 135 include an upper frame 132, a lower frame 133, and side frames 135. The microfilter 130 is mounted to the sump 100 such that the lower frame 133 closely contacts the bottom portion 101 of the sump 100 and that the side frames 135 closely contact the sidewall portion 103 of the sump 100.

The microfilter 130 may partition the water storage chamber 110 of the sump 100 into the dirt catching chamber 111 and a circulation chamber 112. The drainage pump 52 is connected to the dirt catching chamber 111, and the circulation pump 51 is connected to the circulation chamber 112.

Since the lower portion of the coarse filter 140 protrudes toward the dirt catching chamber 111 as described above, the wash water and the dirt therein which have passed through the coarse filter 140 are introduced into the dirt catching chamber 111.

The wash water introduced into the dirt catching chamber 111 may pass through the microfilter 130 and then flow to the circulation chamber 112. The dirt contained in the wash water introduced into the dirt catching chamber 111 fails to pass through the microfilter 130, and therefore it remains in the dirt catching chamber 111 without flowing to the circulation chamber 112.

The dirt caught in the dirt catching chamber 111 may be discharged from the body 10 along with the wash water when the drainage pump 52 is driven.

Meanwhile, to prevent the dirt in the dirt catching chamber 111 from flowing into the circulation chamber 112 through a gap between the microfilter 130 and the sump 100, the microfilter 130 should closely contact the bottom portion 101 and sidewall portion 103 of the sump 100.

To this end, the lower frame 133 of the microfilter 130 may be provided with a lower sealing groove 134, and each of the side frames 135 may be provided with a side sealing protrusion 136. The bottom portion 101 of the sump 100 may be correspondingly provided with a lower sealing protrusion 102 inserted into the lower sealing groove 134, and the sidewall portion 103 of the sump 100 may be correspondingly provided with a side sealing groove 104 allowing the side sealing protrusion 136 to be inserted thereinto.

By the structures of the lower and side protrusions and grooves, sealing of the microfilter 130 and the sump 100 may be enhanced.

Meanwhile, the coarse filter 140 may be mounted to the sump 100 by being inserted vertically downward into the sump 100 and turned from a release position to a lock position.

To this end, the outer circumferential surface of the coarse filter 140 may be provided with a mounting protrusion 143, and the inner surface of the sidewall portion 103 of the sump 100 may be provided with a mounting groove 105 into which the mounting protrusion 143 is horizontally inserted when the coarse filter 140 is turned from the release position to the lock position.

The mounting protrusion 143 may have an upward inclination surface 144 inclined upward as it extends in the direction of turning of the coarse filter 140 from the release position to the lock position. The mounting groove 105 may have a downward inclination surface 106 inclined downward as it extends in the direction of turning of the coarse filter 140 from the release position to the lock position.

With this configuration, when the coarse filter 140 is turned from the release position to the lock position, the upward inclination surface 144 of the mounting protrusion 143 may slide along the downward inclination surface 106 of the mounting groove 105, thereby causing the coarse filter 140 to move downward.

When the coarse filter 140 is turned from the release position to the lock position, it may press the microfilter 130 downward while moving downward. To this end, the coarse filter 140 may have a downwardly pressing surface 145 which is horizontally formed to press the microfilter 130 downward. The microfilter 130 may have a downwardly pressed surface 137 which is horizontally formed to be pressed by the downwardly pressing surface 145.

As the coarse filter 140 presses the microfilter 130 downward by being turned from the release position to the lock position, sealing of the gap between the lower frame 133 of the microfilter 130 and the bottom portion 101 of the sump 100 may be further enhanced, and displacement of the microfilter 130 may be prevented.

In addition, the coarse filter 140 may have a laterally pressing surface 146 formed by radially outward expansion of a portion of the outer circumferential surface of the coarse filter 140 so as to laterally pressing the microfilter 130 when it is turned from the release position to the lock position. That is, the coarse filter 140 may have a bulging shape or an oval shape.

The microfilter 130 may have a laterally pressed surface 138 which is laterally pressed by the laterally pressing surface 146.

With this configuration, the microfilter 130 is laterally pressed when the coarse filter 140 is turned from the release position to the lock position. Thereby, sealing of the gap between the side frame 135 of the microfilter 130 and the sidewall portion 103 of the sump 100 may be enhanced.

Meanwhile, as shown in FIG. 47, the coarse filter 140 may be disposed such that one of two sidewalls 33 and 34 of the washing tub is closer than the other one of the sidewalls 33 and 34 to the coarse filter 140. That is, the coarse filter 140 may be disposed such that the left sidewall 33 is closer than the right sidewall 34 to the coarse filter 140. As the coarse filter 140 is disposed as above, the coarse filter 140 may be readily removed without being interfered with by a rail 440.

Figure 48:
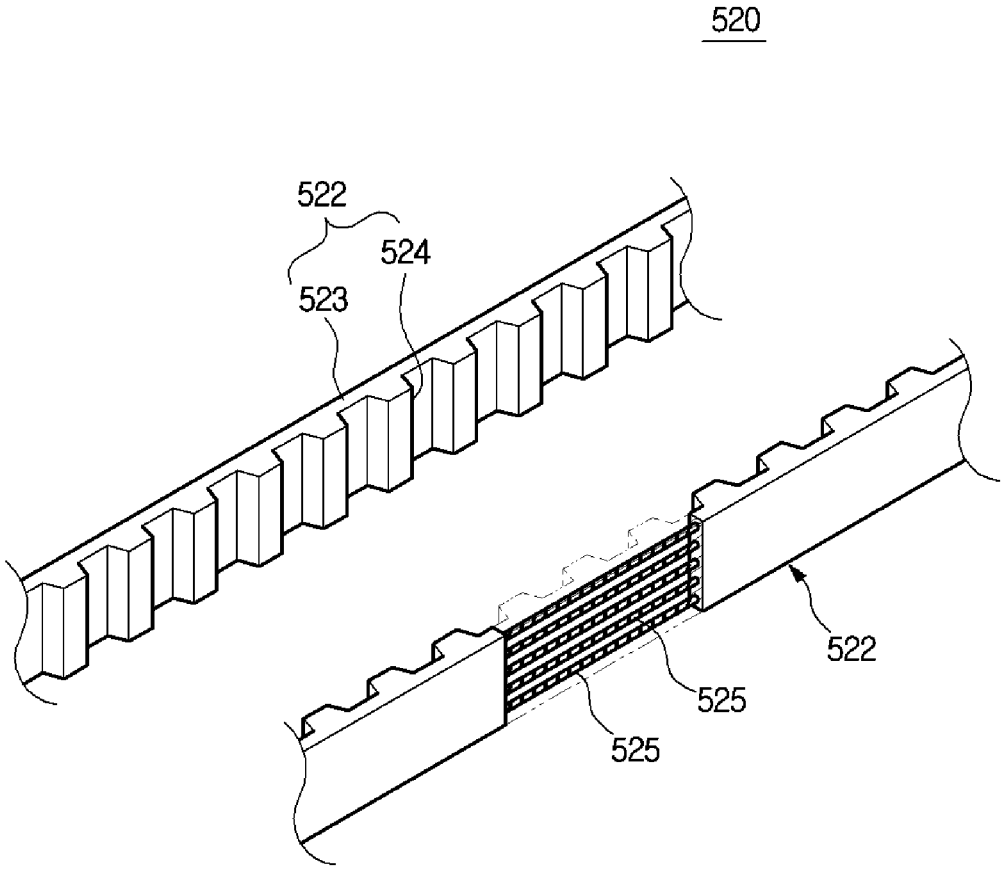
FIG. 48 is a view illustrating a detailed structure of the belt of the dish washing machine of FIG. 1.

FIG. 48 is a view illustrating a detailed structure of the belt of the dish washing machine of FIG. 1.

Referring to FIG. 48, the belt 520 may be a timing belt including a tooth 524. The tooth 524 may be coupled with teeth of the drive pulley 500 and the idle pulley 510 to receive driving power.

The belt 520 may include a belt body 522 having a belt portion 523 and the tooth 524, and a core wire 525 buried in the belt body 522. The core wire 525 may be formed to improve durability of the belt 520, and buried in the belt body 522 in the form of a plurality of spirally twisted fibers formed of a predetermined material.

Normally, a belt body of a timing belt may be formed of rubber or polyurethane. The belt body 522 according to the embodiment of the present disclosure may be properly formed of polyurethane. This is because, as is known, since polyurethane has better water resistance and is cleaner than rubber, it is more suitable for the belt body 522 of the dish washing machine which is always exposed to wash water and a detergent in the washing tub. However, the material of the belt body 522 is not limited thereto.

In addition, iron, glass, or carbon fibers may be normally used as the core wire 525 of the timing belt. The core wire 525 according to the embodiment of the present disclosure may be preferably formed of aramid fibers. The aramid fibers may refer to aromatic polyamide fibers, for example, Kevlar fibers of DuPont Inc. Since the aramid fibers have excellent tensile strength and elasticity compared to other fibers and are inexpensive, the aramid fibers may be most suitable as a reinforcement material of the belt body 522 according to the embodiment of the present disclosure. However, it is obvious that other fibers instead of the aramid fibers may be used as the core wire 525, or the aramid fibers and other fibers may be mixed.

Figure 49:
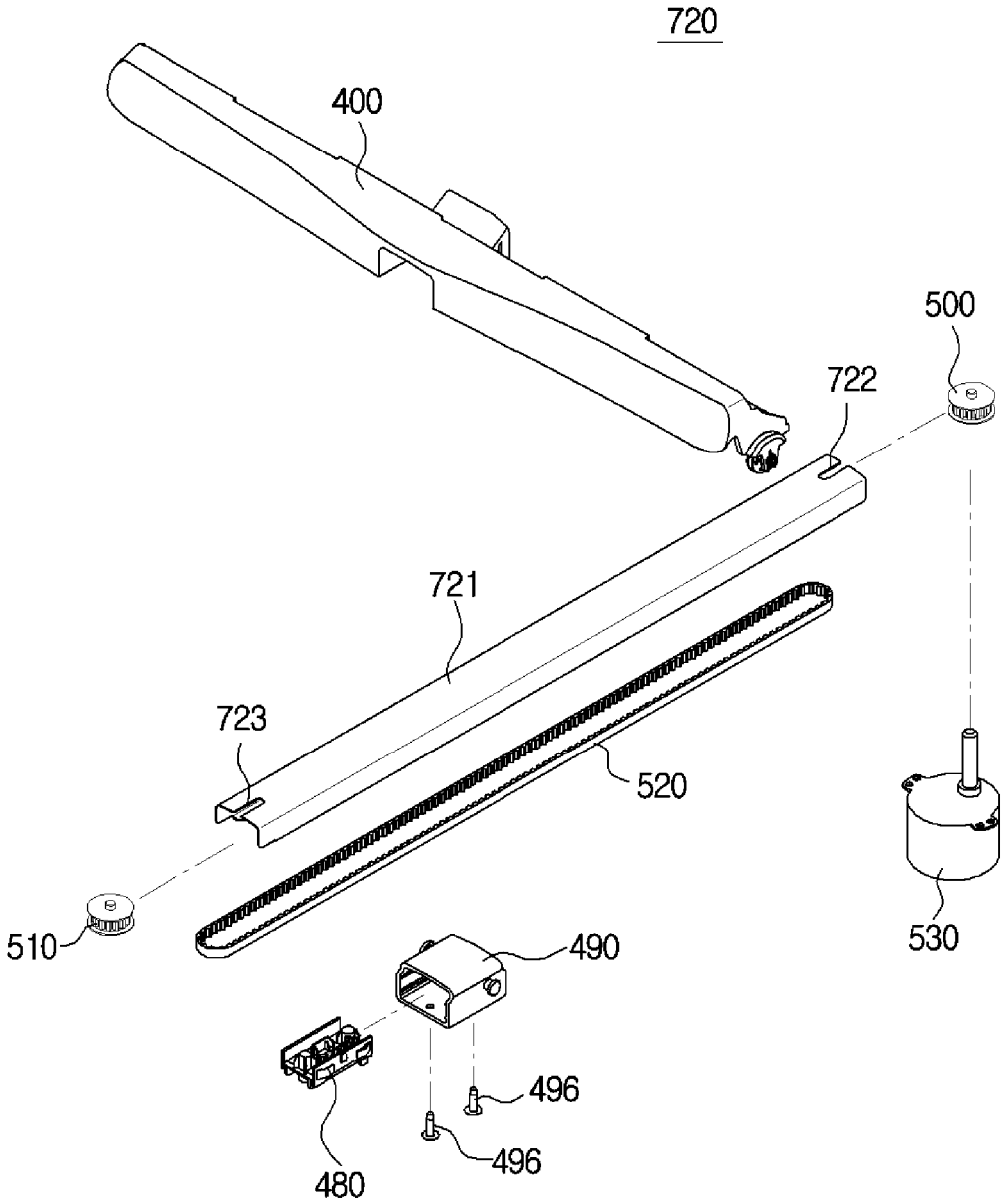
FIG. 49 is an exploded view illustrating a configuration of a drive unit according to a second embodiment of the present disclosure.

FIG. 49 is an exploded view illustrating a configuration of a drive unit according to a second embodiment of the present disclosure.

The drive unit according to the second embodiment of the present disclosure will be described with reference to FIG. 49. The same configurations as in the first embodiment have the same reference numerals, and descriptions thereof will be omitted.

A drive unit 720 of the dish washing machine may linearly reciprocate the vane 400 reflecting wash water sprayed from a nozzle in the spray direction of the wash water. The drive unit 720 may include a motor 530 generating driving power, a rail 721 guiding movement of the vane 400, a drive pulley 500 connected to the motor 530 to rotate, a belt 520 disposed inside the rail 721 and connected to the drive pulley 500 to rotate, an idle pulley 510 connected to the belt 520 to rotatably support the belt 520, a belt holder 480 disposed inside the rail 721 and coupled with the belt 520 to linearly reciprocate, and a vane holder 490 disposed outside the rail 721 and coupled with the belt holder 480 to linearly reciprocate, the vane holder 490 being coupled with the vane 400.

The rail 721 may have a tubular shape having an opening approximately at a lower portion thereof. Through the lower opening of the rail 721, the belt 520 disposed inside the rail 721 may be connected to the vane 400 disposed outside the rail 721, and the driving power of the belt 520 may be transferred to the vane 400.

Pulley mounting parts 722 and 723 rotatably coupled with the drive pulley 500 and the idle pulley 510, respectively, may be disposed at both end portions of the rail 721. Accordingly, the drive pulley 500 and the idle pulley 510 may be directly coupled with the rail 721 with no front holder and rear holder of the drive unit according to the first embodiment of the present disclosure.

Figure 50:
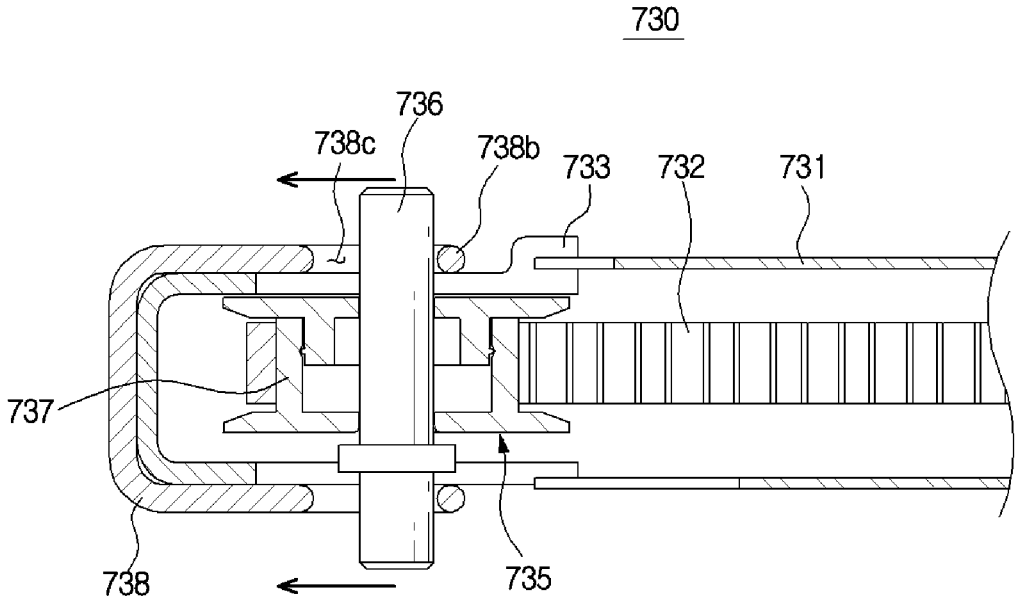
FIG. 50 is a cross-sectional view illustrating a rail, a belt, an idle pulley, a front holder, and a tension maintaining device of a drive unit according to a third embodiment of the present disclosure.

FIG. 50 is a cross-sectional view illustrating a rail, a belt, idle pulley, front holder, and tension maintaining device of a drive unit according to a third embodiment of the present disclosure.

The drive unit according to the third embodiment of the present disclosure will be described with reference to FIG. 50. The same configurations as in the above-described other embodiments have the same reference numerals, and descriptions thereof will be omitted.

A drive unit 730 may include a rail 731 configured to guide movement of a vane 400 (refer to FIG. 21), a belt 732 disposed inside the rail 731, a motor 530 (refer to FIG. 21) configured to generate driving power, a drive pulley 500 (refer to FIG. 21) connected to the motor 530, an idle pulley 735 connected to the belt 732 to rotatably support the belt 732, a pulley holder 733 rotatably supporting the idle pulley 735, a belt holder 480 (refer to FIG. 21) disposed inside the rail 731 and coupled with the belt 732 to linearly reciprocate, a vane holder 490 (refer to FIG. 21) disposed outside the rail 731 and coupled with the belt holder 480 to linearly reciprocate, the vane holder 490 being coupled with the vane 400, and an elastic member 738 which is a tension control device configured to control a tension of the belt 732.

The pulley holder 733 may support the rail 731. A rotary shaft 736 of the idle pulley 735 may extend to an upper portion and a lower portion of the pulley holder 733.

The elastic member 738 may be coupled with an end portion of the pulley holder 733. The elastic member 738 may include an insertion hole 738*c* to which the rotary shaft 736 of the idle pulley 735 is inserted, and a hook 738*b* disposed in close contact with the rotary shaft 736.

The elastic member 738 may be formed as a unibody structure, and the insertion hole 738*c* and the hook 738*b* may be formed on each end portion of the elastic member 738. The elastic member 738 may be bent two times, and thus the insertion hole 738*c* and hook 738*b* of the elastic member 738 may be coupled with each of an upper end portion and lower end portion of the rotary shaft 736 of the idle pulley 735.

Accordingly, the idle pulley 735 may be pressed by an elastic force of the elastic member 738 in a direction in which a tension is applied to the belt 732 (the arrow in FIG. 50).

Accordingly, the idle pulley 735 may be located at a position where the elastic force of the elastic member 738 and the tension of the belt 732 are balanced and, when the tension of the belt 732 becomes weak, may slightly move toward the elastic member 738 due to the elastic force of the elastic member 738 to apply a tension to the belt 732.

The unexplained reference numeral 737 is a belt-mounting part of the idle pulley 735.

Figure 51:
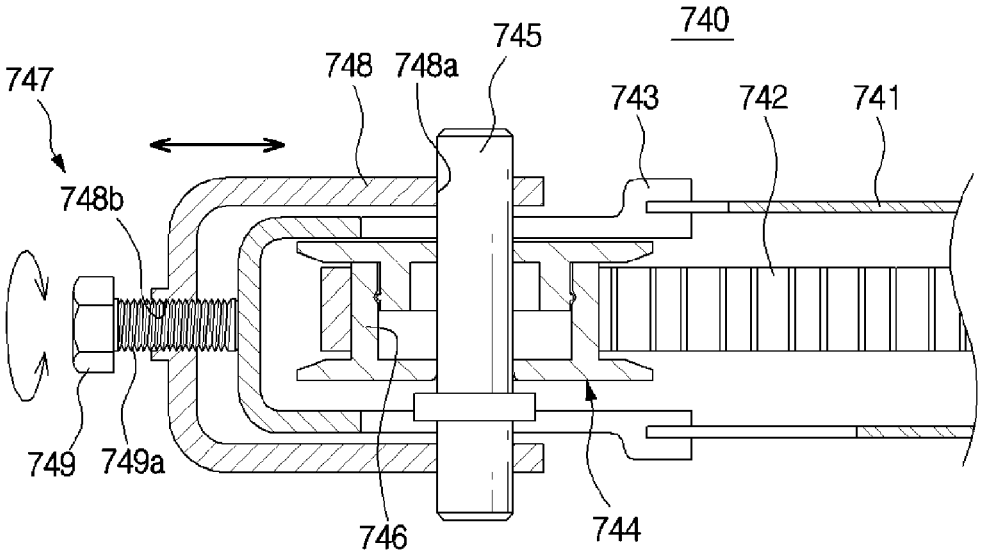
FIG. 51 is a cross-sectional view illustrating a rail, a belt, idle pulley, front holder, and tension maintaining device of a drive unit according to a fourth embodiment of the present disclosure.

FIG. 51 is a cross-sectional view illustrating a rail, a belt, idle pulley, front holder, and tension maintaining device of a drive unit according to a fourth embodiment of the present disclosure.

The drive unit according to the fourth embodiment of the present disclosure will be described with reference to FIG. 51. The same configurations as in the above-described other embodiments have the same reference numerals, and descriptions thereof will be omitted.

A drive unit 740 may include a rail 741 configured to guide movement of a vane 400 (refer to FIG. 21), a belt 742 disposed inside the rail 741, a motor 530 (refer to FIG. 21) generating driving power, a drive pulley 500 (refer to FIG. 21) connected to the motor 530, an idle pulley 744 connected to the belt 742 to rotatably support the belt 742, a pulley holder 743 rotatably supporting the idle pulley 744, a belt holder 480 (refer to FIG. 21) disposed inside the rail 741 to be coupled with the belt 742 to linearly reciprocate, a vane holder 490 (refer to FIG. 21) disposed outside the rail 741 to be coupled with the belt holder 480 to linearly reciprocate, the vane holder 490 being coupled with the vane 400, and a position control device 747 which is a tension control device configured to control a tension of the belt 742.

The pulley holder 743 may support the rail 741. A rotary shaft 745 of the idle pulley 744 may extend to an upper portion and lower portion of the pulley holder 743.

The position control device 747 may include a slide member 748 coupled with the rotary shaft 745 of the idle pulley 744 and movable in a longitudinal direction of the rail 741, and a control member 749 moving the slide member 748.

An insertion hole 748*a* through which the rotary shaft 745 of the idle pulley 744 passes to be coupled to the slide member 748 may be formed at each end portion of the slide member 748. That is, the rotary shaft 745 of the idle pulley 744 may be rotatably supported by the insertion hole 748*a* of the slide member 748. Accordingly, while the slide member 748 moves, the idle pulley 744 may move along with the slide member 748.

The slide member 748 may include a female screw 748*b* to which the control member 749 is screwed, and the control member 749 may be a screw including a male screw 749*a* screwed into the female screw 748*b*.

The control member 749 may be longitudinally supported by the pulley holder 743. Accordingly, when the control member 749 rotates, the control member 749 may not move forward and backward. Instead, the slide member 748 may move forward and backward in a longitudinal direction of the rail 741. When the slide member 748 moves forward and backward, the idle pulley 744 may also move forward and backward. Accordingly, the belt 742 wound around the idle pulley 744 may be tightened or loosened to control the tension of the belt 742.

The unexplained reference numeral 746 is a belt-mounting part of the idle pulley 744.

Figure 52:
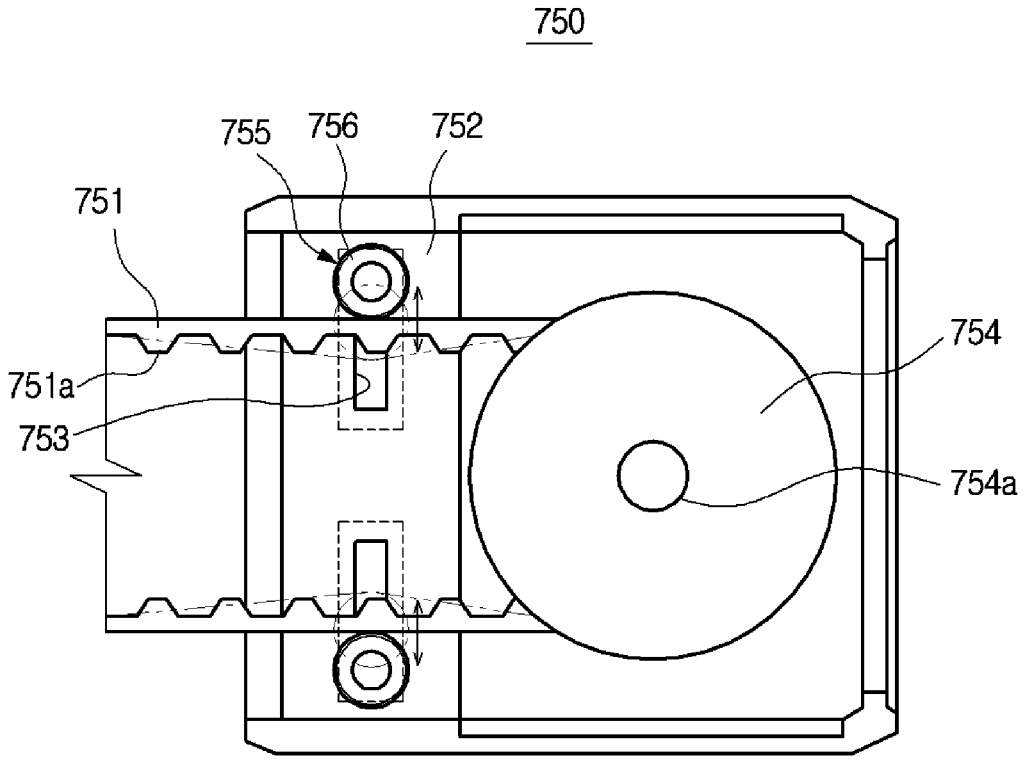
FIG. 52 is a plan view illustrating a belt, idle pulley, front holder, and tension maintaining device of a drive unit according to a fifth embodiment of the present disclosure.
Figure 53:
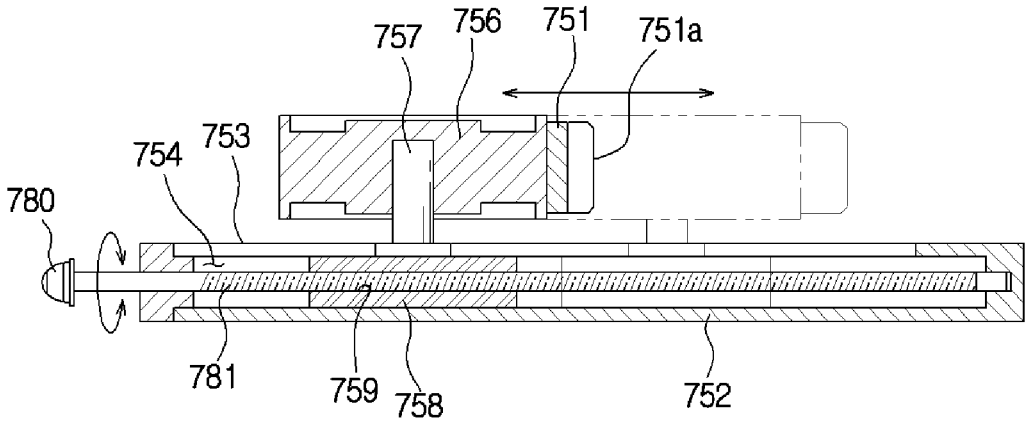
FIG. 53 is a cross-sectional view illustrating a detailed structure of the tension maintaining device in FIG. 52.

FIG. 52 is a plan view illustrating a belt, an idle pulley, a front holder, and a tension maintaining device of a drive unit according to a fifth embodiment of the present disclosure. FIG. 53 is a cross-sectional view illustrating a detailed structure of the tension maintaining device in FIG. 52.

The drive unit according to the fifth embodiment of the present disclosure will be described with reference to FIGS. 52 and 53. The same configurations as in the above-described other embodiments have the same reference numerals, and descriptions thereof will be omitted.

A drive unit 750 may include a belt 751, a motor 530 (refer to FIG. 21) generating driving power, a drive pulley 500 (refer to FIG. 21) connected to the motor 530, an idle pulley 754 connected to the belt 751 to rotatably support the belt 751, a pulley holder 752 rotatably supporting the idle pulley 754, and a pressing device 755 which is a tension control device configured to control a tension of the belt 751.

As illustrated in FIG. 52, the pressing device 755 may apply pressure to an opposite surface to a tooth 751*a* of the belt 751 so as to control the tension of the belt 751.

The pressing device 755 may include a roller 756 which is a press member in contact with the opposite surface to the tooth 751*a* of the belt 751, a slide member 758 moving the roller 756 in a direction perpendicular to the belt 751, and a control member 780 moving the slide member 758.

The roller 756 may be supported by a rotary shaft 757 to rotate by the slide member 758. The pulley holder 752 may include a guide home 753 formed to move the rotary shaft 757 of the roller 756 forward and backward, and an accommodation space 754 configured to accommodate the slide member 758.

The control member 780 may be a screw including a male screw 781, and a female screw 759 to which the male screw 781 is coupled may be formed in the slide member 758. The control member 780 may be longitudinally supported by the pulley holder 752. Accordingly, when the control member 780 rotates, the slide member 758 may move in the direction perpendicular to the belt 751, and the roller 756 may also move in the direction perpendicular to the belt 751. Thus, the belt 751 may be tightened or loosened.

As is apparent from the above description, a dish washing machine with a linear-type spray structure according to one embodiment of the present disclosure has a vane driving unit that may be readily assembled and disassembled, reduce costs and be reliable.

A belt of a drive unit according to one embodiment of the present disclosure may have excellent durability, water resistance, and chemical resistance since it includes a belt body formed of polyurethane and a core wire formed of aramid fibers and buried in the belt body. Accordingly, the belt according to the embodiment of the present disclosure may maintain the reliability even when exposed to water in a wash tub.

A drive unit according to one embodiment of the present disclosure may maintain reliability even when it is used for long periods of time, since it includes a tension control device configured to maintain a tension of a belt.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. A dish washing machine comprising:
- a body;
- a washing tub provided in the body;
- a fixed nozzle positioned at one side of the washing tub to inject wash water into the washing tub;
- a vane configured to be moveable within the washing tub and to reflect the wash water injected from the fixed nozzle toward dishes; and
- a drive unit to drive the vane;
- wherein the drive unit comprises
  - a motor to generate a driving force;
  - a belt, connected to a drive pulley and an idle pulley, to transfer the driving force of the motor to the vane;
  - a rail to guide movement of the vane;
  - a rear holder to rotatably support the drive pulley, the rear holder being coupled to one end of the rail by tension of the belt; and
  - a front holder to rotatably support the idle pulley, the front holder being coupled to the other end of the rail by the tension of the belt.

2. The dish washing machine according to claim 1, wherein the rail comprises an inner space and a lower opening formed at a lower portion of the rail.

3. The dish washing machine according to claim 2, wherein the belt is disposed in the inner space of the rail.

4. The dish washing machine according to claim 2, wherein the drive unit further comprises a belt holder coupled to teeth of the belt to move along with the belt in the inner space of the rail.

5. The dish washing machine according to claim 4, wherein the drive unit further comprises a vane holder arranged to surround an outer surface of the rail and coupled to the belt holder through the lower opening of the belt to move along with the belt holder, the vane holder being coupled to the vane.

6. The dish washing machine according to claim 1, wherein the front holder comprises a front top holder, a front bottom holder, and a pulley bracket provided between the front top holder and the front bottom holder, the pulley bracket being configured to rotatably support the idle pulley.

7. The dish washing machine according to claim 6, wherein the front holder further comprises an elastic member to elastically support the pulley bracket to maintain the tension of the belt.

8. The dish washing machine according to claim 7, wherein one end of the elastic member is supported by the front top holder or the front bottom holder, and the other end of the elastic member is supported by the pulley bracket.

9. The dish washing machine according to claim 7, wherein the pulley bracket is arranged to move with respect to the front top holder and the front bottom holder.

10. The dish washing machine according to claim 7, wherein the elastic member is a compression spring.

11. The dish washing machine according to claim 1, wherein the belt is formed of a resin material.

12. The dish washing machine according to claim 1, wherein a drive shaft of the motor is coupled to the drive pulley by passing through a bottom plate of the washing tub.

13. A dish washing machine, comprising:

a body;

a washing tub disposed inside the body;

a fixed nozzle positioned on one side of the washing tub to inject wash water into the washing tub;

a vane configured to moveable inside the washing tub and to reflect the wash water injected from the fixed nozzle upwardly into the washing tub; and a drive unit configured to drive the vane, wherein the drive unit comprises a motor configured to generate a driving force;

a belt including a belt body having a belt portion and a tooth, and a core wire buried in the belt body, and configured to transfer the driving force of the motor to the vane;

a rail configured to guide movement of the vane;

a drive pulley disposed on one side of the rail and connected to the belt and a driving shaft of the motor;

an idle pulley disposed on the other side of the rail and connected to the belt; and a rear holder to rotatably support the drive pulley, the rear holder being coupled to one end of the rail by tension of the belt; and a front holder to rotatably support the idle pulley, the front holder being coupled to the other end of the rail by the tension of the belt.

14. The dish washing machine of claim 13, wherein the belt body is formed of polyurethane, and the core wire includes aramid fibers.

15. The dish washing machine of claim 13, wherein the rail has an elongated shape with an internal space and a lower opening formed at a lower portion thereof.

16. The dish washing machine of claim 15, wherein the belt is disposed in the internal space of the rail.

17. The dish washing machine of claim 16, wherein the drive unit further comprises a belt holder coupled with the tooth of the belt to move along the belt in the internal space of the rail.

18. The dish washing machine of claim 17, wherein the drive unit further comprises a vane holder formed to surround an outer surface of the rail, coupled with the belt holder through the lower opening to move along the belt holder, and coupled with the vane.

19. A dish washing machine, comprising:

a body;

a washing tub disposed inside the body;

a fixed nozzle positioned on one side of the washing tub to inject wash water into the washing tub;

a vane configured to be moveable inside the washing tub to reflect the wash water injected from the fixed nozzle toward storage baskets configured to hold dishes positioned above the vane; and a drive unit configured to drive the vane, wherein the drive unit comprises a motor configured to generate a driving force;

a rail configured to guide movement of the vane;

a belt, connected to a drive pulley and an idle pulley, including a belt body having a belt portion and a tooth, and a core wire buried in the belt body, to transfer the driving force of the motor to the vane;

a rear holder to rotatably support the drive pulley, the rear holder being coupled to one end of the rail by a tension of the belt;

a front holder to rotatably support the idle pulley, the front holder being coupled to the other end of the rail by the tension of the belt; and a tension control device configured to control the tension of the belt.

20. The dish washing machine of claim 19, wherein the tension control device includes an elastic member coupled to a rotary shaft of an idle pulley to apply pressure to the idle pulley in a direction in which a tension is applied to the belt.

21. The dish washing machine of claim 19, wherein the tension control device includes a position controller configured to move an idle pulley in a longitudinal direction of the rail.

22. The dish washing machine of claim 21, wherein the position controller includes a slide member coupled with a rotary shaft of the idle pulley and movable in the longitudinal direction of the rail.

23. The dish washing machine of claim 22, wherein the position controller includes a control member configured to apply pressure to the slide member so as to move the slide member.

24. The dish washing machine of claim 23, wherein the control member includes a screw.

25. The dish washing machine of claim 20, wherein the tension control device includes a pressing device configured to apply pressure to an opposite surface to the tooth of the belt so as to control the tension of the belt.

26. The dish washing machine of claim 25, wherein the pressing device includes a press member in contact with the opposite surface to the tooth of the belt.

27. The dish washing machine of claim 26, wherein the pressing device includes a slide member coupled to the press member and movable in a direction perpendicular to the belt.

28. The dish washing machine of claim 27, wherein the pressing device include a control member configured to apply pressure to the slide member so as to move the slide member.

29. The dish washing machine of claim 28, wherein the control member includes a screw.

30. A dish washing machine comprising:

a body;

a washing tub provided in the body;

a fixed nozzle positioned at one side of the washing tub to inject wash water into the washing tub;

a vane moveable within the washing tub, the vane including a reflection surface configured to reflect the wash water injected from the fixed nozzle toward dishes; and a drive unit to reciprocally move the vane in the washing tub, the drive unit comprising:

a motor, having a shaft, configured to generate a driving force a belt, connected to a drive pulley coupled to the shaft and an idle pulley, configured to transfer the driving force of the motor to the vane, a belt holder coupled to the belt to move along with the belt, a vane holder coupled to the belt holder and the vane, and a rail formed approximately perpendicular to the vane to guide movement of the vane;

a rear holder to rotatably support the drive pulley, the rear holder being coupled to one end of the rail by tension of the belt; and a front holder to rotatably support the idle pulley, the front holder being coupled to the other end of the rail by the tension of the belt.

31. The dish washing machine according to claim 30, wherein the front holder includes a device to adjust the tension of the belt.

32. The dish washing machine according to claim 30, wherein the rail comprises an inner space and a lower opening formed at a lower portion of the rail, the belt being positioned in the inner space.

33. The dish washing machine according to claim 30, wherein the shaft of the motor is coupled to the drive pulley by passing through a bottom plate of the washing tub.

* * * * *